US008500238B2

(12) United States Patent
Sato et al.

(10) Patent No.: US 8,500,238 B2
(45) Date of Patent: Aug. 6, 2013

(54) CAP DEVICE AND LIQUID EJECTING APPARATUS

(75) Inventors: Seiya Sato, Nagano (JP); Hiroshi Satoh, Yamanashi (JP); Hiroshige Owaki, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 33 days.

(21) Appl. No.: 13/249,018

(22) Filed: Sep. 29, 2011

(65) Prior Publication Data

US 2012/0147090 A1 Jun. 14, 2012

(30) Foreign Application Priority Data

| | | |
|---|---|---|
| Dec. 10, 2010 | (JP) | 2010-275937 |
| Dec. 10, 2010 | (JP) | 2010-275938 |
| Dec. 10, 2010 | (JP) | 2010-275939 |
| Dec. 10, 2010 | (JP) | 2010-275940 |
| Dec. 10, 2010 | (JP) | 2010-275941 |
| Dec. 10, 2010 | (JP) | 2010-276277 |
| Dec. 10, 2010 | (JP) | 2010-276278 |
| Dec. 10, 2010 | (JP) | 2010-276279 |
| Dec. 10, 2010 | (JP) | 2010-276280 |

(51) Int. Cl.
*B41J 2/165* (2006.01)

(52) U.S. Cl.
USPC ..... 347/32

(58) Field of Classification Search
USPC ..... 347/32
See application file for complete search history.

(56) References Cited

U.S. PATENT DOCUMENTS

| | | | | |
|---|---|---|---|---|
| 7,111,921 | B2 * | 9/2006 | Yoshida | 347/32 |
| 7,530,664 | B2 * | 5/2009 | Shimazaki et al. | 347/32 |
| 2009/0303282 | A1 * | 12/2009 | Yamamoto | 347/32 |

FOREIGN PATENT DOCUMENTS

| | | |
|---|---|---|
| JP | 11-138830 | 5/1999 |
| JP | 2000-255075 | 9/2000 |
| JP | 2004-230711 | 8/2004 |
| JP | 2005-125759 | 5/2005 |
| JP | 2008-221702 | 9/2008 |
| JP | 2008-229892 | 10/2008 |
| JP | 2009-297920 | 12/2009 |
| JP | 2010-058449 | 3/2010 |

* cited by examiner

*Primary Examiner* — Matthew Luu
*Assistant Examiner* — Michael Konczal
(74) *Attorney, Agent, or Firm* — Workman Nydegger

(57) ABSTRACT

A cam roller is engaged with a first engaged surface facing downward in a lifting and lowering direction of a cap and moves so as to follow the rotation trajectory about a shaft in the upward direction approaching a liquid ejecting head and in the downward direction separating from the liquid ejecting head. In addition, in the lifting and lowering direction of the cap, the cam roller is engaged from above with a second engaged surface which faces upward at a position lower than the first engaged surface and the first engaged surface has a plane portion as a non-overlapped area which does not overlap the second engaged surface in a direction perpendicular to both of the lifting and lowering direction and the direction of the shaft in a range that the cam roller follows the rotation trajectory about the shaft.

4 Claims, 54 Drawing Sheets

CAP DEVICE AND LIQUID EJECTING APPARATUS

The entire disclosure of Japanese Patent Application Nos. 2010-275939, filed Dec. 10, 2010, 2010-275937, filed Dec. 10, 2010, 2010-276277, filed Dec. 10, 2010, 2010-275938, filed Dec. 10, 2010, 2010-276278, filed Dec. 10, 2010, 2010-275940, filed Dec. 10, 2010, 2010-276279, filed Dec. 10, 2010, 2010-275941, filed Dec. 10, 2010, 2010-276280, filed Dec. 10, 2010 are expressly incorporated by reference herein.

TECHNICAL FIELD

The present invention relates to a cap device capable of capping a liquid ejecting head which ejects liquid and a liquid ejecting apparatus having the cap device.

BACKGROUND ART

Conventionally, as a liquid ejecting apparatus which ejects liquid onto a medium, for example, a ink jet printer disclosed in PTL 1 is proposed. The printer performs the printing onto a medium by ejecting ink (liquid) from a nozzle of a recording head (liquid ejecting head) mounted on a carriage which reciprocates.

In addition, in such a printer, a cap device is disposed in the vicinity of a home position where the carriage waits when the printing is not performed on to a medium. This cap device is attached on a surface of a holder which is a rigid body. In addition, the cap device lifts the holder to approach the recording head after the carriage (recording head) moves to the home position. Accordingly, a cap member which is integrally displaced (lifts) along with the holder comes into close contact with a nozzle-formation surface of the recording head so as to cover the nozzle.

CITATION LIST

Patent Literature

[PTL 1] JP-A-2004-230711

SUMMARY OF INVENTION

Technical Problem

Meanwhile, in the cap device, there is a case where the cap member is desired to be cleaned. In such a case, the cap member is removed from the holder. However, in the above printer, whenever the cap member is removed from the holder, it is necessary that a fixing member (for example, a bolt) which fixes the cap member and the holder is removed from the cap device and whenever the cap member is mounted onto the holder, it is necessary that the above fixing member is attached to the cap device. Therefore, in the above printer, there is a problem in that the operations of attaching and detaching the cap member to and from the holder are not easily performed.

The present invention has been made in consideration of the above-described circumstances, the object thereof is to provide a cap device and a liquid ejecting apparatus which are capable of easily performing the operations of attaching and detaching the cap member.

Solution to Problem

In order to achieve the above-described object, according to the present invention, there is provided a cap device including: a cap unit that can come into contact with a liquid ejecting head having a nozzle, which ejects liquid, so as to cover the nozzle; and a lifting member that rotates to be engaged with the cap unit on the basis of a driving force from a driving source and that moves the cap unit in a lifting and lowering direction approaching and separating from the liquid ejecting head, wherein, in response to the rotation in one direction about a shaft perpendicular to the lifting and lowering direction, in the lifting member, an engaging portion with the cap unit is engaged from below with a first engaged surface facing downward in the lifting and lowering direction of the cap unit and the lifting member moves so as to follow the rotation trajectory about the shaft in the upward direction approaching the liquid ejecting head, wherein, in response to the rotation in the other direction about the shaft, the engaging portion with the cap unit moves so as to follow the rotation trajectory about the shaft in the downward direction separating from the liquid ejecting head and the lifting member is engaged from above with a second engaged surface which faces upward at a position lower than the first engaged surface in the lifting and lowering direction of the cap unit, and wherein, in response to the rotation of the lifting member, the first engaged surface has a non-overlapped area in which the engaging portion does not overlap the second engaged surface in a direction perpendicular to both of the lifting and lowering direction and the shaft direction in a range of the rotation trajectory about the shaft.

According to this configuration, in a state where the engaging portion of the lifting member is disposed so as to correspond to the non-overlapped area with the second engaged surface in the first engaged surface of the cap unit, when the cap unit is moved such that the non-overlapped area is separated from the engaging portion of the lifting member in the lifting and lowering direction, the second engaged surface does not interfere with the lifting member. Accordingly, the cap unit can be easily attached and detached.

In the cap device according to the present invention, the engaging portion of the lifting member moves while following the rotation trajectory about the shaft in the upward direction approaching the liquid ejecting head and is engaged with the non-overlapped area with the first engaged surface in the cap unit in a state of approaching closest to the liquid ejecting head.

According to this configuration, when the engaging portion of the lifting member approaches closest to the liquid ejecting head, the engaging portion is engaged with the non-overlapped area with the first engaged surface in the cap unit from below and the cap unit also approaches closest to the liquid ejecting head. In addition, in this case, since the cap unit is typically in contact with the liquid ejecting head from below, the cap unit is pinched by the liquid ejecting head and the engaging portion of the lifting member from above and below, thereby preventing the cap unit from inadvertently being removed.

In the cap device according to the present invention, the lifting member separately includes a first engaging portion that is engaged with the first engaged surface and a second engaging portion that is engaged with the second engaged surface.

According to this configuration, the shifting time from the engaged state with the first engaged surface to the engaged state with the second engaged surface can be shortened, as compared to a case where one engaging portion is engaged with the first engaged surface and the second engaged surface which are separated from each other in the lifting and lowering direction of the capping unit. Accordingly, the cap unit can be moved up and down in a short period of time.

In the cap device according to the present invention, the cam unit includes a cap member having: a holder member that has the first engaged surface and the second engaged surface; a biasing member that is supported by the holder member along the lifting and lowering direction as a biasing direction; and a contact portion that is supported by the holder member through the biasing member and comes into contact with the liquid ejecting head to cover the nozzle in a state where the engaging portion of the lifting member is engaged with the non-overlapped surface of the first engaged surface in the holder member.

According to this configuration, when the cap holder further lifts in a state where the contact portion of the cap unit is in contact with the liquid ejecting head, the biasing member which is interposed between the cap holder and the cap member is compressed to increase the biasing force to the cap member. As a result, the contact portion of the cap member in the cap unit can come into close contact with the liquid ejecting head on the basis of the biasing force of the biasing member.

According to the present invention, there is provided a liquid ejecting apparatus including a liquid ejecting head having a nozzle which ejects liquid and a cap device having the above-described configuration.

According to this configuration, a liquid ejecting apparatus which achieves the same effect as that of the cap device according to the invention can be obtained.

An object of the present invention is to provide a driving mechanism of a rotation member which can quickly and reliably switch the rotation of the rotation member (gear) using fewer driving sources and a liquid ejecting apparatus having the driving mechanism.

In order to achieve the above object, according to the present invention, there is provided a driving device of the rotation member including: a sun gear that is rotated by a driving force from a driving source; a planetary gear that meshes with the sun gear to rotate and in which a rotation shaft portion can perform revolving movement about the rotation center of the sun gear; a first rotation member that is engaged with the rotation shaft portion of the planetary gear and rotates along with the revolving movement of the rotation shaft portion; a second rotation member that has a internal tooth gear meshing with the planetary gear and rotates about the concentric axis of the sun gear; and a suppressing member that suppresses the rotation of the second rotation member by being displaced along with the rotation of the first rotation member, wherein the planetary gear performs the revolving movement due to the rotation of the sun gear in one direction to rotate the first rotation member in one direction and thus the suppressing member is displaced to suppress the rotation of the second rotation member, wherein due to the additional rotation of the sun gear in one direction, the first rotation member continuously rotates in one direction in a state where the rotation of the second rotation member stops, wherein the planetary gear performs the revolving movement in the other direction due to the rotation of the sun gear in the other direction to rotate the first rotation member in the other direction and thus the displacement of the suppressing member is recovered to release the rotation of the second rotation member, and wherein due to the additional rotation of the sun gear in the other direction, the rotation of the first rotation member stops and the second rotation member rotates in one direction.

According to this configuration, in a gear configuration in which the planetary gear meshes with the sun gear and the internal gear of the second rotation member, the planetary gear performs the revolving movement to rotate the first rotation member by suppressing the rotation of the second rotation member. Meanwhile, the first rotation member stops and the second rotation member rotates by restricting the rotation of the first rotation member and releasing the suppression for the rotation of the second rotation member. As a result, as a transmitting member transmitting the rotation of the sun gear (that is, driving source), the switching to either the first rotation member or the second rotation member can be performed. In this way, plural rotation members are selectively rotated by one driving source. In addition, since the rotation stop of the first rotation member and the rotation of the second rotation member simultaneously are performed, a driven rotation member can be quickly switched. Furthermore, since the planetary gears are positioned between the internal gear of the second rotation member and the sun gear so as to mesh with each other, tooth skipping of the planetary gear can be prevented. Therefore, the rotation can be reliably transmitted.

In the driving mechanism of rotation member according to the present invention, the suppressing member includes an engaging portion that is engaged with the first rotation member and a suppressing portion that suppresses the rotation of the second rotation member, wherein, in the first rotation member, a first cam portion and a second cam portion which displace the engaging portion to different positions in directions approaching and being away from the rotation center of the first rotation member are provided, wherein, when the engaging portion is engaged with one of the first cam portion and the second cam portion, the suppressing portion is engaged with the second rotation member to restrict the rotation of the second rotation member, and wherein, when the engaging portion is engaged with the other one of the first cam portion and the second cam portion, the suppressing portion releases the engagement with the second rotation member to release the suppression for the rotation of the second rotation member.

According to this configuration, the suppressing portion suppressing the rotation of the second rotation member in response to the rotation of the first rotation member can be displaced. Therefore, when the first rotation member rotates, the rotation of the second rotation member is suppressed to stop the rotation. Accordingly, a rotation member which is rotated by one driving source can be made one. As a result, a desired driving target corresponding to, for example a rotation member which rotates can be selected and driven.

In the driving mechanism of rotation member according to the present invention, the engaging portion of the second cam portion is displaced with respect to the first cam portion in a direction approaching the rotation center of the first rotation member, wherein, when the sun gear rotates in one direction, the engaging portion immediately moves from the state of being engaged with the first cam portion to the state of being engaged with the second cam portion and thus the first rotation member rotates while the suppressing member suppresses the rotation of the second rotation member, and wherein, when the sun gears rotates in the other direction, the engaging portion immediately moves from the state of being engaged with the second cam portion to the state of being engaged with the first cam portion, the engaging portion thus restricts the rotation of the first rotation member to stop the rotation in the other direction, and the second rotation member rotates in one direction.

According to this configuration, in response to the rotation direction of the sun gear (driving source), the switching can be performed such that either the first rotation member or the second rotation member rotates. In addition, since the engaging portion immediately shifts from the state of being engaged with the first rotation member to the state of being engaged with the second rotation member due to the rotation of the first rotation member, the displacement of the engaging portion can be rapidly performed. As a result, since the rotation of the second rotation member can be suppressed and the suppression thereof can be released due to the rapid displacement of the suppressing member, the rotation members which are rotated by a single driving source can be rapidly switched.

In the driving mechanism of rotation member according to the present invention, among the engaging portion and the suppressing portion of the suppressing member, one is axially supported by the other so as to rotate and the suppressing portion is connected to the engaging portion in a state where the rotational force is applied to the engaging portion by biasing means so as to rotate to be displaced, wherein the second rotation member has external teeth in the outer circumference and the suppressing member suppresses the rotation of the second rotation member by meshing with the external teeth of the second rotation member.

According to this configuration, for example, when the suppressing portion does not mesh with the external teeth and comes into contact with the tip of a external tooth, the damage of the external teeth or the suppressing portion caused by the suppressing portion rotating to the engaging portion is prevented.

According to the present invention, there is provided a liquid ejecting apparatus including: a liquid ejecting head that ejects liquid; a cap that covers the liquid ejecting head along with the rotation of a first rotation member; a suction pump that is driven for suctioning the liquid from the liquid ejecting head along with the rotation of a second rotation member; and a driving mechanism of rotation member having the above-described configuration.

According to this configuration, due to the driving mechanism of rotation member which can rapidly or reliably switch the rotation of the rotation member using a small driving source, a liquid ejecting apparatus capable of capping a liquid ejecting head and suctioning liquid can be obtained.

An object of the present invention is to provide a cap device, a maintenance device, and a liquid ejecting apparatus which can secure a large lifting and lowering stroke of a cap while suppressing the increase in size of the entire apparatus.

In order to achieve the above-described object, according to the present invention, there is provided a cap device including: a cap that can come into contact with a liquid ejecting head having a nozzle, which ejects liquid, so as to cover the nozzle; and a lifting and lowering mechanism that moves the cap in a lifting and lowering direction approaching and separating from the liquid ejecting head, wherein the lifting and lowering mechanism has a driving lever that rotates about a shaft on the basis of a driving force from a driving source and a driven lever including a first connecting portion which is rotatably connected to a portion being away from the shaft in the driving lever and a second connecting portion which is rotatably connected to the cap at a position being away from the first connecting portion.

According to this configuration, in the lifting and lowering mechanism, when the driving lever rotates about the shaft on the basis of the driving force transmitted from the driving source lifting and lowering mechanism, the first connecting portion of the driven lever is displaced along with the driving lever. In addition, the second connecting portion of the driven lever is displaced along with the displacement of the first connecting portion. Accordingly, the cap member is operated (lifted and lowered) so as to approach or be separated from the liquid ejecting head. In this case, the second connecting portion of the driven lever is displaced relative to the first connecting portion being displaced. Therefore, a relatively large lifting and lowering stroke of the cap member can be secured as compared to a case where only the driving lever operates the cap member without the driven lever. That is, a large lifting and lowering stroke of the cap can be secured while decreasing the size of the driving lever and suppressing the increase in size of the entire apparatus.

In the cap device according to the present invention, in the lifting and lowering mechanism, the distance between the first connecting portion and the second connecting portion in the driven lever is larger than the distance between a position connecting to the first connecting portion of the driven lever and the shaft as the rotation center in the driving lever.

According to this configuration, in the lifting and lowering mechanism, for example, from a state where the driving lever and the driven lever overlap with each other in parallel, when the first connecting portion of the driven lever is displaced upward to revolve about the rotation shaft along with the driving lever such that the first connecting portion is positioned at a position closer to the lower section of the driving lever and the driven lever, the second connecting portion of the driven lever lifts so as to further approach the liquid ejecting head rather than the driving lever. That is, in the lifting and lowering mechanism, since the second connecting portion of the driven lever is displaced further upward along with the operation of the driving lever relative to the first connecting portion which is displaced upward, a large lifting and lowering stroke of the cap member can be secured.

In the cap device according to the present invention, the first connecting portion is provided at one end in the longitudinal direction of the driven lever and the second connecting portion is provided at the other end thereof.

According to this configuration, the distance between the first connecting portion and the second connecting portion of the driven lever can be secured to the maximum. Therefore, the configuration in which the distance between the first connecting portion and the second connecting portion of the driven lever is larger than the distance between the rotation shaft and the first connecting portion can be realized without increasing the size of the driven lever. Therefore, a large lifting and lowering stroke of the cap can be secured while decreasing the size of the driven lever and suppressing the increase in size of the entire apparatus.

A maintenance device according to the present invention includes a cap device having the above-described configuration and a suction pump that is driven when suctioning the inside of the cap.

According to this configuration, a maintenance device which achieves the same effect as that of the cap device according to the invention can be obtained.

A liquid ejecting apparatus according to the present invention includes a liquid ejecting head having a nozzle which ejects liquid and a maintenance device having the above-described configuration which performs the maintenance operation of the liquid ejecting head.

A main object of the present invention is to realize, using fewer driving sources, a small maintenance device which includes at least a first cap, a second cap, and a wiping member having different functions. Further, an object is to provide a liquid ejecting apparatus having such a maintenance device.

In order to achieve the above-described objects, according to the present invention, there is provided a maintenance device including: a wiping member that wipes a liquid ejecting head ejecting liquid onto a medium; a first cap that forms a closed space by coming into contact with the liquid ejecting head; a second cap that forms a closed space by coming into contact with the liquid ejecting head for another functional purpose different from the first cap; a first gear and a second gear that are rotated by a driving force from a single driving source and that are configured in which, when one of the gears is rotated by switching means, the other does not rotate; a third gear that, due to the rotation, moves between a contact position where the suction cap comes into contact with the liquid ejecting head and a separating position where the suction cap is separated from the liquid ejecting head; a fourth gear that, due to the rotation, moves between a start position where the wiping member starts wiping the liquid ejecting head and an end position where the wiping member ends wiping the liquid ejecting head; and a fifth gear that, due to the rotation, moves between a contact position where the second cap comes into contact with the liquid ejecting head and a separating position where the second cap is separated from the liquid ejecting head, wherein the third gear and the fourth gear can mesh with the first gear, and wherein the fifth gear can mesh with the second gear.

According to this configuration, the second cap can be moved separate from the first cap and the wiping member by a single driving source. Therefore, since plural function components for maintenance of the head are respectively moved by a single driving source, the size of a maintenance device having plural maintenance functions can be decreased.

In the maintenance device according to the present invention, among the third gear and the fourth gear, the first gear does not mesh with the fourth gear when meshing with the third gear and does not mesh with the third gear when meshing with fourth gear.

According to this configuration, since the first cap and the wiping member do not simultaneously move, the first cap and the wiping member can move without interfering with each other. Therefore, since the first cap can share a movement area with the wiping member, a small maintenance device can be realized.

In the maintenance device according to the present invention, from the state where, due to the rotation of the first gear, the first cap is in the separating position and the wiping member is in the end position, the second cap moves to the contact position by being switched to the rotation of the second gear by the switching means.

According to this configuration, the liquid ejecting head can move to a position opposite to the second cap using a single driving source without interfering with the first cap and the wiping member. Therefore, since the first cap, the wiping member, and the second cap can be disposed adjacent to each other, the small maintenance device having plural maintenance functions can be realized.

The maintenance device according to the present invention is moved in directions approaching and separating from the liquid ejecting head by the rotation of the third gear and includes a liquid containing member that contains the liquid ejected from the liquid ejecting head, wherein, due to the rotation of the third gear in one direction, the first cap moves from the contact position to the separating position, wherein, due to the rotation of the third gear in the other direction, the first cap is maintained at the separating position, and wherein the liquid containing member moves such that the distance between the liquid containing member and the liquid ejecting head is a predetermined distance.

According to this configuration, the first cap can move the liquid containing member while maintaining at the separating position. Therefore, the liquid ejecting head can be moved to a position opposite to the liquid containing member without interfering with the first cap, and then the liquid containing member can be moved such that the distance between the liquid containing member and the liquid ejecting head is a predetermined distance. Therefore, liquid ejection check which uses, for example, a potential change between the liquid ejecting head and the liquid containing member can be reliably performed without increasing a driving source.

The maintenance device according to the present invention includes a cover member which covers a containing surface of the liquid of the liquid containing member, wherein the cover member moves from a cover-opened position of not covering the containing surface to a cover-closed position of covering the containing surface along with the movement of the second cap from the separating position to the contact position due to the rotation of the fifth gear.

According to this configuration, the containing surface of the liquid containing member can be covered without increasing a diving source. Therefore, a small maintenance device having maintenance functions maintained can be realized by restricting, for example, drying the liquid contained in the liquid containing member.

The maintenance device according to the present invention includes a sixth gear that, due to the rotation, drives a suction pump which reduces the pressure in the closed space formed by the first cap coming contact into contact with liquid ejecting head, wherein, when the first gear rotates in the other direction after the first cap is positioned in the contact position by the rotation of the third gear rotating due to the rotation of the first gear in one direction, the first cap is maintained at the contact position and wherein, when the rotation of the first gear in the other direction is switched to the rotation of the second gear by the switching means, the suction pump is driven in the state where the first cap is maintained at the contact position.

According to this configuration, the first pump can be driven to suction liquid by a single driving source. Therefore, a small maintenance device can be realized.

According to the present invention, there is provided a liquid ejecting apparatus including a liquid ejecting head that ejects liquid onto a medium and a maintenance device having the above-described device.

An object thereof is to provide a cap device having the transmission mechanism which restricts the action of one-way clutch. In addition, the object thereof is to provide a head maintenance device having such a head cap device and a liquid ejecting apparatus having such a head maintenance device.

In order to achieve the above-described objects, according to the present invention, there is provided a cap device including a transmitting mechanism that transmits the rotation of a driving side member to a driven-side member and a cap that moves between a contact position where the cap comes into contact with a liquid ejecting head which ejects liquid using the rotation of the driven-side member and a separating position where the cap is separated from the liquid ejecting head, wherein the transmitting mechanism transmits only the rotation of the driving-side member in one direction to the driven-side member in a state where the cap reaches the contact position, and wherein the transmitting mechanism transmits the rotation of the driving-side member in both one and the other directions to the driven-side member during at least one of a period in which the cap moves from the contact position to the separating position and or a period in which the cap moves from the separating position to the contact position.

According to this configuration, for example, in a case where the cap lifts, when the cap is hindered from lifting by an obstacle, the rotation of the driving-side member in both directions is transmitted to the driven side. Accordingly, the cap can be returned during the lifting. Alternatively, in a case where the cap lowers due to the forward rotation of the motor, when the cap is pressed in the lowering direction, the driving-side member rotates during the lowering movement. Accordingly, the lowering movement is restricted by the rotational load of the driving-side member (motor). Therefore, the cap is restricted from rapidly dropping during the lowering movement without using biasing means such as a coil spring.

In the cap device according to the present invention, the transmitting mechanism includes an engaging member one end of which is axially supported by the driven-side member so as to rotate and the other end of which has an engaging claw engaged with the driving-side member, wherein due to the rotation of the driving-side member in one direction, the engaging claw is engaged with the driving-side member and the rotation of the driving-side member is transmitted to the driven-side member, wherein due to the rotation of the driving-side member in the other direction, the engaging member rotates to release the engagement between the engaging claw and the driving-side member and the rotation of the driving-side member is not transmitted to the driven-side member, and wherein the transmitting mechanism is provided with a rotation suppressing portion which suppresses the rotation of the engaging member to suppress the engagement between the engaging claw and the driving-side member from releasing during at least one of a given rotation period of the driven-side member in which the cap moves from the separating position to the contact position and a given rotation period of the driven-side member in which the cap moves from the contact position to the separating position.

According to this configuration, since the rotation of the engaging member is suppressed by the rotation suppressing portion, a period in which the one-way clutch does not act can be set. Therefore, the period in which the one-way clutch transmitting the rotation of the driving-side member in both directions to the driven-side member without using a complex clutch mechanism does not act can be easily set.

In the cap device according to the present invention, in a state where the cap reaches the contact position, the rotation suppressing portion is not formed such that the engaging member rotates to release the engagement with the driving-side member due to the rotation of the driving-side member in the other direction.

According to this configuration, in the state where the cap is in contact with the liquid ejecting head, the one-way clutch can be made to act. Therefore, using the rotation in the other direction of the driving-side member which makes the one-way clutch to act while maintaining the state where the cap is in contact with the liquid ejecting head, the other function components can be made to operate.

In the cap device according to the invention, in a state where the cap reaches the separating position, the rotation suppressing portion is not formed such that the engaging member rotates to release the engagement with the driving-side member due to the rotation of the driving-side member in the other direction.

According to this configuration, in the state where the cap is separated from the liquid ejecting head, the one-way clutch can be made to act. Therefore, using the rotation in the other direction of the driving-side member which makes the one-way clutch to act while maintaining the state where the cap is separated from the liquid ejecting head, the other function components can be made to operate.

According to the present invention, there is provided a head maintenance device including a cap device having the above-described configuration and a suction pump that reduces the pressure in the cap, wherein the suction pump is driven along with the rotation of the driving-side member in the other direction.

According to this configuration, for example, using the rotation of the driving-side member which makes the one-way clutch to act while maintaining the state where the cap is in contact with the liquid ejecting head, the suction pump is driven. As a result, the maintenance of the liquid ejecting head can be performed by reducing the pressure of the closed space formed by being in contact with the cap to suction ink from the liquid ejecting head. Alternatively, using the rotation of the driving-side member which makes the one-way clutch to act while maintaining the state where the cap is separated from the liquid ejecting head, the suction pump is driven. As a result, the maintenance of the cap can be performed by suctioning ink in the cap while the cap is opened to the atmosphere.

According to the present invention, there is provided a liquid ejecting apparatus including a liquid ejecting head that ejects liquid onto a medium and the head maintenance device which has the above configuration.

According to this configuration, the maintenance for a liquid ejecting head can be performed by a cap using a single driving source, and a liquid ejecting apparatus having a head maintenance device in which a cap does not rapidly lower during the lowering movement can be obtained.

DESCRIPTION OF EMBODIMENTS

Figure 1:
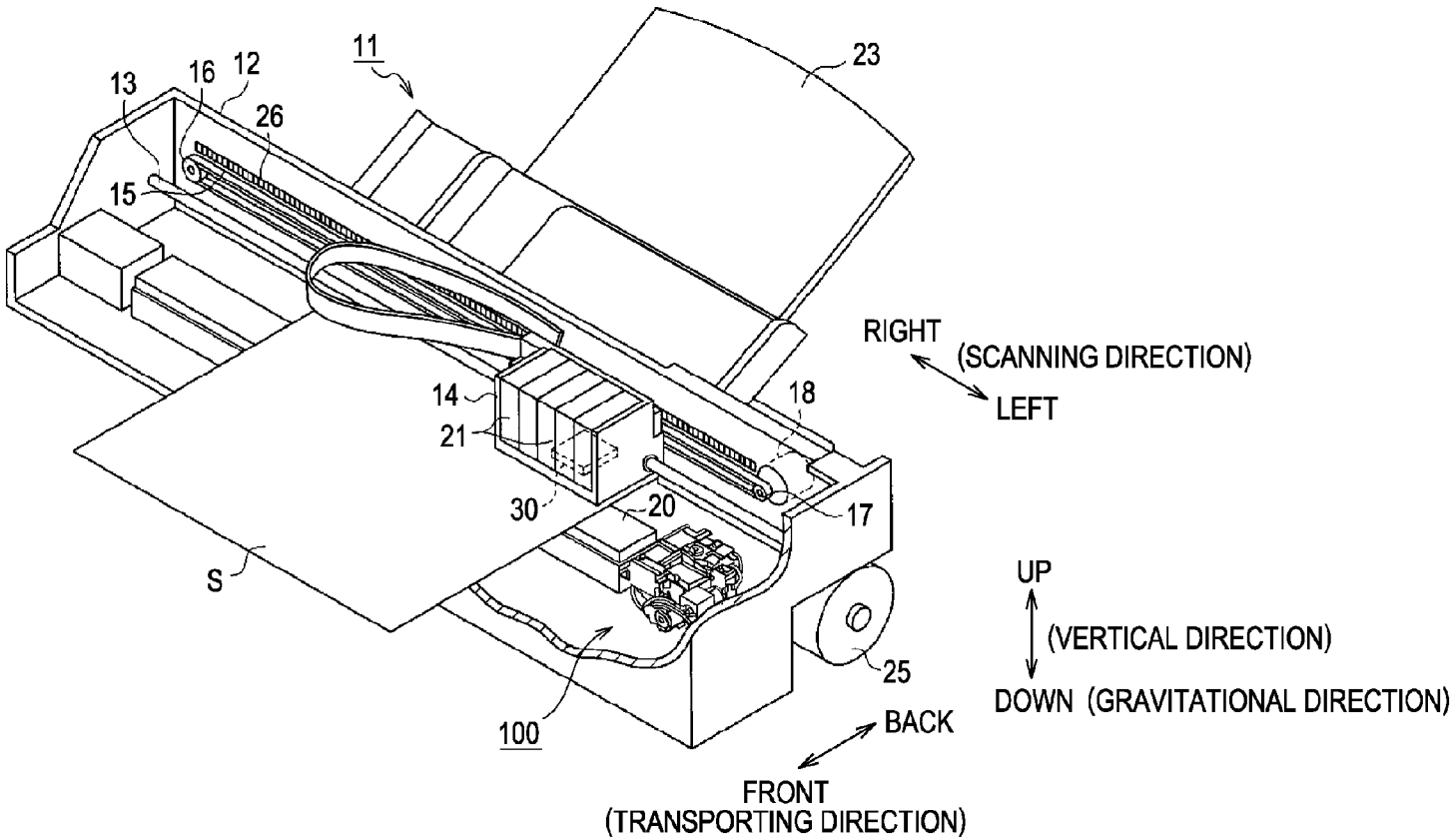
FIG. 1 is a perspective view schematically illustrating the configuration of a printer having a maintenance device according to an embodiment of the present invention.

Hereinafter, an embodiment in which the present invention is realized as an ink jet printer 11 which is a kind of liquid ejecting apparatus (hereinafter, also abbreviated as "printer") will be described with reference to the drawings. Here, for easy understanding of the following description, as shown in FIG. 1, among vertical directions, the gravitational direction is set as a down direction and the antigravitational direction is set as an up direction. In addition, among directions intersecting with the vertical directions, a transporting direction in which a sheet S fed into the printer 11 is transported when an image is formed is set as a front direction and a direction opposite to the transporting direction is set as a back direction. Further, as directions intersecting with both the gravitational direction and the transporting direction, directions in which a carriage 14 reciprocates, that is, scanning directions are called a left direction and a right direction, respectively when seen from the back.

As shown in FIG. 1, the printer 11 is provided such that a carriage 14 is guided along a carriage guide axis 3 which is installed across the inside of a substantially box-shaped main body case 12 having an opening upward and reciprocates in the left-right direction. An endless timing belt 15 fixed at the back side of the carriage 14 is wound around a pair of pulleys 16 and 17 arranged on the surface in a back plate of the main body case 12. In addition, the carriage 14 reciprocates in the left-right direction by rotating forwardly and reversely a carriage motor 18 which is connected so as to rotate along with one of the pulleys 16.

In a lower section of the carriage 14, an ink ejecting head 30 which ejects ink as a liquid is provided. In addition, a supporting plate 20, which supports the sheet S serving as an image-forming medium at a lower position opposite to the liquid ejecting head 30 in the main body case 12 and which defines a gap between the liquid ejecting head 30 and the sheet S, is arranged to extend in the left-right direction. Moreover, in an upper section of the carriage 14, an ink cartridge 21 containing ink is detachably loaded. In the present embodiment, the liquid ejecting head 30 includes plural head units (not shown, five head units in the present embodiment), which are arranged in the left-right direction, and ejects ink, which is supplied from the ink cartridge 21, from plural nozzle openings (not shown) which are provided in line below each of the head units in the front-back direction.

In a back side of the printer 11, a sheet-feeding tray 23 is provided. Each of the sheets S stacked on the sheet-feeding tray 23 are transported by plural transporting rollers (not shown) from the back side to the front side, that is, in the transporting direction and supplied between the liquid ejecting head 30 and the supporting plate 20. As shown in FIG. 1, each of the transporting rollers is driven by a sheet-feeding motor 25 which is disposed in the lower left direction of the main body case 12 in the printer 11 so as to transport the sheet S in the transporting direction. At this time, the sheet S to be transported is transported in contact with the above-described supporting plate 20 so as to be separated from the ink ejecting head 30 by a predetermined amount. Here, the ink ejecting head 30 is moved by a movement mechanism (not shown) in the up-down direction such that the distance between the ink ejecting head 30 and the sheet S is the predetermined amount corresponding to the thickness of the sheet S to be transported.

In addition, in the printer 11, a linear encoder 26 which outputs the number of pulses in proportion to the movement distance of the carriage 14 is provided so as to extend along the carriage guide axis 13. Using the pulses output from the linear encoder 26, data of the movement position, movement direction, and movement speed of the carriage 14 in the left-right direction are obtained. Based on the obtained data, the speed control and the position control of the carriage 14 in the left-right direction are performed. In addition, a character, an image, or the like is formed by the operation of ejecting ink toward the sheet S from the nozzle opening of the liquid ejecting head 30 while the carriage 14 reciprocates (scans) in the left-right direction and the operation of transporting the sheet S in the front direction by a predetermined transporting amount.

In the printer 11, a head maintenance device 100 is arranged on the left side of the supporting plate 20. That is, the position in which the maintenance device 100 is arranged is on the moving route of the carriage 14 in the left-right direction and is a position in which ink is not ejected onto the sheet S, that is, a home position. The maintenance device 100 includes plural function components in order to maintain the ejection characteristics of ink in the ink ejecting head 30. The function components are operated to perform the maintenance of the liquid ejecting head 30 at the home position. Further, all of the operations of the function components are performed by a single motor as a driving source.

In addition, the printer 11 includes, as a controller, a circuit substrate (not shown) mounting a control circuit which controls an image forming operation including the operation of moving the carriage 14, the operation of ejecting ink, and the operation of transporting the sheet S, other than the operations of the function components relating to the maintenance. The controller includes a CPU, an ASIC, and a memory.

Figure 2:
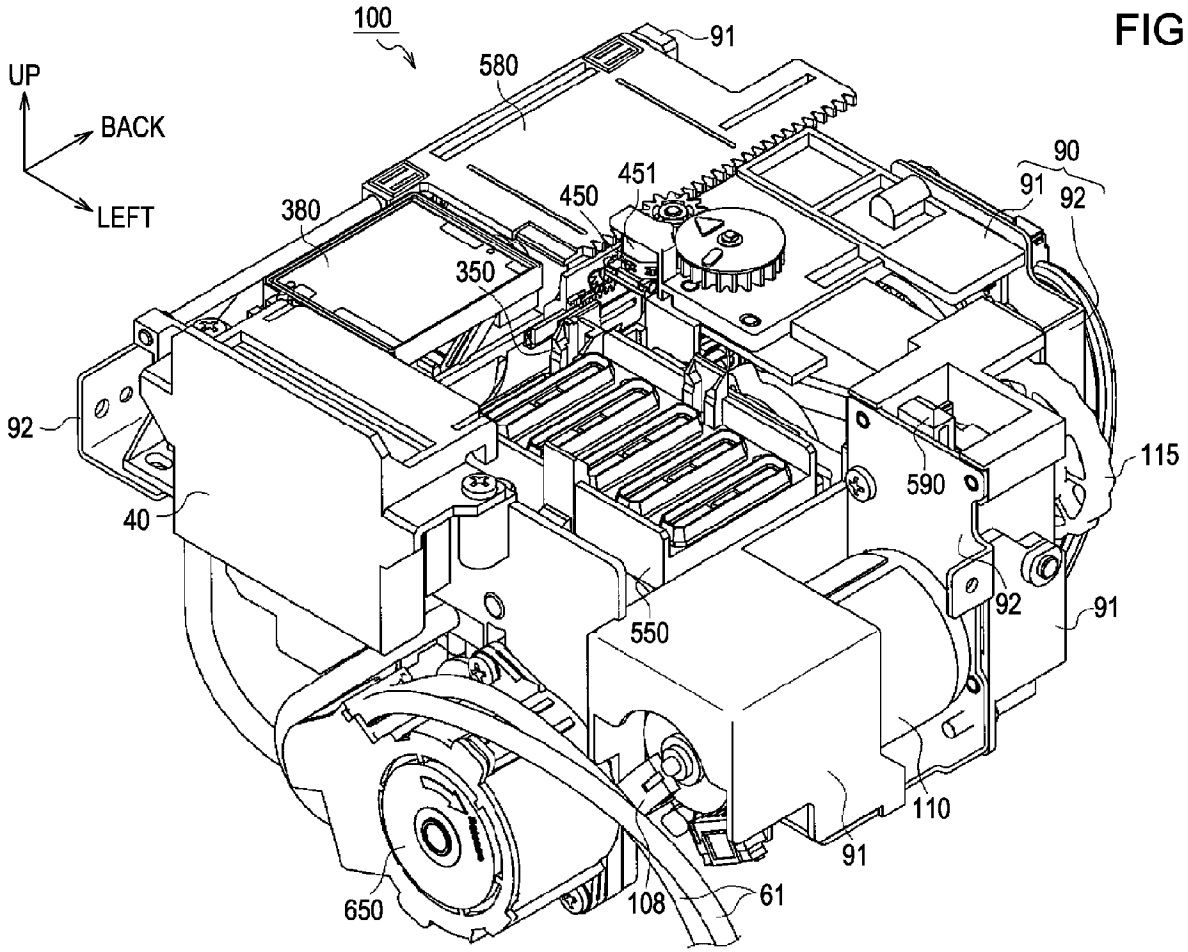
FIG. 2 is a perspective view illustrating the maintenance device according to the embodiment when seen from one direction.
Figure 3:
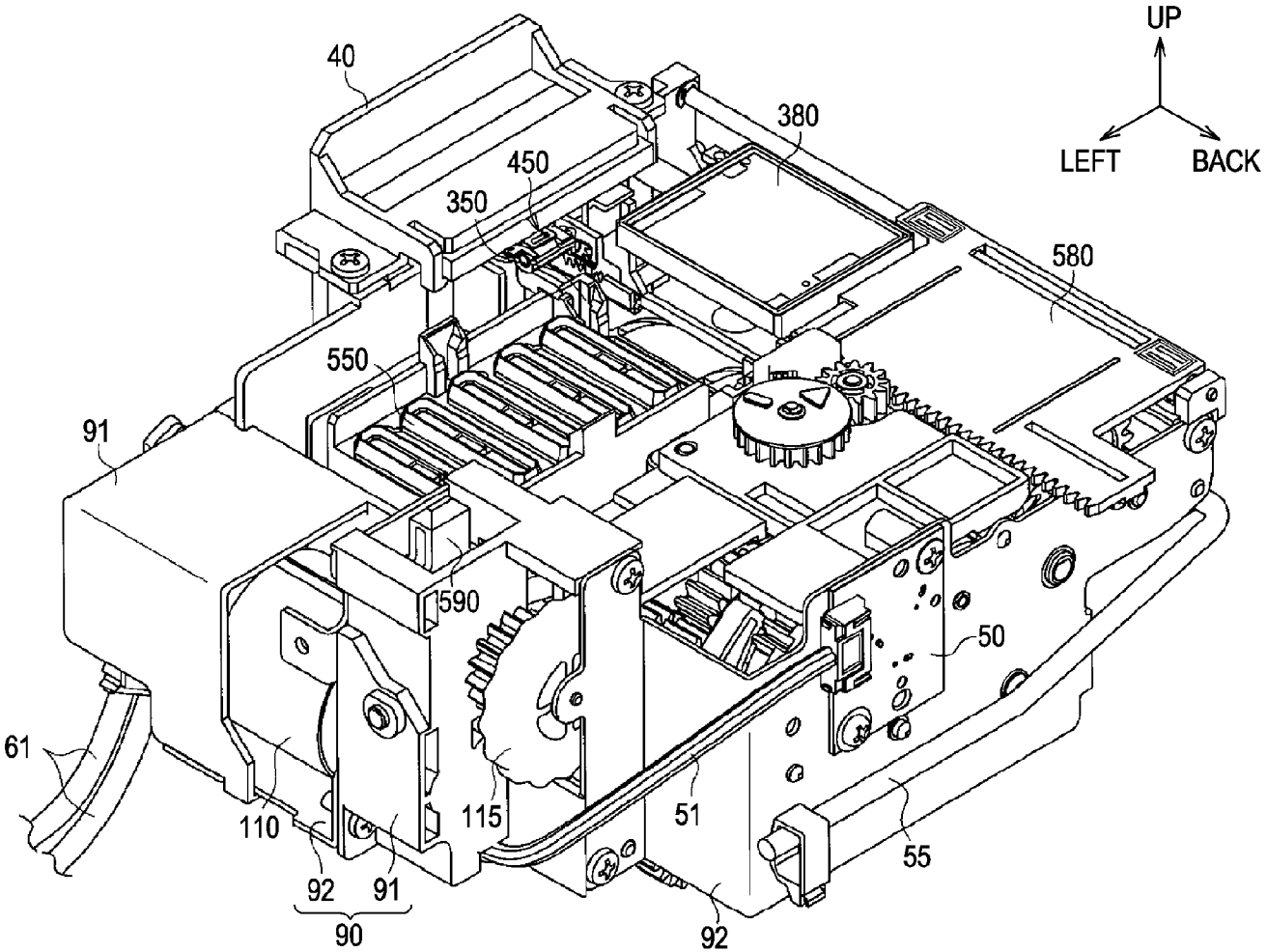
FIG. 3 is a perspective view illustrating the maintenance device according to the embodiment when seen from another direction.

Next, the configuration of the head maintenance device according to the present embodiment having plural function components relating to the maintenance (hereinafter, simply referred to as "maintenance device") 100 will be described with reference to FIGS. 2 and 3. Here, FIG. 2 is a perspective view illustrating the maintenance device 100 when seen from the same direction as that of FIG. 1, that is, the left-front direction. FIG. 3 is a perspective view illustrating the maintenance device 100 when seen from in the rear left direction different from FIGS. 1 and 2.

As shown in FIGS. 2 and 3, the maintenance device 100 according to the present embodiment includes a leaving cap 550 which comes into contact with the liquid ejecting head 30 being in a leaving state where ink is not ejected onto the sheet S so as to surround a nozzle and which forms a closed space. That is, the leaving cap 550 forms the closed space between a nozzle-formation surface of the liquid ejecting head 30 in which a nozzle is formed and the leaving cap 550 when turning off the printer 11, and functions as a function component which controls drying ink in the nozzle opening. In addition, the leaving cap 550 vertically moves so as to come into contact with or separate from (hereinafter, it is also referred as "come into contact with or separate from".) the liquid ejecting head 30 and thus functions as a cap device capping the liquid ejecting head 30. In addition, each of the nozzle openings is blocked from the atmosphere by covering all the nozzle openings of each of five head units provided in the liquid ejecting head 30.

In addition, the maintenance device 100 includes a carriage lock body 590 as a function component which locks the carriage 14 so as not to move in the left-right direction in a state where the leaving cap 550 comes into contact with the liquid ejecting head 30. The carriage lock body 590 can vertically move in the carriage 14 and locks the carriage 14 so as not to move in the left-right direction by engaging an engaging portion (not shown) provided in the carriage 14 with the carriage lock body 590 which is lifted.

In addition, the maintenance device 100 includes a suction cap 350 and a suction pump 650 as a function component which recovers the ejection characteristics of ink by suctioning, for example, thickened ink from the nozzle opening. The suction cap 350 vertically moves so as to come into contact with or separate from the liquid ejecting head 30 to function as a cap device capping the liquid ejecting head 30 for another functional purpose different from that of the leaving cap 550. Further, by the suction cap 350 being in contact with one nozzle unit among five head units provided in the liquid ejecting head 30 so as to surround a nozzle, the closed space in which the opening of the nozzle is blocked from the atmosphere is formed. In addition, in the state where the closed space is formed, the suction pump 650 reduces the pressure of the closed space covered with the suction cap 350 to suction ink from the nozzle opening. The suctioned ink is discharged through a discharge tube 61 to a waste ink tank (not shown) provided in the main body case of the printer 11.

In addition, the maintenance device 100 includes a wiping member 450 as a function component which wipes unnecessary ink attached to the nozzle opening of the nozzle-formation surface in the liquid ejecting head 30. The wiping member 450 includes a wipe blade 451 and reciprocates forward and backward. Further, with respect to the liquid ejecting head 30, by moving the wiper blade 451 from the back to the front along the arranging direction of the nozzle opening, unnecessary ink is acquired and wiped by the wiper blade 451. Here, in the present embodiment, the wiping member 450 moves on a space region above the suction cap 350 in the state where the suction cap 350 is separated from the liquid ejecting head 30.

Furthermore, the maintenance device 100 includes, as a function component, an ink absorption body 40 which can absorb ink acquired by the wiper blade 451 at an end in the movement direction of the wiper blade 451 which moves forward. The ink absorption body 40 partially comes into contact with the wiper blade 451 to transfer ink acquired by the wiper blade 451 to the ink absorption body 40, thereby absorbing the ink.

Meanwhile, in order to discharge an air bubble and thickened ink which are mixed into ink, the printer 11 performs the operation of forcibly ejecting ink, that is, the flushing operation. Therefore, the maintenance device 100 includes a flushing box (hereinafter, referred to as "FL box") 380 as a function component which contains ink ejected by the flushing operation. Further, the FL box according to the present embodiment (ink containing member) 380 can vertically moves. For example, in order to electrically check whether or not ink is ejected from the ink ejecting head 30 (referred to as "ink ejection check"), it is necessary that a gap between the liquid ejection head 30 and the FL box 380 is adjusted to be an optimal distance for the ink ejection check. Further, the suction pump 650 suctions ink from the suction cap 350 as well as ink ejected into the FL box 380.

In addition, the maintenance device 100 includes an FL box cover (cover member) 580 as a function component which covers an ink containing portion of the FL box 380 (here, upper opening) so as not to dry ink inside the FL box. That is, the FL box cover 580 can move in the front-back direction in order to block or open the region above the FL box 380 during non-use period of the printer 11 in which ink is not ejected onto the sheet S to form an image.

The above-described components of the maintenance device 100 are respectively disposed at predetermined positions in the maintenance device 100 by a frame structure 90 which is configured by plural frame members 91 made of resin and plural frame plates 92 made of metal and respectively performs the above-described operations. In addition, a circuit substrate 50, which outputs a detection signal for making each of the function components of the maintenance device 100 appropriately operate to the controller through a signal line 51, is attached to the frame structure 90.

The maintenance device 100 according to the present embodiment includes a single motor (DC motor) 110 as a driving source and rotates in response to an electric signal supplied through a input line 55. Further, the motor 110 is provided with a rotary encoder 108 which controls the rotation of the motor 110 by a pulse signal output in response to a rotation number. In addition, a driving mechanism which transmits the rotation of the motor 110 is configured such that the above-described plural function components for maintenance are operated by the rotation of the single motor 110. In addition, in a case where the motor 110 does not rotate, a hand-turned wheel 115 is provided for operating the function components.

Figure 4:
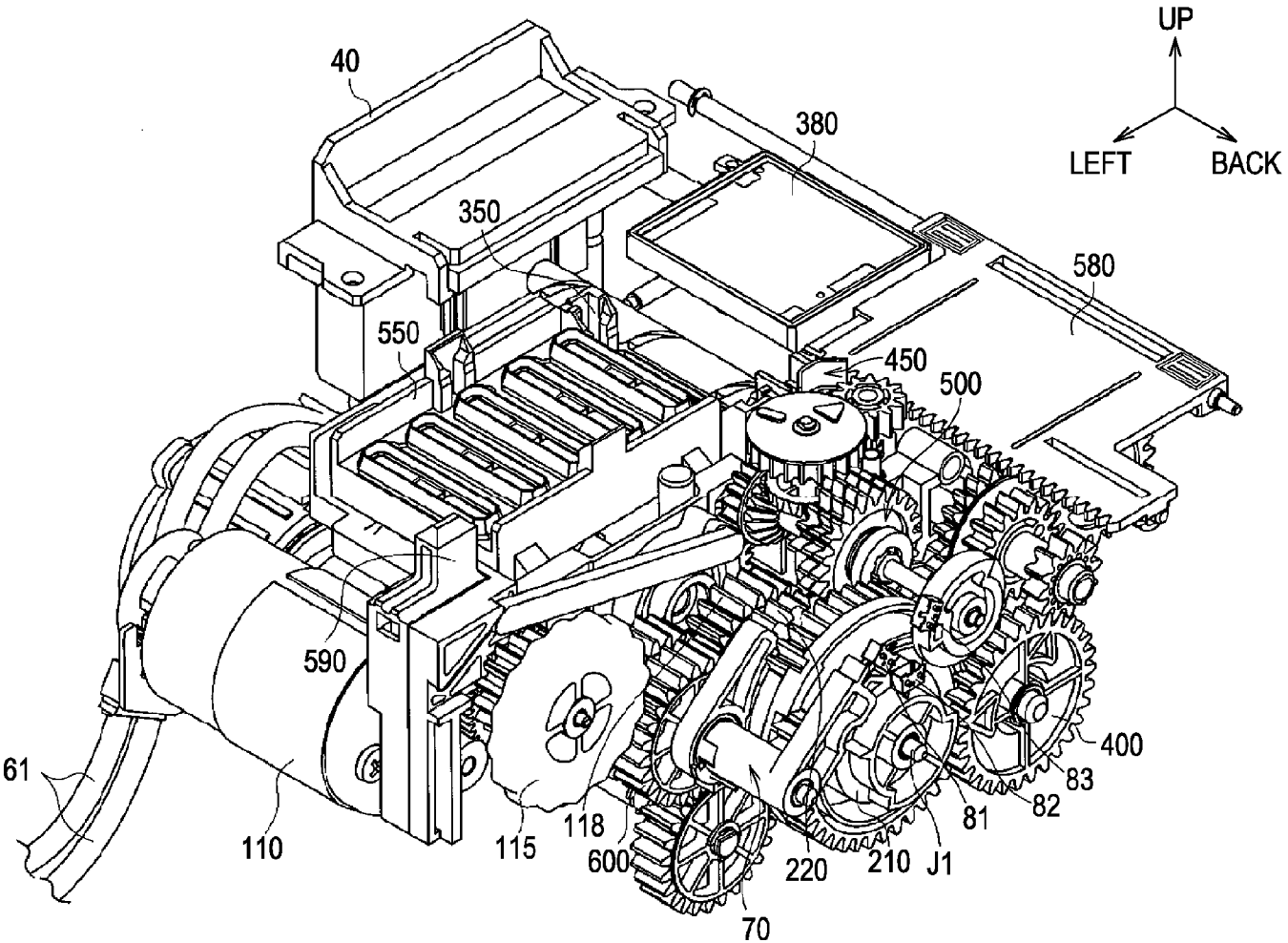
FIG. 4 is a perspective view illustrating the maintenance device in the state in which a frame structure is removed.

As shown in FIG. 4 in which the frame structure 90 is removed from the maintenance device 100, the driving mechanism includes a gear train in which plural gears mesh with each other and switching means 70 as a suppressing member which suppresses the rotation. Plural gears are axially supported by rotation shafts which are rotatably supported by the frame structure 90. In addition, in the gear train, the rotation of a drive transmitting gear 118 to which the rotation of the motor 110 is always transmitted, is transmitted to either a first gear 210 as a first rotation member or a second gear 220 as a second rotation member by the switching operation of the switching means 70. In addition, a third gear 300 (See FIG. 6) and a fourth gear 400 are rotated by the rotation of the first gear 210 for each of predetermined timings, a fifth gear 500 and a sixth gear 600 are rotated by the rotation of the second gear 220 for each of predetermined timings, and predetermined function components for maintenance are operated. Further, first detecting means 81, second detecting means 82, and third detecting means 83 which output a detection signal for controlling a direction of rotating the motor 110 when rotating the first gear 210 and the second gear 220 and controlling stopping the rotation of the motor 110, are attached to the circuit substrate 50 (see FIG. 3). The detecting operations of three detecting means will be described later.

Next, in the maintenance device 100, regarding which gear of the gear train is rotated by the rotation of the motor 110 and which of the above-described function components relating to maintenance is operated by the rotation of the gear, the configuration thereof will be sequentially described.

First, regarding switching between the rotation of the first gear 210 and the second gear 220 by the rotation of the motor 110, the configuration thereof as well as the transmitting mechanism until the drive transmitting gear 118 and the switching mechanism of the switching means 70 will be described with reference to FIG. 5 and FIGS. 6 to 9.

Figure 5:
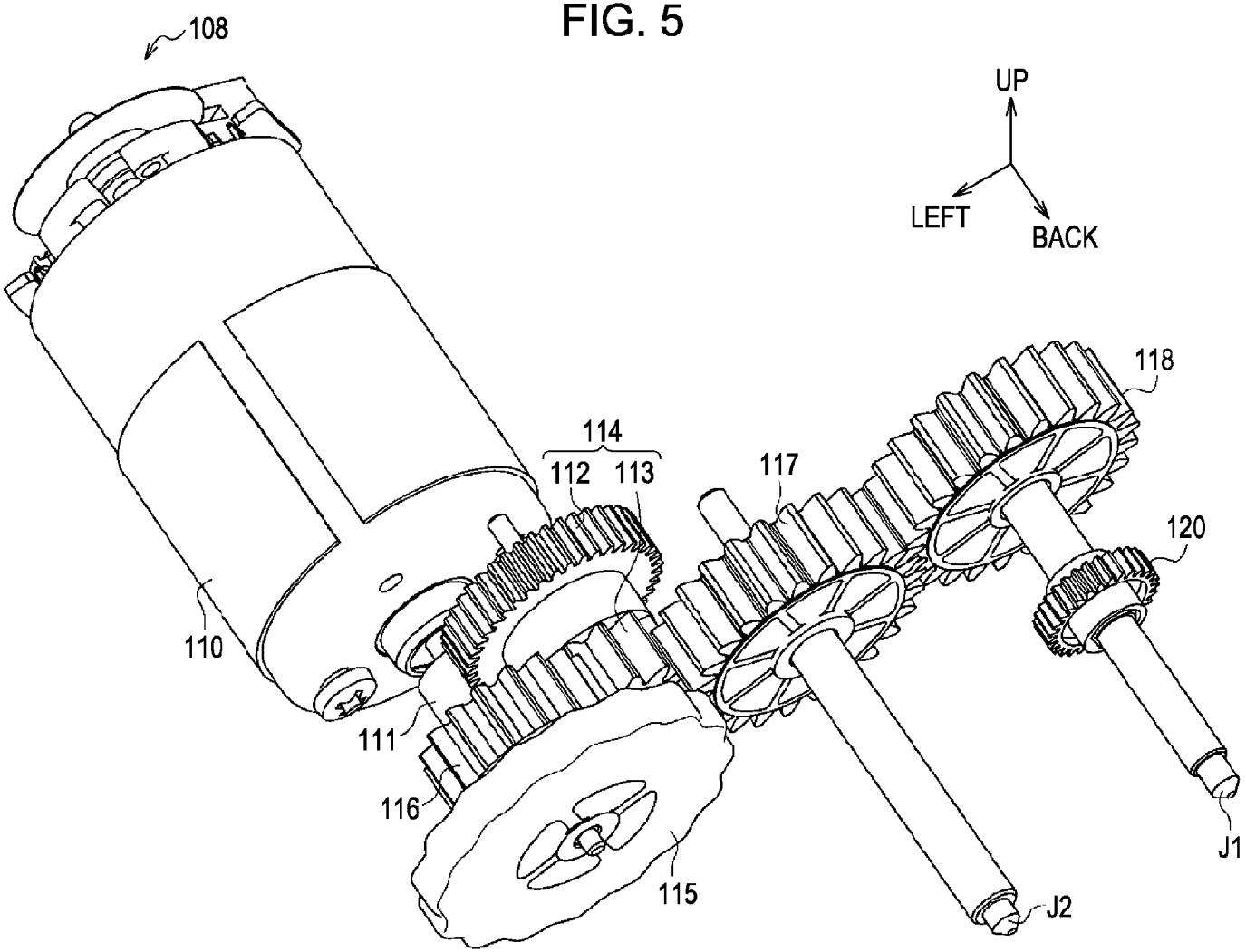
FIG. 5 is a perspective view illustrating a gear train which transmits the rotation of a motor to the rotation of a sun gear.

As shown in FIG. 5, the maintenance device 100 according to the present embodiment includes the motor 110 as a single driving source, transmits the rotation of the motor 110 to plural transmitting gears, and rotates the drive transmitting gear 118. Specifically, the rotation of a motor pinion 111 provided in the rotation shaft of the motor 110 is sequentially transmitted to a first transmitting gear 114 which meshes with the motor pinion 111, a second transmitting gear 117 which meshes with the first transmitting gear 114, and the drive transmitting gear 118 which meshes with the second transmitting gear 117. The first transmitting gear 114 is configured by a large gear 112 having a large pitch diameter which meshes with the motor pinion 111 and a small gear 113 having a small pitch diameter which meshes with the second transmitting gear such that the rotation having a rotation number lower than that of the motor pinion 111 is transmitted to the second transmitting gear 117. Further, the second transmitting gear 117 which meshes with the first transmitting gear 114 and the drive transmitting gear 118 which meshes with the second transmitting gear 117 have the same pitch diameter. The gear train is spatially easily formed by positioning a first rotation shaft J1 to which the drive transmitting gear 118 is fixed far from the motor 110. Moreover, the second transmitting gear 117 is rotatably supported by a second rotation shaft J2 parallel to the first rotation shaft J1.

A sun gear 120 rotating along with the drive transmitting gear 118 is fixed to the first rotation shaft J1 to which the drive transmitting gear 118 is fixed. The sun gear 120 will be described in detail later. Moreover, as described above, a hand-turned gear 116 which has the external hand-turned wheel 115 having a predetermined shape is disposed so as to mesh with the small gear 113 of the second transmitting gear 117. Therefore, the drive transmitting gear 118 is rotated by the single motor 110 and can be also rotated in a desired direction by a user rotating the wheel 115 without driving the motor 110.

Figure 6:
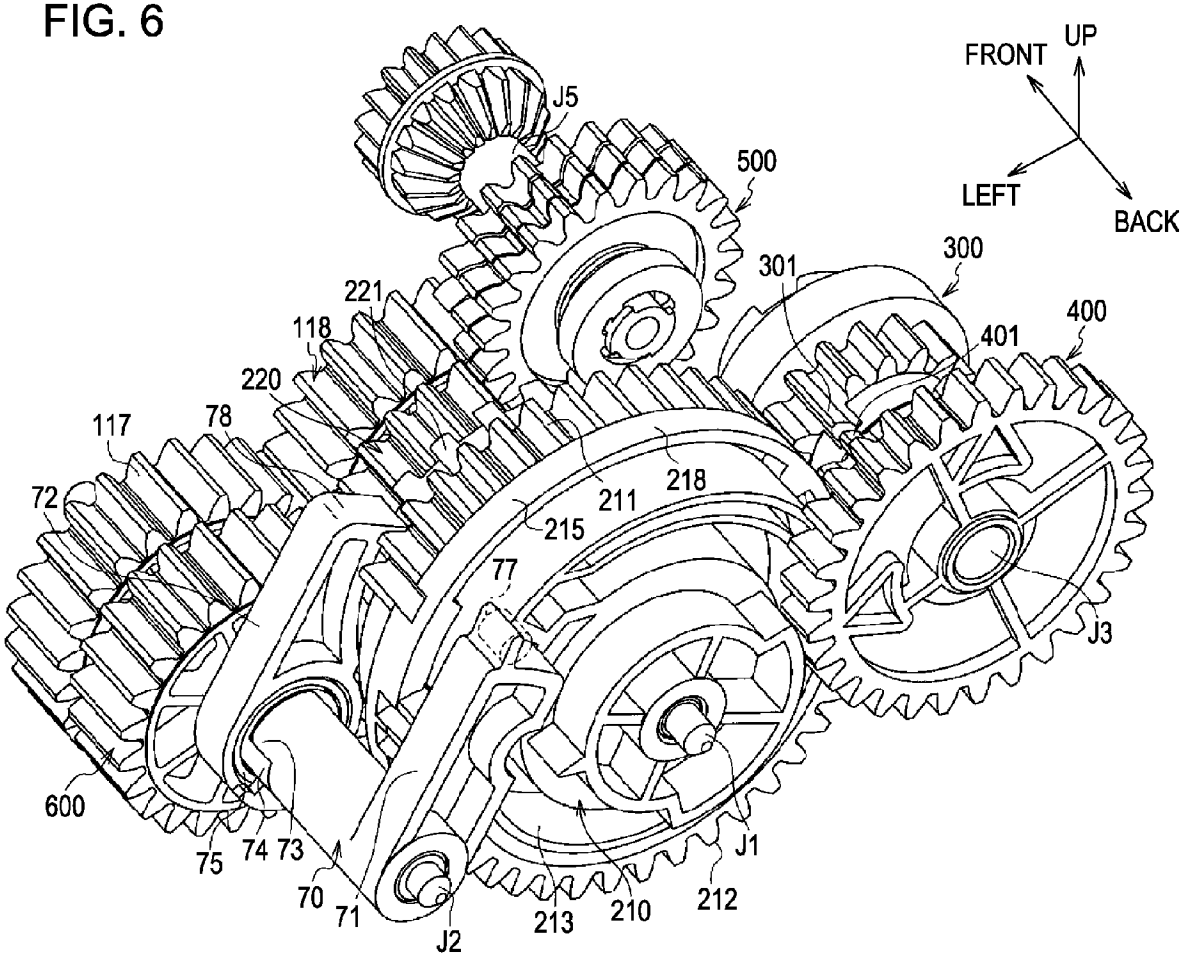
FIG. 6 is a perspective view illustrating a gear of the gear train to which the rotation of the motor is switched and transmitted.

FIG. 6 illustrates, in the gear train, the drive transmitting gear 118 to which the rotation of the motor 110 is transmitted to be driven, the first gear 210, the second gear 220, the third gear 300 and the fourth gear 400 which respectively mesh with the first gear 210, and the fifth gear 500 and the sixth gear 600 which respectively mesh with the second gear 220.

Two tooth-missing gears including a first tooth-missing gear 211 and a second tooth-missing gear 212 are formed at a outer circumferential surface 218 of the first gear 210 in which the tooth-missing gears are shifted to each other in the front-back direction and are shifted to each other by about half circumference in the circumferential direction. In addition, the third gear 300 meshes with the first tooth-missing gear 211 and the fourth gear 400 meshes with the second tooth-missing gear 212. In this way, when one gear of the third gear 300 and the fourth gear 400 rotates, the other gear does not rotate.

In addition, in the third gear 300, plural long teeth 301 (here, two teeth) which are longer than the other teeth in the axial direction among the teeth formed at the outer circumference are formed. When the third gear 300 is separated from the first tooth-missing gear 211 to end the rotation, the two long teeth 301 slide into contact with the outer circumferential surface 218 of the first gear 210. In this way, since the rotation of the third gear 300 ends, the rotation is restricted until the third gear 300 meshes with the first tooth-missing gear 211 to rotate again. Originally, in the fourth gear 400, plural long teeth 401 (here, four teeth) are formed among the teeth formed at the outer circumference. When the fourth gear 400 is separated from the second tooth-missing gear 212 to end the rotation, the plural long teeth 401 slide into contact with the outer circumferential surface 218 of the first gear 210 to restrict the rotation.

In the fifth gear 500 which meshes with the second gear 220, three gears are pressed into contact with each other in the front-back direction serving as the rotation axial direction, and by the friction thereof, the rotation is performed. Two of the three gears are tooth-missing gears. In this way, when the rotation is performed by a predetermined angle in one direction, the rotation ends. After the rotation ends in one direction, the rotation smoothly starts in the other direction. The structure of the fifth gear 500 will be described in detail later.

The first gear 210 and the second gear 220 are axially supported so as to rotate about the first rotation shaft J1 rotating along with the drive transmitting gear 118. In addition, the switching means 70 for switching the rotation of the drive transmitting gear 118 into the rotation of either the first gear 210 or the second gear 220 is provided.

The switching means 70 includes a first hook portion 71 and a second hook portion 72 each end of which is axially supported by a second rotation shaft J2 so as to rotate, and a torsion spring 75 as biasing means which is biased toward the second hook portion 72 and the first hook portion 71 clockwise when seen from the back. The torsion spring 75 is biased such that a second locking portion 74 installed at the second hook portion 72 comes into contact with a first locking portion 73 installed at the first hook portion 71. Therefore, in the switching means 70, the first hook portion 71 and the second hook portion 72 typically rotate along with each other while maintaining the contact state of the first locking portion 73 and the second locking portion 74. Meanwhile, in a case where a force greater than the biasing force of the torsion spring 75 is applied to the second hook portion 72 counterclockwise when seen from the back, the second hook portion 72 can rotate counterclockwise with respect to the first hook portion 71.

In the first hook portion 71, a first protrusion 77 as a substantially cylindrical engaging portion protruding forward is formed at a tip end opposite to a base end which is axially supported by the second rotation shaft J2, and the first protrusion 77 is engaged with a outer circumferential groove 213 which is formed along almost the entire outer circumference of the first gear 210. In addition, the first hook portion 71 rotates (swings) about the second rotation shaft J2 so as to correspond to the behavior of the first protrusion 77 which slides while being engaged with the outer circumferential groove 213 in response to the rotation of the first gear 210.

Furthermore, in the second hook portion 72, a second protrusion 78 which protrudes in a claw shape on a side opposite to the second gear 220 is formed at a tip end opposite to a base end which is axially supported. Meanwhile, in the second gear 220, plural external teeth 221 are formed at predetermined intervals at the outer circumferential portion on the back side thereof, in addition to gears transmitting the rotation of the fifth gear 500 and the sixth gear 600. In addition, the second protrusion 78 is engaged with the external teeth 221 by rotating clockwise when seen from the back along with the first hook portion 71. Therefore, due to this engagement, the second protrusion 78 functions as a suppressing portion which suppresses the rotation of the second gear 220, thereby suppressing the rotation of the second gear 220.

Figure 7:
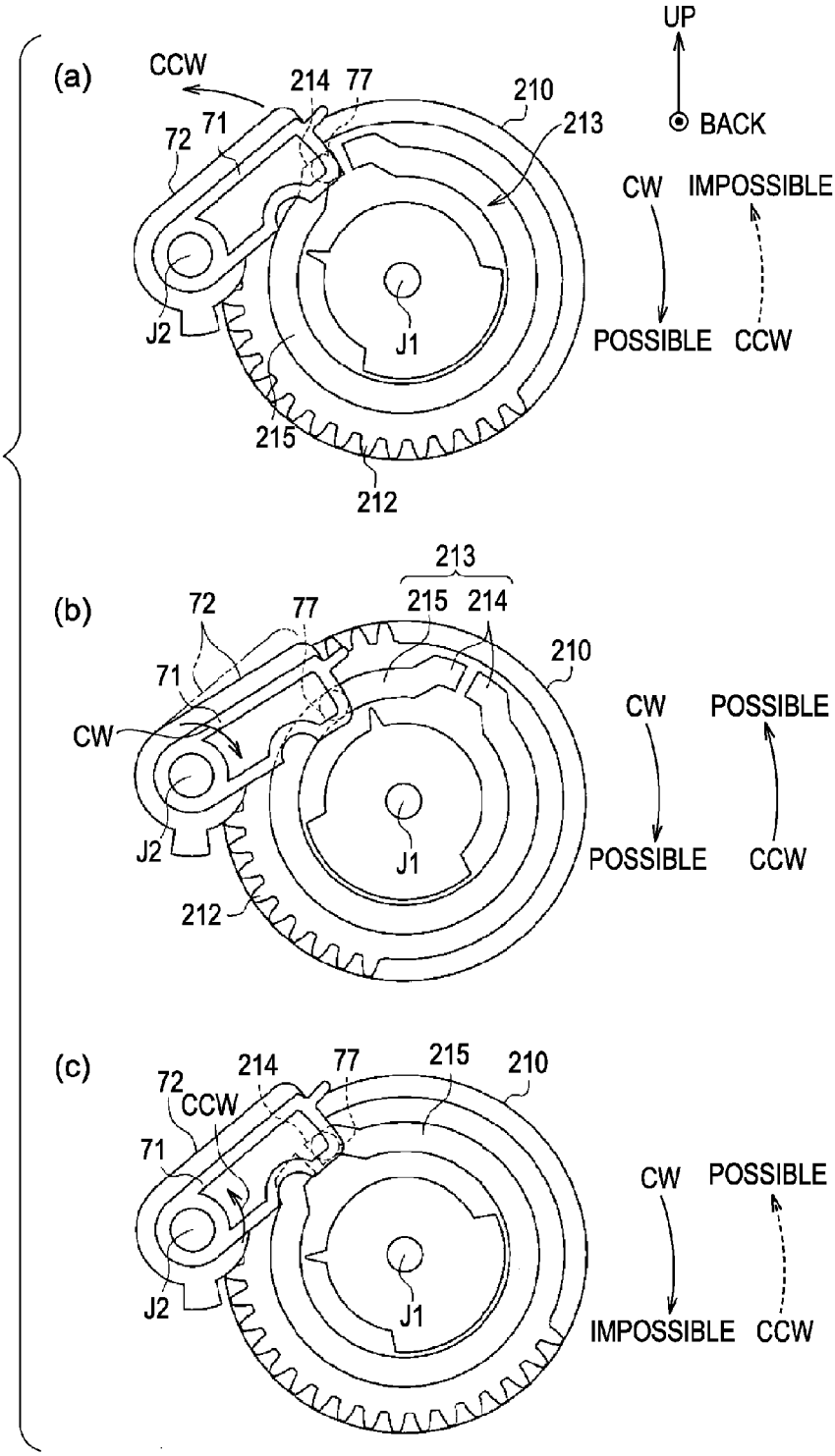
FIG. 7(*a*) to (*c*) are diagrams illustrating the operation of switching means which switches between the rotation of a first gear and a second gear.

Next, regarding switching between the rotation of the first gear 210 and the second gear 220 by the switching means 70, the mechanism thereof will be described with reference to FIG. 7. FIG. 7(*a*) illustrates a state where the first gear 210 rotates to the end by counterclockwise rotation when seen from the back (hereinafter, referred to as "CCW rotation") and the first protrusion 77 serving as an engaging portion of the first hook portion 71 is positioned at an end of the outer circumferential groove 213. In this state, the first gear 210 can perform clockwise rotation (hereinafter, referred to as "CW rotation"), but cannot perform CCW rotation. Further, first cam portions 214 are formed at both ends of the outer circumferential groove 213 so as to become far from the center of the first rotation shaft J1. When the first protrusion 77 reaches the first cam portion 214 formed at one end, the first hook portion 71 performs the CCW rotation about the second rotation shaft J2. In this way, the first protrusion 77 restricts and stops the CCW rotation of the first gear 210 while the second protrusion 78 of the second hook portion 72 is not engaged with the external teeth 221 installed at the outer circumference of the second gear 220 so as not to restrict the rotation of the second gear 220.

From this state, as shown in FIG. 7(*b*), when the first gear 210 performs the CW rotation, the first protrusion 77 is separated from the first cam portion 214 and reaches a second cam portion 215 which forms an arc shape at a position closer to the first rotation shaft J1 than the first cam portion 214 of the outer circumferential groove 213. Therefore, since the first hook portion 71 performs the CW rotation about the second rotation shaft J2 as shown in the drawing, the second protrusion 78 of the second hook portion 72 is engaged with the external teeth 221 to restrict and stop the rotation of the second gear 220. Originally, in this state, the first gear 210 can perform both of the CW rotation and the CCW rotation.

In addition, as shown in FIG. 7(*c*), when the first gear 210 performs the CW rotation to the end and the first protrusion 77 of the first hook portion 71 is at a position engaged with the first cam portion 214 formed at the other end of the outer circumferential groove 213, the first gear 210 can perform the CCW rotation, but cannot perform the CW rotation. Further, the first cam portion 214 formed at the other end of the outer circumferential groove 213 is also further separated from the first rotation shaft J1 than the second cam portion 215. Therefore, when the first protrusion 77 reaches the first cam portion 214 formed at the other end of the outer circumferential groove 213, the first hook portion 71 can perform the CCW rotation. As a result, in the switching means 70, the first protrusion 77 of the first hook portion 71 restricts and stops the CW rotation of the first gear 210 while the second protrusion 78 of the second hook portion 72 is not engaged with teeth (external teeth) of the second gear 220 to restrict the rotation of the second gear 220.

In this way, the rotation of the drive transmitting 118 is transmitted by the switching means 70 such that either the first gear 210 or the second gear 220 rotates. That is, in a state where the rotation of the first gear 210 is restricted and stopped by the first protrusion 77, the rotation of the second gear 220 is not restricted by the second protrusion 78. On the other hand, in a state where the rotation of the first gear 210 is not restricted by the first protrusion 77, the rotation of the second gear 220 is restricted and stopped by the second protrusion 78.

In the present embodiment, the rotation of the drive transmitting gear 118, that is, the rotation of the single motor 110 is transmitted from the above-described sun gear 120 to the first gear 210 or the second gear 220 by a planetary gear mechanism using a planetary gear 230 which meshes with the sun gear 120.

Figure 8:
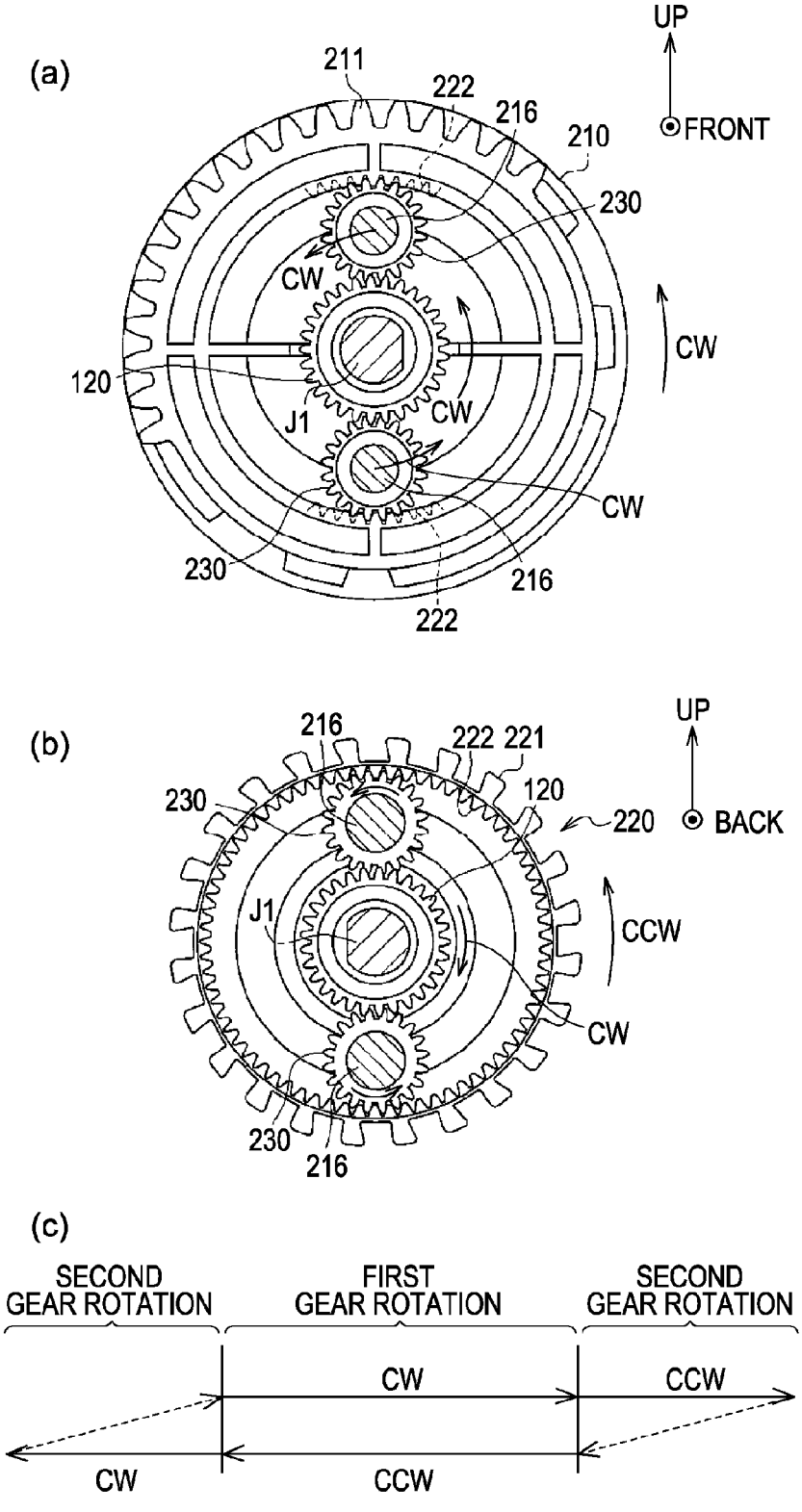
FIG. 8(*a*) is a diagram illustrating the behavior of the first gear in a planetary gear mechanism, (*b*) is a diagram illustrating the behavior of the second gear in the planetary gear mechanism, and (*c*) is a diagram illustrating the behavior relationship between the first gear and the second gear.

Specifically, the planetary gear mechanism used for the rotation transmission between the first gear 210 or the second gear 220 and the drive transmitting gear 118 will be described with reference to FIG. 8. FIG. 8(*a*) is a diagram illustrating the structure of the planetary gear mechanism when the first gear 210 is seen from the front. FIG. 8(*b*) is a diagram illustrating the structure of the planetary gear mechanism when the second gear 220 is seen from the back.

As shown in FIG. 8(*a*), in the first gear 210, two arm shafts 216 protruding forward (front direction in the drawing) with a surface almost perpendicular to the axis line of the first rotation shaft J1 as a base, are provided at a position almost symmetrical to the first rotation shaft J1. The planetary gear 230 is axially supported in each of the arm shafts 216 so as to rotate. In addition, the sun gear 120 rotating along with the drive transmitting gear 118 is fixed to the first rotation shaft J1 and the sun gear is disposed so as to mesh with the planetary gear 230. In addition, as shown in FIG. 8(*b*), the planetary gear 230 is configured to mesh with internal teeth, that is, internal gears 222, which are provided in the inner circumference of the second gear 220, at an opposing position opposite to a position which meshes with the sun gear 120.

In the planetary gear mechanism having the sun gear 120 and the planetary gear 230 which are configured in this way, when the first protrusion 77 is at a position other than both ends of the outer circumferential surface 213 in the first gear 210, the second protrusion 78 is engaged with the external teeth 221 of the second gear 220 to restrict the rotation of the second gear 220. In this state, for example, as shown in FIG. 8(*a*), the planetary gear 230 performs the CW rotation, that is, revolving movement about the sun gear 120 while performing the CCW rotation along with the CW rotation of the sun gear 120. Therefore, since rotation shafts of the planetary gear 230, that is the two arm shafts 216 also perform the CW rotation along with the revolving movement, the first gear 210 where the two arm shafts 216 are provided similarly performs the CW rotation.

In addition, when the first gear 210 rotates such that the first protrusion 77 is positioned at one of both ends of the outer circumferential groove 213 of the first gear 210, the rotation of the first gear 210 is restricted and the second protrusion 78 releases the restriction for the rotation of the second gear 220. In this state, for example, as shown in FIG. 8(*b*), the rotation shafts of the planetary gear 230, that is, the two arm shafts 216 are fixed without rotating. Therefore, in this state, when the sun gear 120 continuously performs the CW rotation, the planetary gear 230 the CCW rotation about the two fixed arm shafts 216. Moreover, since the internal gears 222 of the second gear 220 perform the CCW rotation due to the CCW rotation of the planetary gear 230, the second gear 220 performs the CCW rotation.

As a result, as shown in FIG. 8(*c*), the rotation of the drive transmitting gear 118 is transmitted by the planetary gear mechanism configured by the sun gear 120 and the planetary gear 230 and the switching means 70 according to the present embodiment such that either the first gear 210 or the second gear 220 rotates. That is, while the first gear 210 performs the CW rotation or the CCW rotation, the second gear 220 stops. Further, in a case where the drive transmitting gear 118 continuously rotates in one direction, when the first gear 210 performs the CW rotation and stops, the second gear 220 starts the CCW rotation, and when the first gear 210 performs the CCW rotation and stops, the second gear 220 starts the CW rotation. In addition, when the drive transmitting gear 118 reversely rotates at the time of the CCW rotation of the second gear 220, the second gear 220 stops and the first gear 210 immediately starts the CCW rotation. When the drive transmitting gear 118 reversely rotates at the time of the CW rotation of the second gear 220, the second gear 220 stops and the first gear 210 immediately starts the CW rotation.

Figure 9:
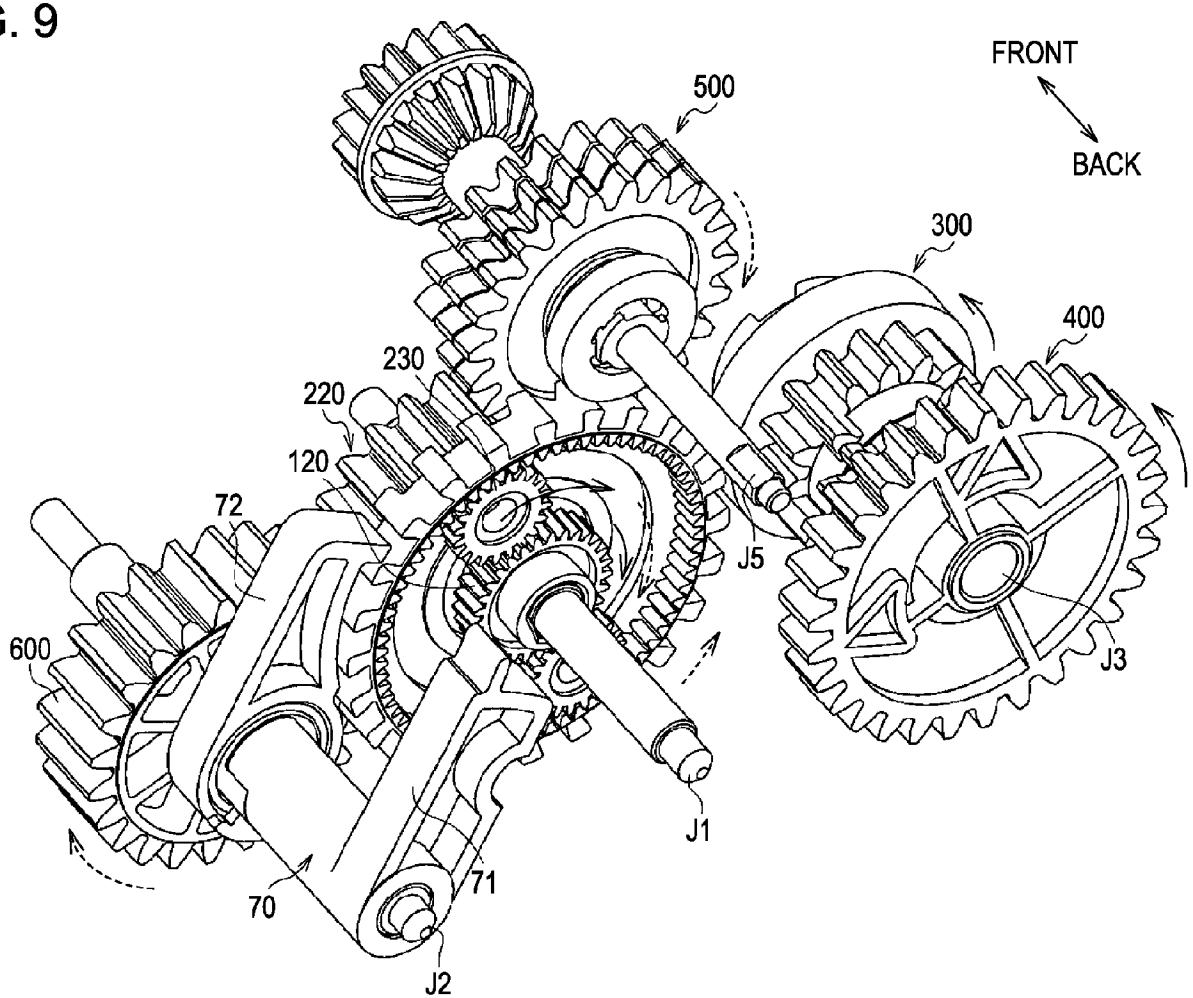
FIG. 9 is a diagram illustrating the rotation states of a third gear, a fourth gear, a fifth gear, and a sixth gear which are rotated by the first gear or the second gear in the gear train.

As a result, as shown in FIG. 9, the third gear 300, the fourth gear 400, the fifth gear 500, and the sixth gear 600 are rotated by the first gear 210 or the second gear 220, respectively. That is, in a state where the rotation of the second gear 220 is restricted by the second hook portion 72, the planetary gear 230 performs the revolving movement by the rotation of the sun gear 120 as indicated by the solid arrow in the drawing. As a result, the first gear 210 which is not shown here for convenience of the description rotates. Accordingly, the third gear 300 or the fourth gear 400 is rotated. Meanwhile, in a state where the restriction for the rotation of the second gear 220 is released by the second hook portion 72, the second gear 220 is rotated by the rotation of the sun gear 120 as indicated by the broken line arrow in the drawing. Accordingly, the fifth gear 500 and the sixth gear 600 are rotated.

In the maintenance device 100 according to the present embodiment, the driving mechanism is configured such that plural function components for maintenance of the maintenance device 100 are operated in response to the rotation of each gear of the third gear 300 to the sixth gear 600. In other words, plural systems of the driving mechanism (drive system) are configured such that plural function components are operated by the rotation of the single motor 110.

Next, the driving mechanism for operating each of the function components will be described. Here, in the maintenance device 100 according to the present embodiment, since plural drive systems for operating the function components relating to maintenance are configured, the drive systems can be described in various ways. Therefore, for easy understanding of the following descriptions, the overall drive system relating to maintenance will be described in advance with reference to FIG. 10 schematically illustrating the drive system.

Figure 10:
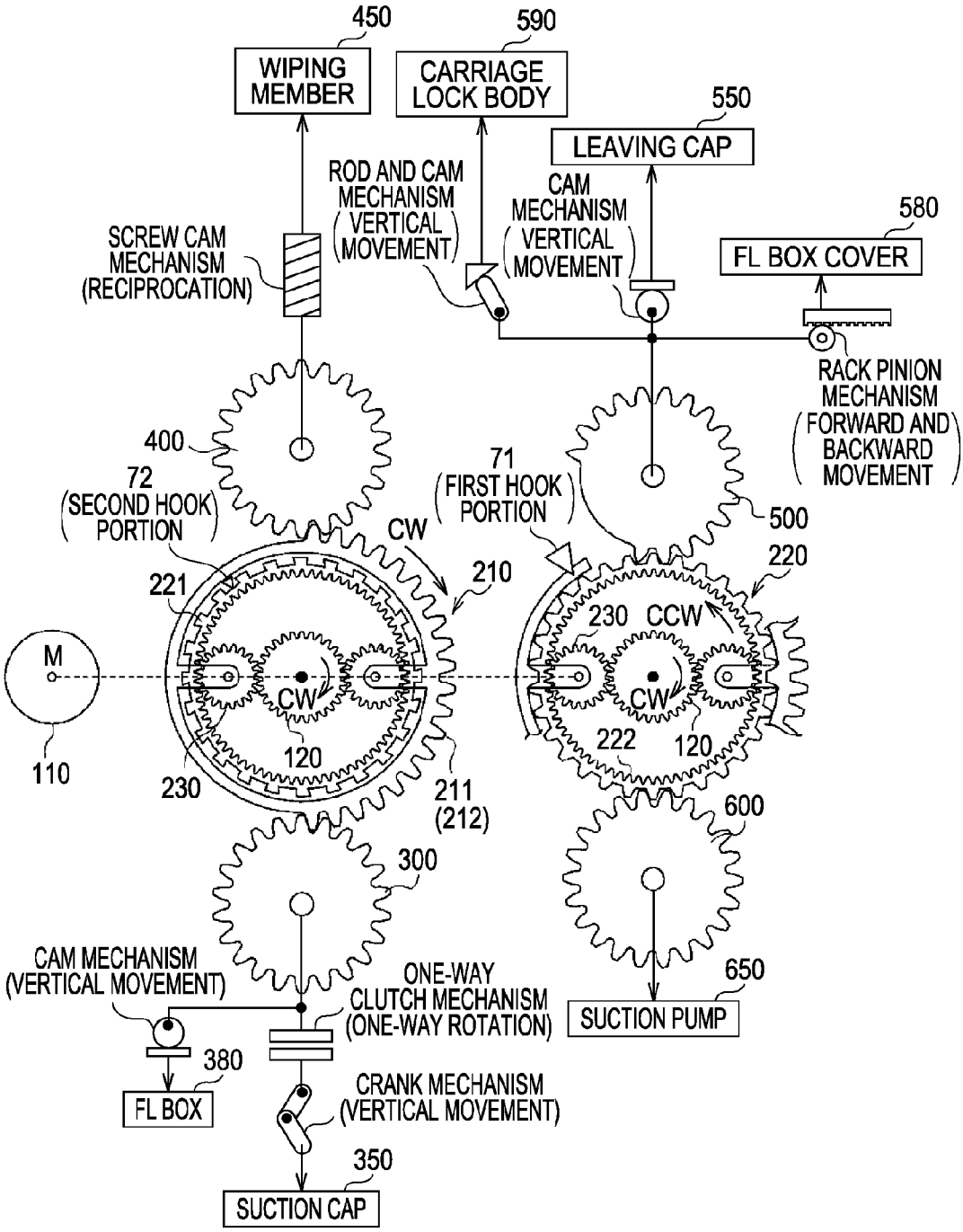
FIG. 10 is a diagram schematically illustrating the entire driving system having a maintenance function.

As shown in FIG. 10, the maintenance device 100 according to the present embodiment includes one drive system which performs the vertical movement of the suction cap 350 and the vertical movement of the FL box 380 due to the rotation of the third gear 300. In the drive system, the suction cap 350 and the FL box 380 convert the rotation of the third gear 300 into the movement in the up-down direction using a crank mechanism and a cam mechanism, respectively. Further, the suction cap 350 has a structure such that it is maintained at a predetermined position in the vertical direction using a one-way clutch mechanism which rotates only in one direction such that the rotation in the other direction opposite to one direction is not transmitted to the rotation of the third gear 300.

In addition, the maintenance device 100 includes one drive system in which the wiping member 450 is reciprocated in the front-back direction by the rotation of the fourth gear 400. In this drive system, the rotation of the fourth gear 400 is converted into the movement of the wiping member 450 in the front-back direction by a screw cam mechanism in which a pin is engaged with a spiral groove formed at the rotation shaft.

In addition, the maintenance device 100 includes one drive system in which the vertical movement of the leaving cap 550, the vertical movement of the carriage lock body 590, and the forward and backward movement of the FL box cover 580 are performed by the rotation of the fifth gear 500. In the drive system, the rotation of the fifth gear 500 is converted such that the leaving cap 550 and the carriage lock body 590 are moved in the up-down direction by a cam mechanism and by a rod and a cam mechanism, respectively. In addition, the FL box cover 580 is configured such that the rotation of the fifth gear 500 is converted into the forward and backward movement by a rack pinion mechanism.

In addition, the maintenance device 100 includes one drive system in which the suction pump 650 is rotated by the rotation of the sixth gear 600. In this drive system, the suction pump 650 performs the suction due to the rotation in one direction. On the other hand, during the rotation in the other direction, the suction pump 650 is in a non-suction state where the suction operation is not performed.

Further, as described above, in the state where the rotation of the second gear 220 is restricted by the second hook portion 72 (left side in FIG. 10), the first gear 210 rotates in the same direction (that is, CW rotation) as that of the sun gear 120 (for example, CW rotation) which is driven by the motor 110. At this time, since the first gear 210 is configured such that the gears at the outer circumference thereof mesh with either the third gear 300 or the fourth gear 400, the wiping member 450 does not move forward and backward during the vertical movement of the suction cap 350 (FL box 380).

Similarly, as described above, in the state where the rotation of the first gear 210 is restricted by the first hook portion 71 (right side in FIG. 10), the second gear 220 rotates in the direction reverse to that of the sun gear 120 (here, CCW rotation). Therefore, in a state where the suction cap 350 (FL box 380) does not move vertically, or a state where the wiping member 450 does not move forward and backward, the vertical movement of the leaving cap 550 (carriage lock body 590), the forward and backward movement of the FL box cover 580, and the rotation of the suction pump 650 are performed.

Hereinafter in the maintenance device 100 having plural drive systems which respectively operate each of the plural function components, the specific configuration of each of the drive systems will be sequentially described.

Figure 11:
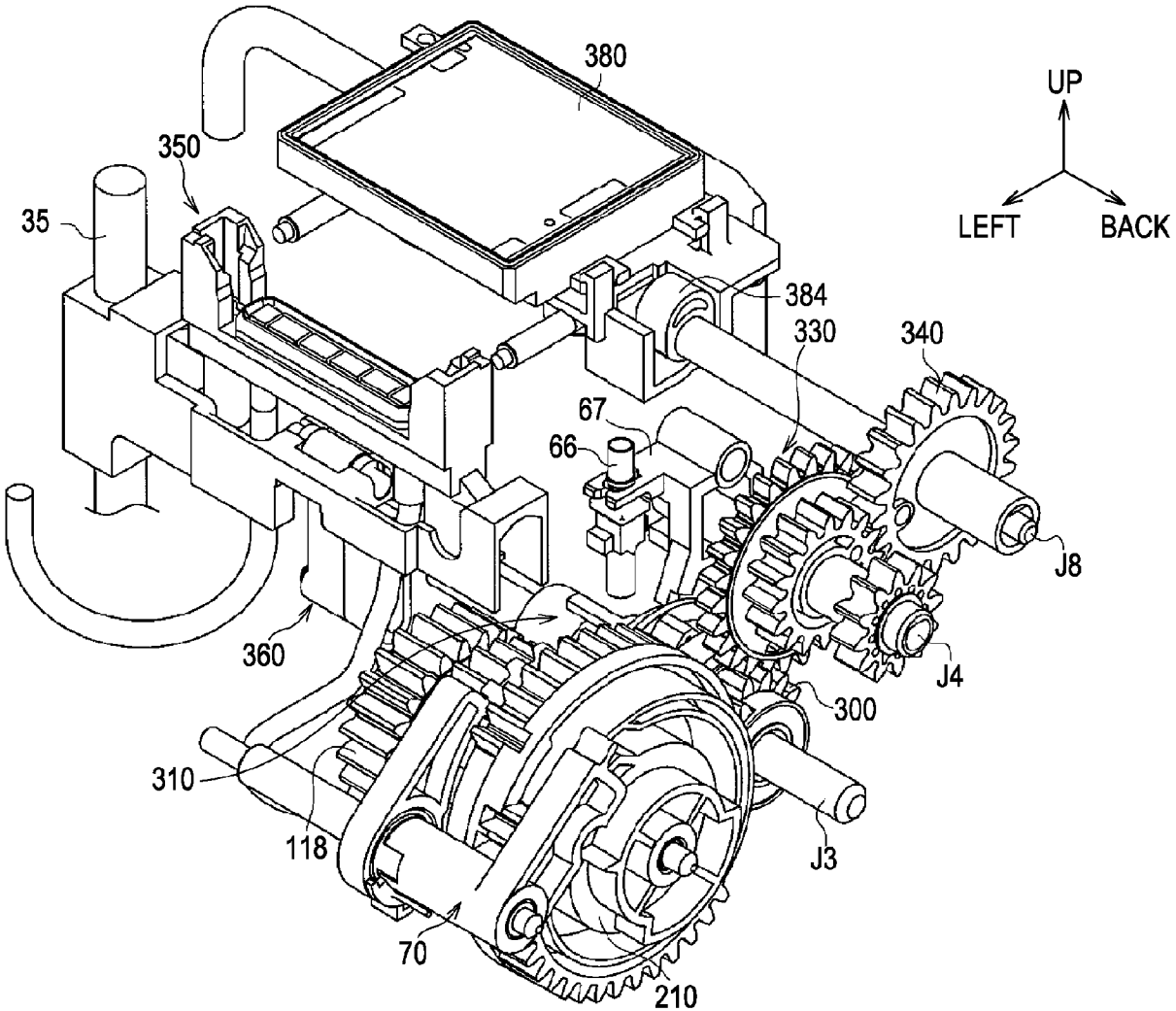
FIG. 11 is a perspective view illustrating the driving system having a maintenance function which is driven by the third gear.

(Drive System of Suction Cap and FL Box) As described in FIG. 11, the maintenance device 100 according to the present invention includes a drive system in which the suction cap 350 is moved in the up-down direction by the rotation of the third gear 300. That is, the third gear 300 meshing with the first tooth-missing gear 211 is rotated by the rotation of the first gear 210. The rotation of the third gear 300 is transmitted by a clutch mechanism 310 to the rotation of the third rotation shaft J3 where the third gear 300 is axially supported so as to rotate. The transmitted rotation of the third rotation shaft J3 is converted into the vertical movement of the suction cap 350 by a crank mechanism 360. That is, the suction cap 350 vertically moves along a suction cap guide rod 35 fixed in the frame structure 90 and is separated from the liquid ejecting head 30 (not shown).

Furthermore, the drive system is configured such that the FL box 380 is driven in the up-down direction by the rotation of the third gear 300. That is, the third gear 300 rotates a FL box driving gear 340 through a fourth transmitting gear 330 which is axially supported in a fourth rotation shaft J4 so as to rotate, thereby rotating an eighth rotation shaft J8 to which the FL box driving gear 340 is fixed. In addition, due to the rotation of the eighth rotation shaft J8, a FL cam 384 which is fixed to the eighth rotation shaft J8 rotates. Accordingly, the FL box 380 is vertically moved.

In the drive systems, the mechanism relating to the vertical movement of the suction cap 350 will be first described. In the third gear 300 of the present embodiment, as described above, the clutch mechanism 310 which transmits the rotation of the third gear 300 serving as a driving-side member to the third rotation shaft J3 serving as a driven-side member is formed as a transmitting mechanism. Further, the clutch mechanism 310 is provided with a cam-shaped portion 317 (see FIG. 12) which is engaged with a part of a valve opening and closing member 67 opening and closing the atmosphere opening valve 66. The cam-shaped portion 317 rotates along with the rotation of the third gear 300 to be engaged with a part of the valve opening and closing member 67 and to move an atmosphere opening valve 66 upward. Accordingly, the closed space formed by the suction cap 350 being in contact with the liquid ejecting head 30 is opened to the atmosphere. The configuration relating to the atmosphere opening will be described later.

Next, the clutch mechanism 310 will be described with reference to FIG. 12. When the third rotation shaft J3 rotates in a predetermined angle range, that is, when the suction cap 350 lifts by a predetermined amount, the clutch mechanism 310 according to the present embodiment operates as a one-way clutch which transmits only the rotation in one direction.

Figure 12:
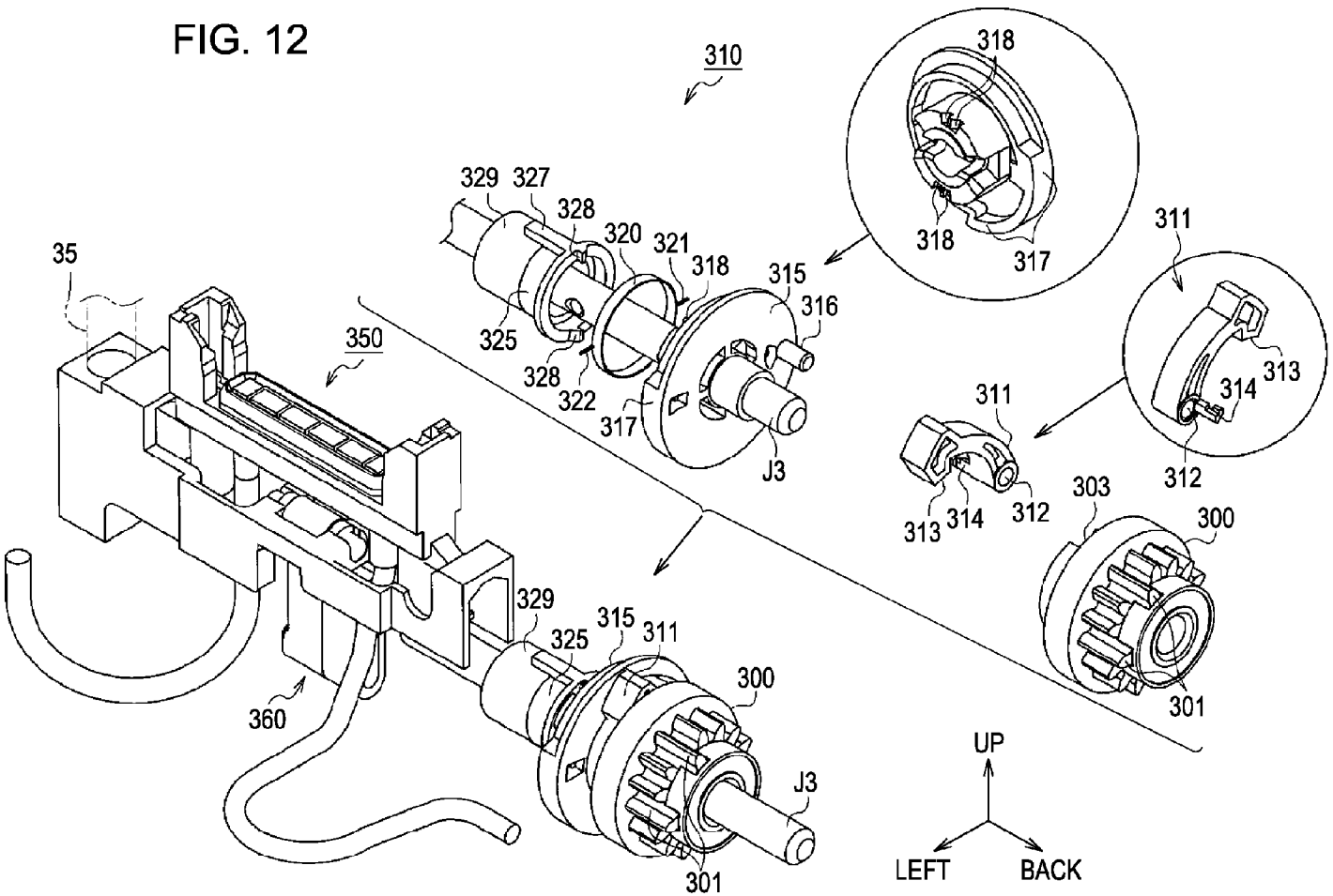
FIG. 12 is an exploded perspective view illustrating the structure of a clutch mechanism which transmits the rotation of the third gear.

As shown in the upper right section of FIG. 12, the clutch mechanism 310 includes, as a component which transmits the rotation of the third gear 330, a lever member 311, a clutch plate 315, a torsion spring 320, and a clutch plate restricting member 325 sequentially in the front direction from the third gear 300.

A penetrating hole 312 is provided at one end of the lever member 311 and is axially supported so as to swing in the clutch plate 315 by inserting a lever shaft portion 316, which is provided so as to protrude backward in the back surface of the clutch plate 315, into the penetrating hole 312. Further, an engaging claw 313 is formed at the other end of the lever member 311 so as to be engaged with an engaging groove 303 provided in the third gear 300. In addition, as shown in the circle frame of FIG. 12, in the lever member 311, one end 321 is in contact with a protrusion 314 provided in a surface (front surface) on the clutch plate 315 side of the lever member 311 and the biasing force of the torsion spring 320 which is fixed to the clutch plate 315 is applied to the other end 322. Therefore, the lever member 311 functions as an engaging member and is biased by the torsion spring 320 in a direction in which the engaging claw 313 is always engaged with the engaging groove 303.

The clutch plate 315 is fixed to the third rotation shaft J3 and integrally rotates with the third rotation shaft J3. Therefore, the clutch mechanism 310 is configured such that the rotation of the third gear 300 is transmitted to the rotation of the clutch plate 315 by the engagement between the engaging groove 303 and the engaging claw 313, thereby rotating the third rotation shaft J3. Here, the cam-shaped portion 317 which expands in the front direction and is formed to be thick in the outer circumference of the clutch plate 315 is provided. The cam-shaped portion 317 functions when the closed space in the suction cap 350 which will be described later is opened to the atmosphere.

The clutch plate restricting member 325 extends in the radial direction and the rotation about the third rotation shaft J3 is restricted by a convex strip portion 327 which extends by a predetermined length along the front-back direction. Meanwhile, the clutch plate restricting member 325 can slide along the third rotation shaft J3 in the front-back direction. Moreover, the clutch plate restricting member 325 is always biased backward by biasing means (for example, a coil spring) 329. The clutch plate restricting member 325 is provided with a triangle protrusion 328, which has an inclined surface on the CW rotation side when seen from the back and a surface perpendicular to about the same direction as the front-back direction on the CCW rotation side, so as to protrude backward in the outer circumference thereof. Here, in the clutch plate restricting member 325 of the present embodiment, one triangle protrusion 328 (in total, two triangle protrusions) is formed at each of positions opposite to each other centering on the third rotation shaft J3.

On the other hand, in the clutch plate 315, as shown in the circle frame of FIG. 12, two triangle recesses 318, which are engaged with the triangle protrusions 328 where the clutch plate restricting member 325 is provided, are formed at two positions (in total, four positions) adjacent to a front surface opposite to the clutch plate restricting member 325. Therefore, in a state where the triangle protrusions 328 and the triangle recesses 318 are engaged with each other, when seen from the back, the clutch plate 315 can perform the CCW rotation about the third rotation shaft J3 but the CW rotation is restricted.

In this state, when the CCW rotation side of the engaging groove 303 comes into contact with the engaging claw 313 along with the CW rotation of the third gear 300, the engagement between the engaging groove 303 and the engaging claw 313 is released. That is, the lever member 311 which is axially supported in the clutch plate 315 in which the CW rotation is restricted is in a state where the CW rotation is restricted. Therefore, the surface shapes on the CCW side of the engaging groove 303 and the CCW side of the engaging claw 313 are set such that the lever member 311 performs the CW rotation (swings) about the lever shaft portion 316 due to the contact between the engaging groove 303 and the engaging claw 313. In other words, the shape of the engaging claw 313 of the lever member 311 is set such that, during the CW rotation of the third gear 300, the lever member 311 is rotated (swings) by the biasing force of the torsion spring 320 to release the engagement with the engaging groove 303. Further, the shape of the engaging claw 313 is set such that, during the CCW rotation, the engagement with the engaging groove 303 is maintained and the rotation of the third gear 300 is transmitted to the third rotation shaft J3. In this way, the clutch mechanism 310 functions as a one-way clutch.

In the present embodiment, the clutch mechanism 310 operates as a one-way clutch at two rotation positions of the clutch plate 315 where the triangle protrusion 328 and the triangle recesses 318 are engaged with each other. That is, one rotation position of the clutch plate 315 is a suction position where the suction cap 350 is in contact with the liquid ejecting head 30 to suction ink and the other rotation position is an atmosphere-opened suction position where the closed space formed by the suction cap 350 being in contact with the liquid ejecting head 30 is opened to the atmosphere to suction in the state of the suction cap 350 being in contact with the liquid ejecting head 30. Here, the atmosphere-opened suction will be described later. In addition, the one-way clutch is restricted so as not to act on at least a part of rotation position of the clutch plate 315. The mechanism of the operation of this one-way clutch will be described with reference to FIG. 13. Here, in FIG. 13, a part component of the suction cap 350 which comes into contact with the liquid ejecting head is shown as the suction cap 350 for convenience of the description.

Figure 13:
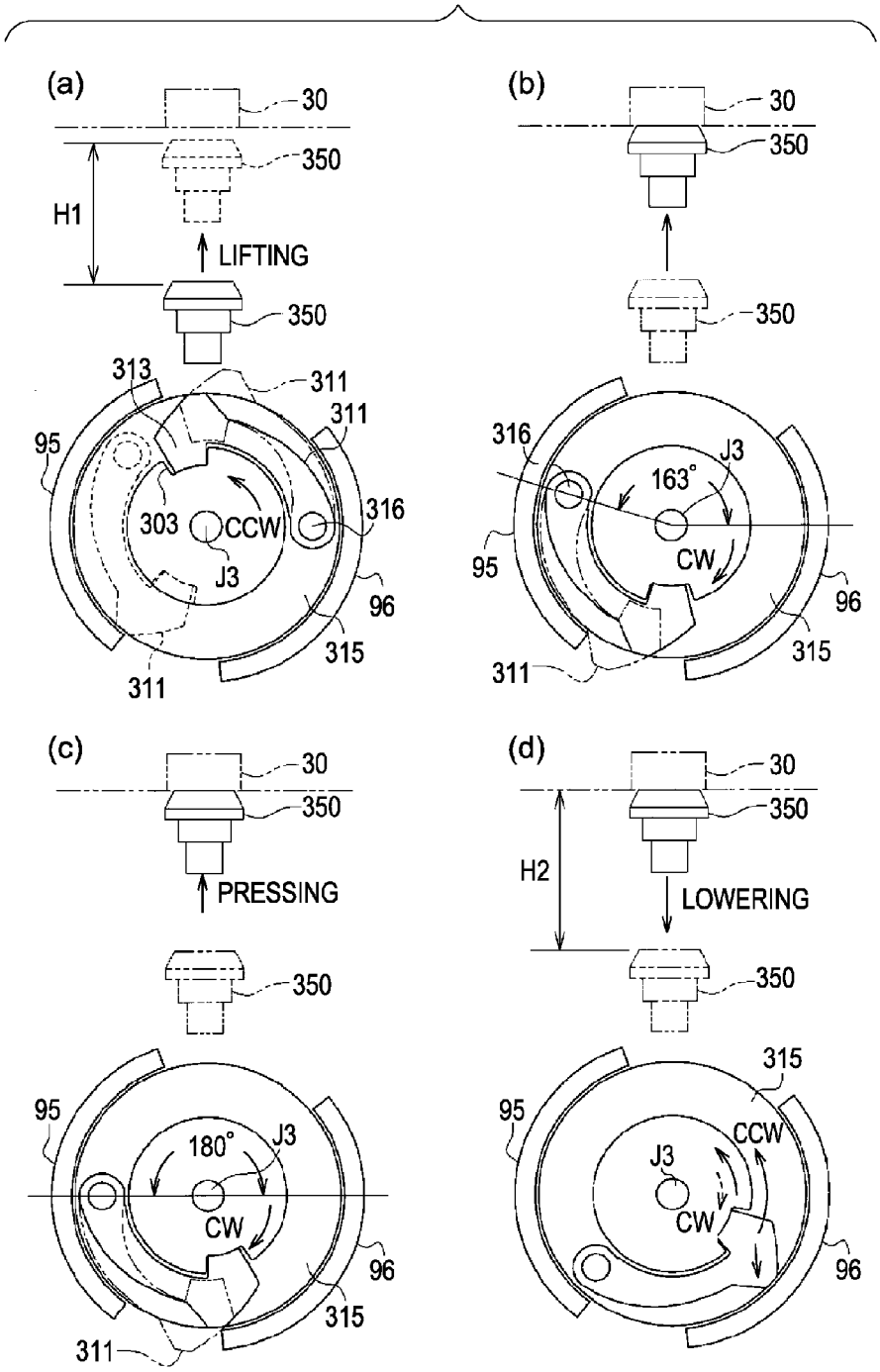
FIG. 13 is a diagram schematically illustrating states of the clutch mechanism in which (a) is a state where a suction cap lifts from the lowest position, (b) is a suction state where the suction cap is in contact with a liquid ejecting head, (c) is a state where a sealed space formed by the suction cap being in contact with a liquid ejecting head is opened to the atmosphere, and (d) is a state where the suction cap lowers from the highest position.

As shown in FIG. 13(*a*), in the present embodiment, when the clutch plate 315 is at a rotation start position, that is, when the suction cap 350 is at a position separating from the liquid ejecting head 30, namely, at a reference position, the one-way clutch acts. That is, as shown in FIG. 13(*a*), when the engaging groove 303 of the third gear 300 performs the CW rotation, the lever member 311 performs the CW rotation about the lever shaft portion 316 to release the engagement between the engaging groove 303 and the engaging claw 313. Originally, the triangle protrusion 328 is engaged with the triangle recess 318 at the reference position.

Meanwhile, when the engaging groove 303 of the third gear 300 performs the CCW rotation, the lever member 311 performs the CCW rotation due to the engaging claw 313 engaged with the engaging groove 303. As a result, the clutch plate 315 which is connected to the lever member 311 through the lever shaft portion 316 performs the CCW rotation along with the lever member 311 to perform the CCW rotation of the third rotation shaft J3, thereby lifting the suction cap 350 so as to approach the liquid ejecting head 30.

In the present embodiment, the one-way clutch is configured so as not to act at the time of lifting of the suction cap 350. Specifically, a first suppressing wall 95 is provided along the rotational movement path of the lever member 311 as a rotation suppressing portion which suppresses the rotation of the lever member 311 about the lever shaft portion 316 so as not to release the engagement between the engaging claw 313 of the lever member 311 and the engaging groove 303 in the outer circumference of the clutch plate 315. In the present embodiment, the first suppressing wall 95 is formed at the frame structure 90. As a result, during a period in which the suction cap 350 lifts from the lowest position and the suction cap 350 moves by a movement section H1 equivalent to a position which is indicated by the broken line in the drawing, the one-way clutch does not operate.

Next, as shown in FIG. 13(*b*), in a state where the clutch plate 315 performs the CCW rotation up to the suction position where the suction cap 350 comes into contact with the liquid ejecting head 30 due to the CCW rotation of the engaging groove 303 of the third gear 300 (here, rotates by 163 degrees from the reference position), the one-way clutch operates. That is, the first suppressing wall 95 is formed so as not to be present in the rotation track until the lever member 311 rotates about the lever shaft portion 316 to release the engagement between the engaging groove 303 and the engaging claw 313. Therefore, in this state, the motor 110 is reversely driven and the third rotation shaft J3 does not perform the CW rotation even when the engaging groove 303 performs the CW rotation. In addition, the suction pump 650 operates due to the reverse drive of the motor 110 to suction ink from the liquid ejecting head 30. The suction using suction pump 650 will be described later.

Furthermore, as shown in FIG. 13(*c*), in a state where the clutch plate 315 performs the CCW rotation about a predetermined angle due to the addition CCW rotation of the engaging groove 303 of the third gear 300 (here, rotates by 180 degrees from the reference position), the one-way clutch continuously operates. That is, the suppressing wall which suppresses the rotation of the lever member 311 is not present in the rotation track until the lever member 311 rotates (swings) about the lever shaft portion 316 to release the engagement between the engaging groove 303 and the engaging claw 313. Here, in this state, while the suction cap 350 is pressed against and is in contact with the liquid ejecting head 30, the cam-shaped portion 317 (see FIG. 12) where the clutch plate 315 is provided is engaged with the valve opening and closing member 67 to open the closed space in the suction cap 350 to the atmosphere. In addition, the suction pump 650 operates due to the drive of the single motor 110 to perform the suction of the closed space in the atmosphere-opened state.

In addition, as shown in FIG. 13(*d*), the lever member 311 performs the CCW rotation due to the engaging claw 313 which is engaged with the engaging groove 303 of the third gear 300 and thus the clutch plate 315 additionally performs the CCW rotation from the state where the clutch plate 315 rotated by 180 degrees. As a result, the clutch plate 315 performs the CCW rotation of the third rotation shaft J3 to lower the suction cap 350, thereby moving the suction cap 350 by a movement section H2 from a contact position where the suction cap 350 comes into contact with the liquid ejecting head 30 to a separating position where the suction cap 350 is separated from the liquid ejecting head 30.

At this time, in the movement section H2, for example, when the suction cap 350 is attempted to be forcibly lowered prior to the lowering due to the CCW rotation of the third gear 300, the CCW rotation (arrow indicated by the thick line in the drawing) of the clutch plate 315 which is performed along with the third rotation shaft J3 is performed prior to the CCW rotation of the third gear 300. Accordingly, the third gear 300 performs the CW rotation (arrow indicated by the broken line in the drawing) relative to the clutch plate 315. Therefore, since the one-way clutch typically acts due to this CW rotation, the clutch plate 315 performs the CCW rotation in a state where the load resistance applied by the rotation is low. Accordingly, the lowering speed of the suction cap 350 is increased.

Therefore, in the present embodiment, a second suppressing wall 96 is provided along the rotational movement path of the lever member 311 as a rotation suppressing portion which suppresses the rotation of the lever member 311 about the lever shaft portion 316 so as not to release the engagement between the engaging claw 313 and the engaging groove 303 in the outer circumference of the clutch plate 315. In the present embodiment, the second suppressing wall 96 is formed in the frame structure 90 similarly to the first suppressing plate 95. As a result, in the movement section H2 until the suction cap 350 lowers from the contact position and reaches the separating position, the range where the one-way clutch does not act due to the second suppressing wall is set.

The second suppressing wall 96 is provided in this way such that the one-way clutch does not act. Accordingly, the clutch plate 315 is pressed against the engaging groove 303 by the engaging claw 313 to rotate the third gear 300. As a result, in the period in which the one-way clutch does not act, the load resistance applied by the rotation of the third gear 300 is applied to the rotation of the clutch plate 315 to suppress the suction cap 350 from rapidly dropping.

Here, in the present embodiment, when the clutch plate 315 rotates by 360 degrees and returns to the rotation start position, that is, when the suction cap 350 returns to the separating position, namely, the reference position, the one-way clutch acts as described above. Therefore, as shown in FIG. 13(*a*), the first suppressing wall 95 and the second suppressing wall 96 are formed at the position where the clutch plate 315 starts rotating or the position where the clutch plate 315 rotates about 360 degrees so as not to be present in the rotation track until the lever member 311 rotates about the lever shaft portion 316 to release the engagement between the engaging groove 303 and the engaging claw 313.

Next, the mechanism relating to the vertical movement of the suction cap 350 will be described. In the present embodiment, as described above, the suction cap is separated from the liquid ejecting head 30 by a distance such that the wiping member 450 can move above the separating position. Here, in the present embodiment, the suction cap 350 can be vertically moved to a large degree using the crank mechanism 360 serving as a lifting and lowering mechanism and the suction cap 350 can be positioned in the liquid ejecting head 30 in the front, back, left, and right position. Hereinafter, first, regarding the vertical movement using the crank mechanism 360 of the suction cap 350, the configuration thereof will be described in detail. Next, the structure of positioning the suction cap 350 in the liquid ejecting head 30 will be described.

Figure 14:
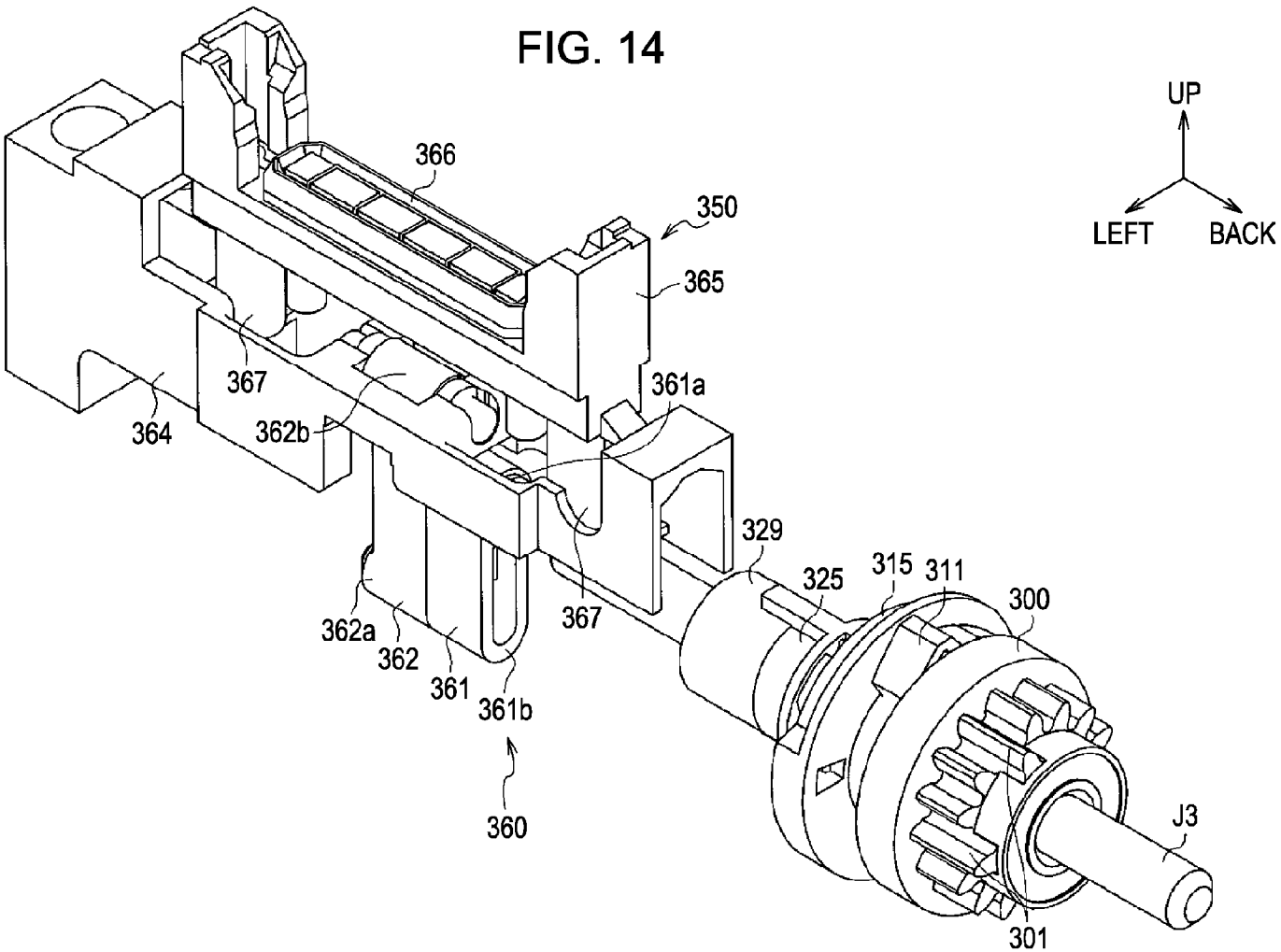
FIG. 14 is a perspective view illustrating the driving system of the clutch mechanism which lifts and lowers the suction cap.

As shown in FIG. 14, the crank mechanism 360 of the suction cap 350 includes a driving lever 361 in which the driving force is transmitted from the third rotation shaft J3 and operated and a driven lever 362 which is connected such that the driving force can be transmitted to the driving lever 361. The driving lever 361 is formed in a substantially long circle shape where the contour shape when seen from the back has a longitudinal direction. In addition, the driving lever 361 is fixed and connected such that the front end of the third rotation shaft J3 is fitted into one end 361*a* (upper end in FIG. 14) in the longitudinal direction of the driving lever 361. Further, the driving lever 361 is connected to the driven lever 362 such that the other end 361*b* (lower end in FIG. 14) in the longitudinal direction of the driving lever 361 can rotate. That is, the driving lever 361 and the driven lever 362 are connected so as to allow the relative rotation about the connecting portion therebetween.

Similar to the drive lever 361, the driven lever 362 is formed in a substantially long circle shape where the contour shape when seen from the back has a longitudinal direction. In addition, one end 362*a* (lower end in FIG. 14) in the longitudinal direction of the driven lever 362 is rotatably connected to the driving lever 361 as a first connecting portion and the other end 362*b* (upper end in FIG. 14) in the longitudinal direction of the driven lever 362 is rotatably connected to the suction cap 350 as a second connecting portion.

The size of the driven lever 362 in the longitudinal direction is set to be larger than that of the driving lever 361 in the longitudinal direction. Therefore, as shown in FIG. 14, in a state where the driving lever 361 and the driven lever 362 overlap each other to match the longitudinal directions thereof, the other end 362*b* of the driven lever 362 which is connected to the suction cap 350 (upper end in FIG. 14) is positioned above the third rotation shaft J3 which is connected to the driving lever 361.

The suction cap 350 includes a cap holder (holding member) 364 to which the driven lever 362 is connected and a cap member 365 which is supported by the cap holder 364. In addition, the other end 362*b* (upper end in FIG. 14) serving as the second connecting portion of the driven lever 362 is rotatably connected to the cap holder 364.

The cap member 365 is formed in a substantially U-shape in a side view when seen from the left and is provided with a contact portion 366 having a substantially box tube-shaped elastic material which is tapered in the front-back direction so as to protrude upward from the bottom surface of the cap member 365. In addition, since the cap member 365 is in close contact with the liquid ejecting head 30 along with the elastic deformation of the contact portion 366, the nozzle opening of the liquid ejecting head 30 is covered with the air-tight closed space.

Further, coil springs 367 are respectively provided as a biasing member at positions of both ends in the longitudinal direction of the bottom surface of the cap member 365 between the bottom surface of the cap member 365 and the top surface of the cap holder 364. In addition, typically, the cap member 365 is approximately positioned in the cap holder 364 in the front, back, left, and right direction in a state of being biased upward by the coil springs 367. Therefore, the cap member 365 is pressed down to compress the coil spring 367 and moves downward relative to the cap holder 364. In addition, due to this downward movement, the cap member 365 can move in the front, back, left, and right directions. In this way, since the cap member 365 can move in the front, back, left, and right directions, the cap member 365 of the suction cap 350 can be positioned in the liquid ejecting head 30 as described later even when the position of the cap holder 364 is shifted from the liquid ejecting head 30 (head unit) in the front, back, left, and right directions. Further, the suction cap 350 as a cap device configures a cap unit which can integrally lift using the cap holder 364, the coil spring 367, and the cap member 365.

Figure 15:
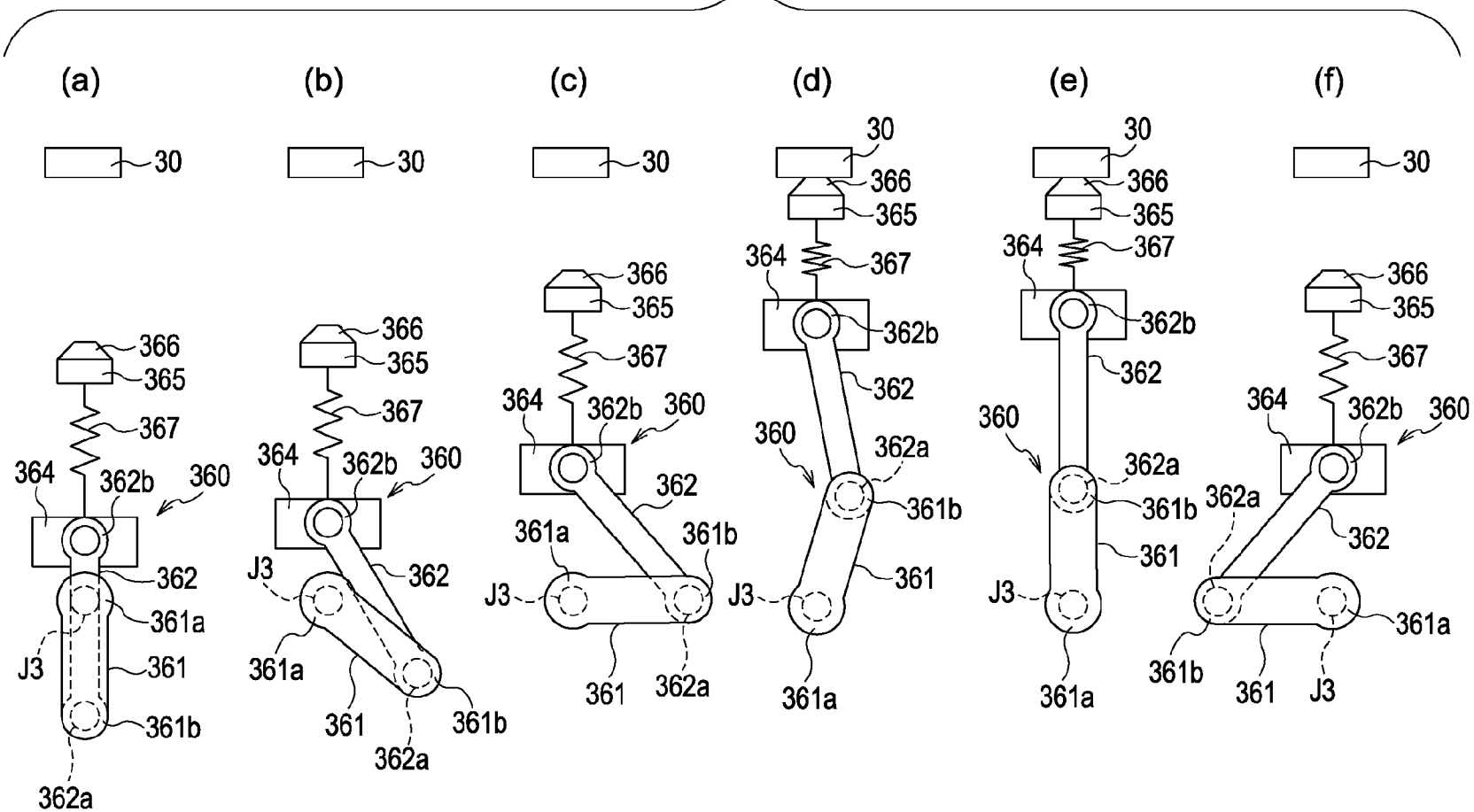
FIG. 15(*a*) to (*f*) are diagrams illustrating the operation of the clutch mechanism which lifts and lowers the suction cap.

Next, the mechanism of the lifting and lowering movement of the suction cap 350 which is performed by the crank mechanism 360 of the suction cap 350 will be described with reference to FIG. 15. FIG. 15(*a*) illustrates a state where the driving lever 361 overlaps the driven lever 362 in the front-back direction. In this state, the end 362*b* of the driven lever 362 which is connected to the cap holder 364 is positioned at the lowest position when the driving lever 361 rotates about the third rotation shaft J3 and the contact portion 366 of the cap member 365 is positioned at the farthest position from the liquid ejecting head 30 in the up-down direction. In the present embodiment, the positions are the start position and the end position of the lifting and lowering movement of the suction cap 350.

Next, in this state (start position), as shown in FIG. 15(*b*), the rotation of the third gear 300 is transmitted to the third rotation shaft J3 by the clutch mechanism 310 to perform the CCW rotation. The rotation thereof is transmitted to the driving lever 361 by the third rotation shaft J3. Then, the driving lever 361 performs the CCW rotation in the same direction as the rotation direction of the third rotation shaft J3 on the basis of the driving force transmitted from the third rotation shaft J3. In addition, the end 361*b* of the driving lever 361 which is connected to the driven lever 362 performs the revolving movement about the third rotation shaft J3.

Here, as described above, the displacement direction of the cap holder 364 which is connected to the end 361*b* of the driven lever 362 is restricted to the up-down direction by the suction cap guide rod 35 which is fixed to the frame structure 90. In addition, the displacement direction of the end 362*b* of the driven lever 362 which is connected to the cap holder 364 is also restricted to the up-down direction. Further, the size of the driven lever 362 in the longitudinal direction is set to be longer than that of the driving lever 361 in the longitudinal direction. Therefore, in the driven lever 362, when one end 362*a* serving as the first connection portion connected to the driving lever 361 performs the revolving movement about the third rotation shaft J3, the end 362*b* serving as the second connection portion connected to the cap holder 364 moves upward in principle, thereby lifting the cap holder 364. Therefore, the cap member 365 which is biased above the cap holder 364 through the coil spring 367 lifts and approaches the liquid ejecting head 30 along with the lifting of the cap holder 364.

Further, as shown in (*a*) and (*b*) of FIG. 15, when the rotation angle of the crank mechanism 360 is small during the CCW rotation of the driving lever 361, the lifting amount of the cap holder 364 is small. As the rotation angle becomes larger, the cap holder 364 lifts to a larger degree. Therefore, in the crank mechanism 360 according to the present embodiment, if the cap holder 364 lifts when the angle between the driving lever 361 and the driven lever 362 is equal to or larger than a predetermined angle, the cap holder 364 can efficiently lift in response to the rotation of the driving lever 361. Here, it is preferable in practice that the predetermined angle be 30 degrees. In the present embodiment, as shown in FIG. 15(*a*), the angle between the driving lever 361 and the driven lever 362 is 0 degrees. In this case, the distance between the liquid ejecting head 30 and the contact portion 366 can be set to be large. Accordingly, it is desirable that the position of the driving lever 361 when the angle between the driving lever 361 and the driven ever 362 is from 0 degrees to 30 degrees be a starting position of the driving lever 361.

Next, as shown in FIG. 15(*c*), when the third rotation shaft J3 further rotates and the longitudinal direction of the driving lever 361 is at a position in the horizontal direction, the end 361*b* connected to the driven lever 362 is most separated in the right direction. In other words, the right side occupied area necessary for the driving lever 361 to rotate (swing) have only to be approximately the length of the driving lever 361.

Next, as shown in FIG. 15(*d*), when the third rotation shaft J3 further rotates, the suction reaches the suction position. At this time, in the present embodiment, the driving lever 361 is in a state of performing the CCW rotation by 163 degrees from the start position. In this state, the driven lever 362 is positioned upward from the end (first connecting portion) 362*a* connected to the driving lever 361. In addition, the driven lever 362 intersects the driving lever 361 so as to form an obtuse angle close to almost 180 degrees. That is, in the driven lever 362, the end (second connecting portion) 362*b* connected to the cap holder 364 is positioned to be slightly inclined in the upper left direction of the end 362*a* connected to the driving lever 361 as shown in FIG. 15(*d*). As a result, the crank mechanism 360 can lift the cap holder 364 from the start position in the vertical direction by a distance almost two times the length of the driving lever 361.

In the suction position, the contact portion 366 of the cap member 365 which is connected to the cap holder 364 through the coil spring 367 comes into close contact with the liquid ejecting head 30 along with lifting of the cap holder 364. In addition, in the suction position, the contact portion 366 moves downward relative to the cap holder 364 and comes into close contact with the liquid ejecting head 30 while having the elastic deformation. Accordingly, the air-tight closed space is formed between the contact portion 366 of the cap member 365 and the liquid ejecting head 30. In addition, in this state, when the suction pump 650 operates, the pressure of the closed space formed between the contact portion 366 of the cap member 365 and the nozzle-formed surface of the liquid ejecting head 30 is reduced to suction ink from the nozzle of the liquid ejecting head 30.

Next, as shown in FIG. 15(*e*), when the third rotation shaft J3 further rotates, the suction cap reaches the atmosphere-opened suction position described above. At this time, the driving lever 361 performs the CCW rotation by 180 degrees from the start position in the present embodiment. In this state, the driven lever 362 is positioned upward from the end 362*a* connected to the driving lever 361 and intersects the driving lever 361 to form 180 degrees, that is, forms a straight line with the driving lever 361. As a result, the crank mechanism 360 can lift the cap holder 364 from the start position in the vertical direction by a distance two times the length of the driving lever 361. In addition, the end 362*b* of the driven lever 362 which is connected to the cap holder 364 is positioned at the highest position when the driving lever 361 rotates about the third rotation shaft J3.

Then, as the cap holder 364 slightly lifts from the state shown in FIG. 15(*d*), the coil springs 367 provided between the cap holder 364 and the cap member 365 is further compressed. As a result, the biasing force which is larger than that of FIG. 15(*d*) is applied to the cap member 365 from the coil spring 367. Therefore, the contact portion 366 of the cap member 365 further strongly comes into close contact with the liquid ejecting head 30. In addition, in the atmosphere-opened suction position, when the vacuum suction of the closed space which is opened to the atmosphere is performed, ink stored in the cap member 365 can be discharged.

Further, as shown in (*d*) and (*e*) of FIG. 15, in the crank mechanism 360, when the angle between the driving lever 361 and the driven lever 362 is large during the CCW rotation of the driving lever 361, it can be seen that the lifting amount of the cap holder 364 is small. Therefore, in the crank mechanism 360 according to the present embodiment, when the rotation angle of the driving lever 361 is a predetermined angle equal to or smaller than 163 degrees, the cap holder 364 lifts such that the contact portion 366 of the cap member 365 comes into contact with the liquid ejecting head 30. In this way, the lifting amount of the cap holder 364 since the contact portion 366 of the cap member 365 comes into contact with the liquid ejecting head 30 is suppressed. Accordingly, the increase in change of the biasing force which is applied to the cap member 365 by the coil spring 367 is suppressed. As a result, the elastic deformation of the contact portion 366 in the cap member 365 is suppressed and thus comes into contact with the liquid ejecting head 30 while stably maintaining the close contact state. In a case where the contact portion 366 is made of material of which the elastic force is deteriorated due to the repetition of the elastic deformation, it is preferable to use the above-described method. In addition, since the movement angle is short, the movement time is small. Further, in practice, it is preferable that the predetermined angle be 135 degrees or more. In the present embodiment, the driving lever 361 rotates by 180 degrees as shown in FIG. 15(*e*). In this case, since the biasing force of the coil spring 367 is the maximum, the contact portion 366 can be reliably and suitably in close contact with the liquid ejecting head 30.

Next, as shown in FIG. 15(*f*), when the third rotation shaft J3 further rotates and the longitudinal direction of the driving lever 361 is at a position in the horizontal direction, the end 361*b* connected to the driven lever 362 is most separated in the left direction. In other words, the left side occupied area necessary for the driving lever 361 to rotate (swing) only has to be approximately the length of the driving lever 361. Here, in the process of the driving lever 361 moving to the horizontal position, the suction cap 350 also lowers such that the cap member 365 which is connected to the cap holder 364 through the coil spring 367 is also separated from the liquid ejecting head 30. Here, in this case, in the state shown in FIG. 15(*e*), since the pressure of the closed space formed between the contact portion 366 of the cap member 365 and the liquid ejecting head 30 is approximately equal to the atmosphere pressure along with the atmosphere opening, the cap member 365 can be separated from the liquid ejecting head 30.

Next, the specific structure of positioning the suction cap 350 in the liquid ejecting head 30 will be described with reference to FIGS. 16 to 21. Further, in the present embodiment, using the shape provided in the liquid ejecting head 30, the cap member 365 of the suction cap 350 can be positioned in the liquid ejecting head 30. Therefore, the structure of the liquid ejecting head 30 will be first described.

As shown in the upper section in FIG. 16, the liquid ejecting head 30 according to the present embodiment includes five head units 30*a* which are arranged in the left-right direction and is covered and held from below with a metal plate 31 which is bent upward in the front, back, left, and right directions. In addition, a protrusion 32 protruding by a predetermined amount from the end surface in the front-back direction of the liquid ejecting head 30 is formed so as to correspond to each of the head units 30*a*. Therefore, regarding the position of each of the head units 30*a* in the liquid ejecting head 30, the front-back direction thereof is determined by the plate 31 and the left-right direction thereof is determined by the protrusion 32.

Next, the structure of the cap member 365 will be described. As shown in FIG. 16, walls 368 protruding upward from both side in the longitudinal direction are provided in the cap member 365 of the suction cap 350. The walls 368 are arranged at an interval almost equal to the size of the head units 30*a* of the liquid ejecting head 30 in the longitudinal direction (front-back direction). In addition, recesses 369 which have a substantially U-shape in a plan view when seen from above and of which the internal surfaces are opposed to each other in the front-back direction are formed in the walls 368. In addition, when the cap member 365 lifts and approaches the liquid ejecting head 30, the protrusion 32 of the liquid ejecting head 30 is inserted into each of the recesses 369 of the wall 368. In addition, a portion of the plate 31 of the liquid ejecting head 30 in the front-back direction is inserted between the walls 368 in the front-back direction.

Figure 16:
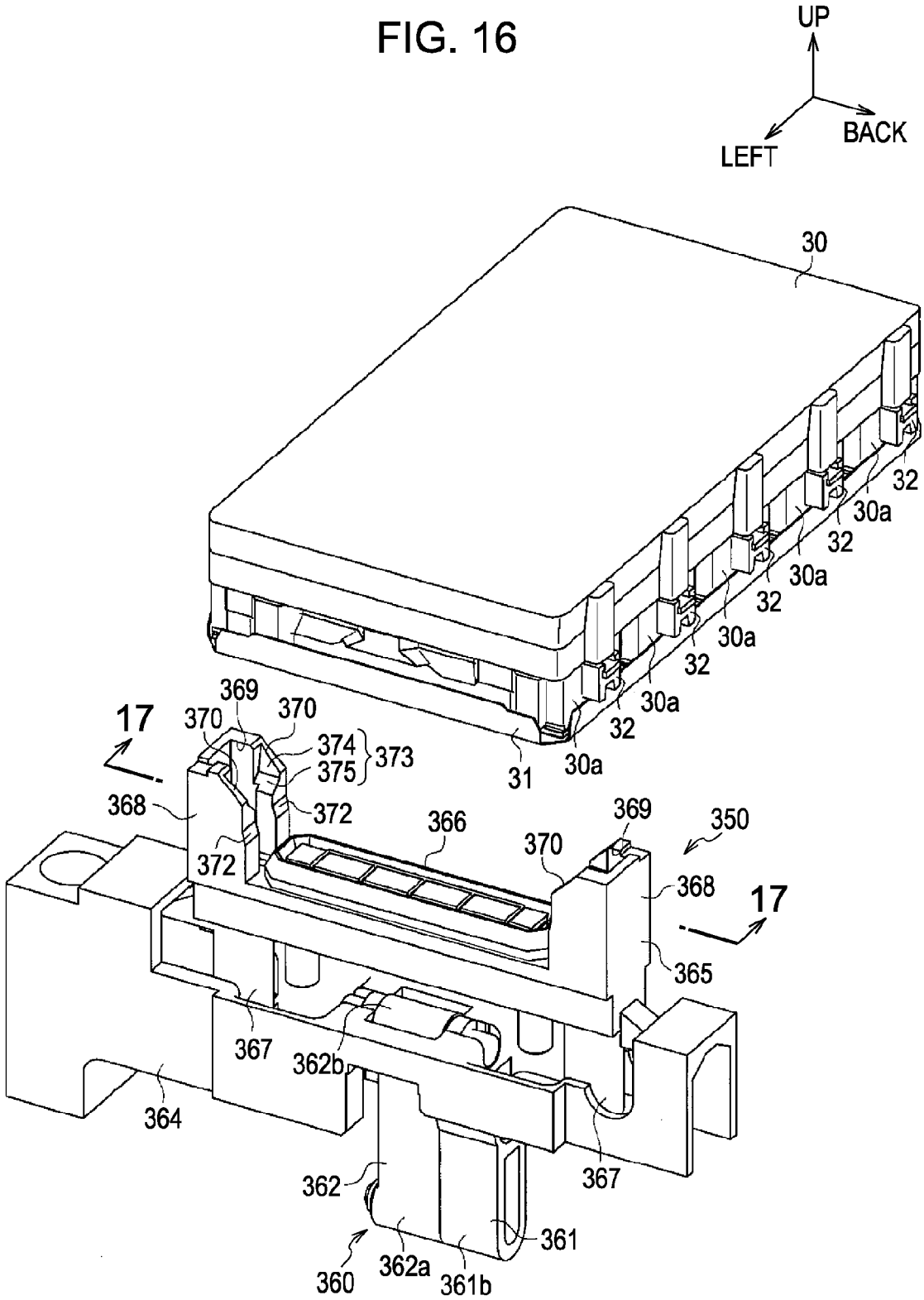
FIG. 16 is a perspective view illustrating the liquid ejecting head and the suction cap.
Figure 17:
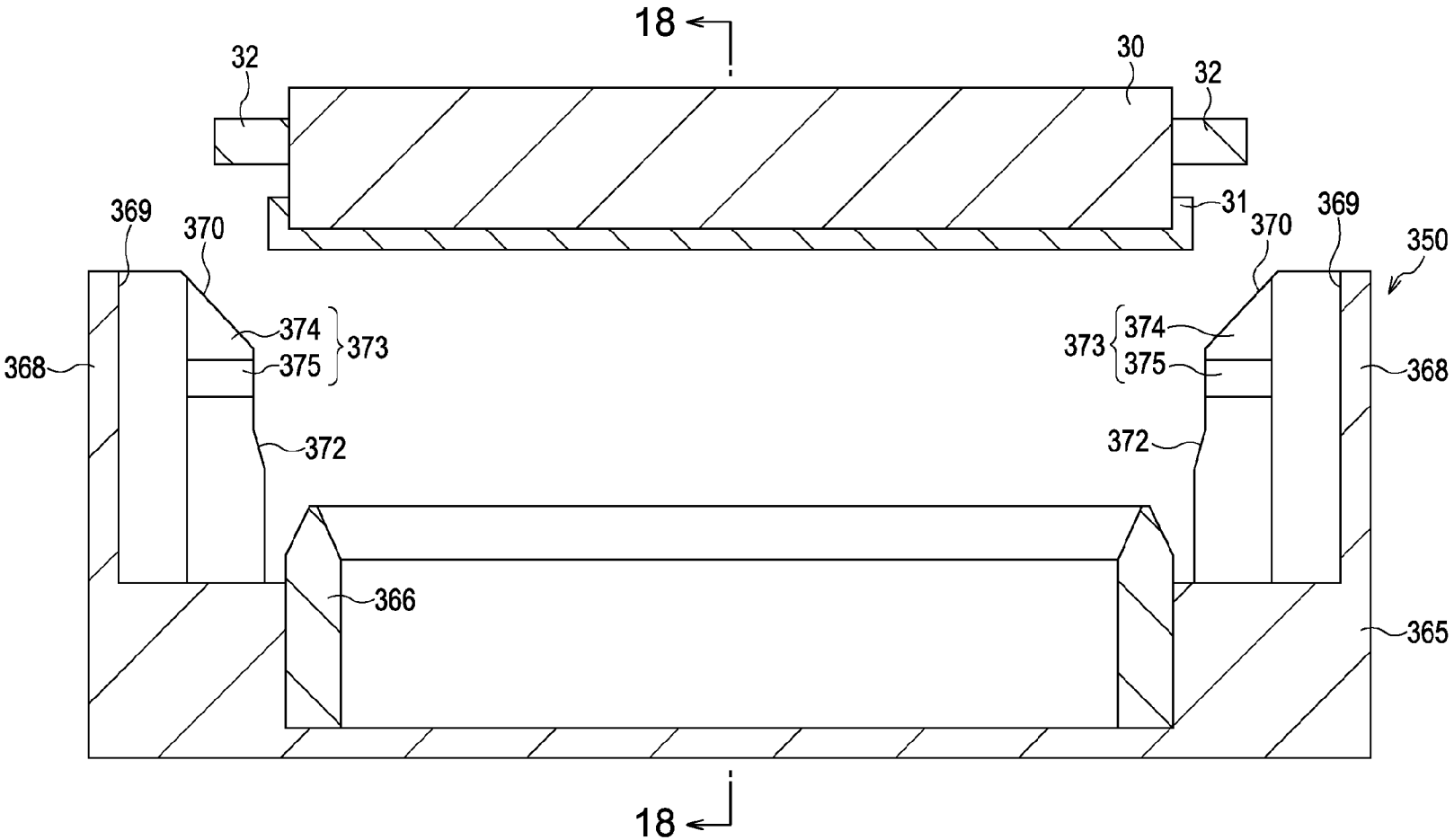
FIG. 17 is a cross-sectional view taken along the line 17-17 of FIG. 16.

As shown in the cross-sectional views in FIGS. 16 and 17, in the walls 368, first inclined surfaces (first sliding surfaces) 370 are respectively formed on both sides in the left-right direction at the upper ends of the internal surfaces which are opposite to each other in the front-back direction. The first inclined surfaces (second sliding surfaces) 370 are formed such that the separating distance in the front-back direction between the first inclined surfaces 370 is gradually increased in the upward direction approaching the liquid ejecting head 30 in a side view when seen from the left-right direction. In addition, in the lower end of each of the first inclined surfaces 370, the separating distance in the front-back direction between the first inclined surfaces 370 is slightly greater than the size of the plate 31 in the front-back size of the liquid ejecting head 30.

Further, in the internal surfaces, which are opposite to each other in the front-back direction, of the wall surfaces 368, second inclined surfaces 372 are formed at both sides in the left-right direction at an approximately central position in the up-down direction. The second inclined surfaces 372 are formed such that the separating distance in the front-back direction between the second inclined surfaces 372 is gradually increased in the upward direction approaching the liquid ejecting head 30 in a side view when seen from the left-right direction. In addition, in the lower end of each of the second inclined surfaces 372, the separating distance in the front-back direction between the second inclined surfaces 372 is formed to be almost equal to the size of the plate 31 in the front-back direction of the liquid ejecting head 30.

Figure 18:
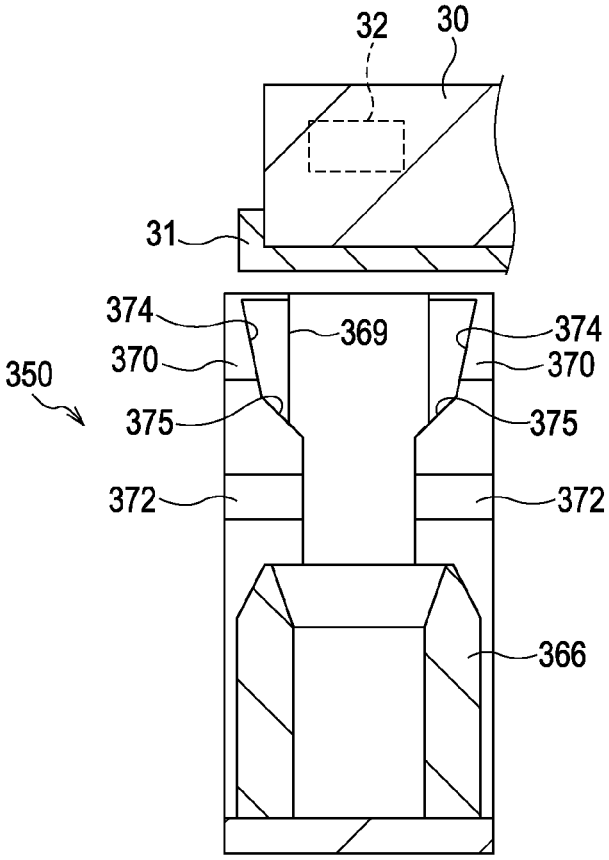
FIG. 18 is a cross-sectional view taken along the line 18-18 of FIG. 17.

Meanwhile, as shown in the cross-sectional views in FIGS. 16 and 18, in the recess 369 of each of the walls 368, third inclined surfaces 373 are respectively formed at the upper ends of the internal surfaces which are opposite to each other in the left-right direction. The third inclined surfaces 373 are formed such that the separating distance in the left-right direction between the internal surfaces of the recess 369 is gradually increased in the upward direction approaching the liquid ejecting head 30 in a side view when seen from the front-back direction. The third inclined surfaces 373 are formed such that the inclination pitch of an upper side portion 374 is larger than that of a lower side portion 375. That is, the third inclined surfaces 373 are formed such that the upper side portion 374 intersects the lower side portion 375 to form an obtuse angle.

In addition, the third inclined surfaces 373 are formed such that the separating distance in the left-right direction between the internal surfaces of the recess 369 is slightly greater than the size of the protrusion 32 of the liquid ejecting head 30 in the left-right direction at the boundary between the upper side portion 374 and the lower side portion 375. In addition, the third inclined surfaces 373 are formed such that the separating distance in the left-right direction between the internal surfaces of the recess 369 is almost equal to the size of the protrusion 32 of the liquid ejecting head 30 in the left-right direction in the lower end of the lower side portion 375.

In the present embodiment, when the protrusion 32 of the liquid ejecting head 30 is inserted from above into the recess 369, the cap member 365 can be positioned in each of the head units 30*a* in the front, back, left, and right directions. Hereinafter, firstly, the mechanism of positioning in the front-back direction will be described and then the mechanism of positioning in the left-right direction will be described.

Figure 19:
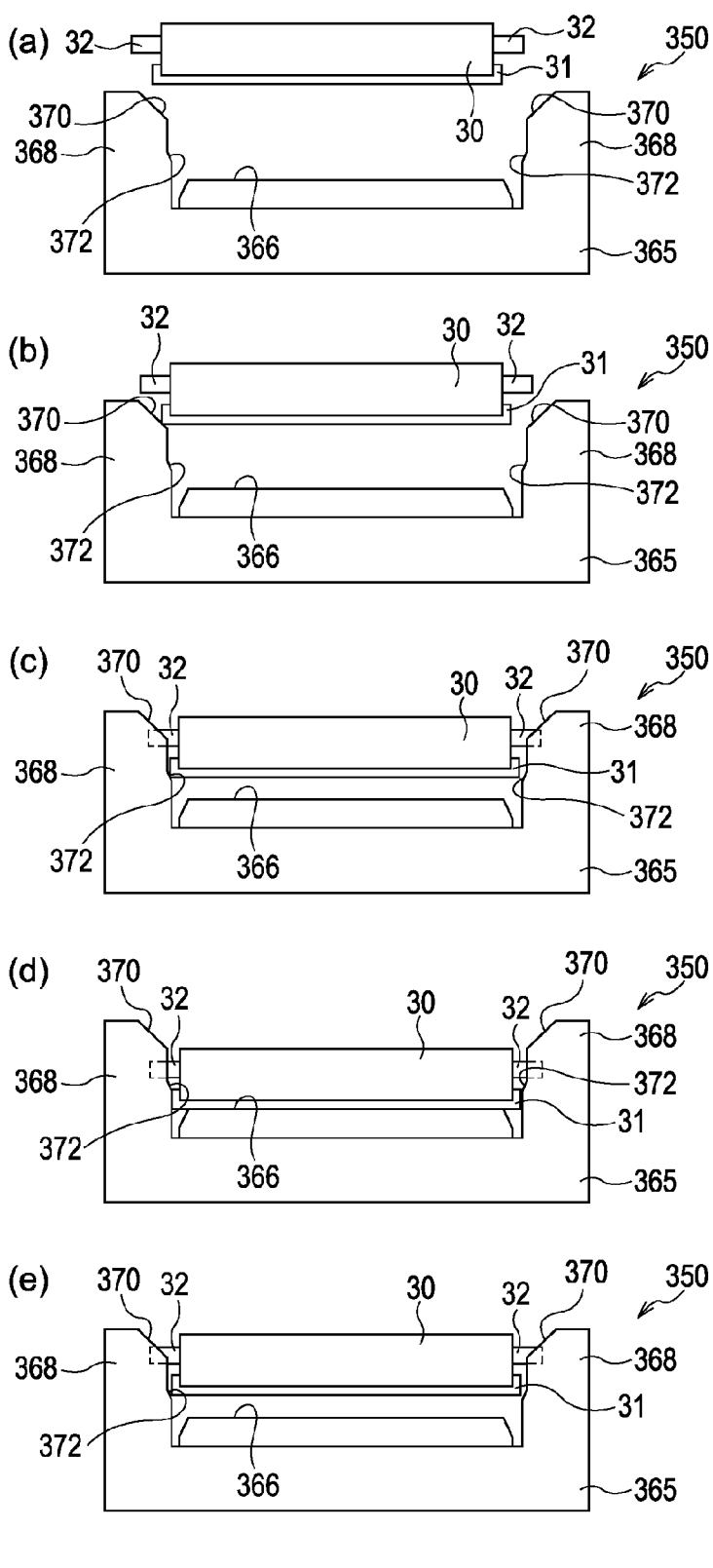
FIG. 19(*a*) to (*e*) are diagrams illustrating the operation of the suction cap which is positioned in a front-back direction of the liquid ejecting head.

The mechanism of positioning the suction cap 350 in the liquid ejecting head 30 in the front-back direction will be described with reference to FIG. 19. FIG. 19(*a*) illustrates a state where the contact portion 366 of the cap member 365 is arranged opposite to the liquid ejecting head 30 in the up-down direction while causing a position gap with the liquid ejecting head 30 in the front-back direction.

From this state, as shown in FIG. 19(*b*), when the suction cap 350 lifts and approaches the liquid ejecting head 30, the first inclined surface 370 of the cap member 365 comes into contact with the plate 31 provided in the liquid ejecting head 30. In addition, when the first inclined surface 370 of the cap member 365 slides along the plate 31 of the liquid ejecting head 30, the cap member 365 lifts and approaches the liquid ejecting head 30 while moving relative to the liquid ejecting head 30 in the front-back direction.

In addition, as shown in FIG. 19(*c*), when the suction cap 350 further lifts and approaches the liquid ejecting head 30, the first inclined surface 370 of the cap member 365 runs onto the plate 31 of the liquid ejecting head 30. Then, the second inclined surface 372 of the cap member 365 comes into contact with the plate 31 of the liquid ejecting head 30. Further, when the second inclined surface 372 of the cap member 365 slides along the plate 31 of the liquid ejecting head 30, the contact portion 366 lifts and approaches the liquid ejecting head 30 while moving relative to the liquid ejecting head 30 in the front-back direction.

In addition, when the suction cap 350 further lifts and approaches the liquid suction head 30, the second inclined surface 372 of the cap member 365 runs onto the plate 31 of the liquid ejecting head 30. Here, in the cap member 365, the separating distance between the lower ends in the front-back direction of the second inclined surface 372 is almost equal to the size of the liquid ejecting head 30 in the front-back direction. Therefore, when the first inclined surface 370 of the cap member 365 runs onto the plate 31 of the liquid ejecting head 30, the plate 31 of the liquid ejecting head 30 is inserted so as to be fitted between both of the walls 368 of the cap member 365. Accordingly, the cap member 365 is positioned in the liquid ejecting head 30, that is, the head unit 30*a* in the front-back direction. In this way, the mechanism of positioning the suction cap 350 in the liquid ejecting head 30 in the front-back direction is configured.

Further, as shown in FIG. 19(*d*), the cap member 365 in the state of being positioned in this way lifts to the position where the contact portion 366 comes into contact with the liquid ejecting head 30, the closed space covering the nozzle of the liquid ejecting head 30 is reliably formed between the contact portion 366 of the cap member 365 and the liquid ejecting head 30. Further, as shown in FIG. 19(*d*), in the state where the contact portion 366 is in contact with the liquid ejecting head 30, an upper end of a portion, which is in close contact with the side surface of the liquid ejecting head 30, in the plate 31 is positioned above a lower end of the second inclined surface 372 of the cap member 365. Therefore, a slight clearance is interposed between the upper end portion of the plate 31 and the second inclined surface 372 of the cap member 365 in the front-back direction. Therefore, from this state, as shown in FIG. 19(*e*), when the suction cap 350 lowers so as to be separated from the liquid ejecting head 30, the plate 31 of the liquid ejecting head 30 is suppressed from being locked by the internal surface of the cap member 365.

Figure 20:
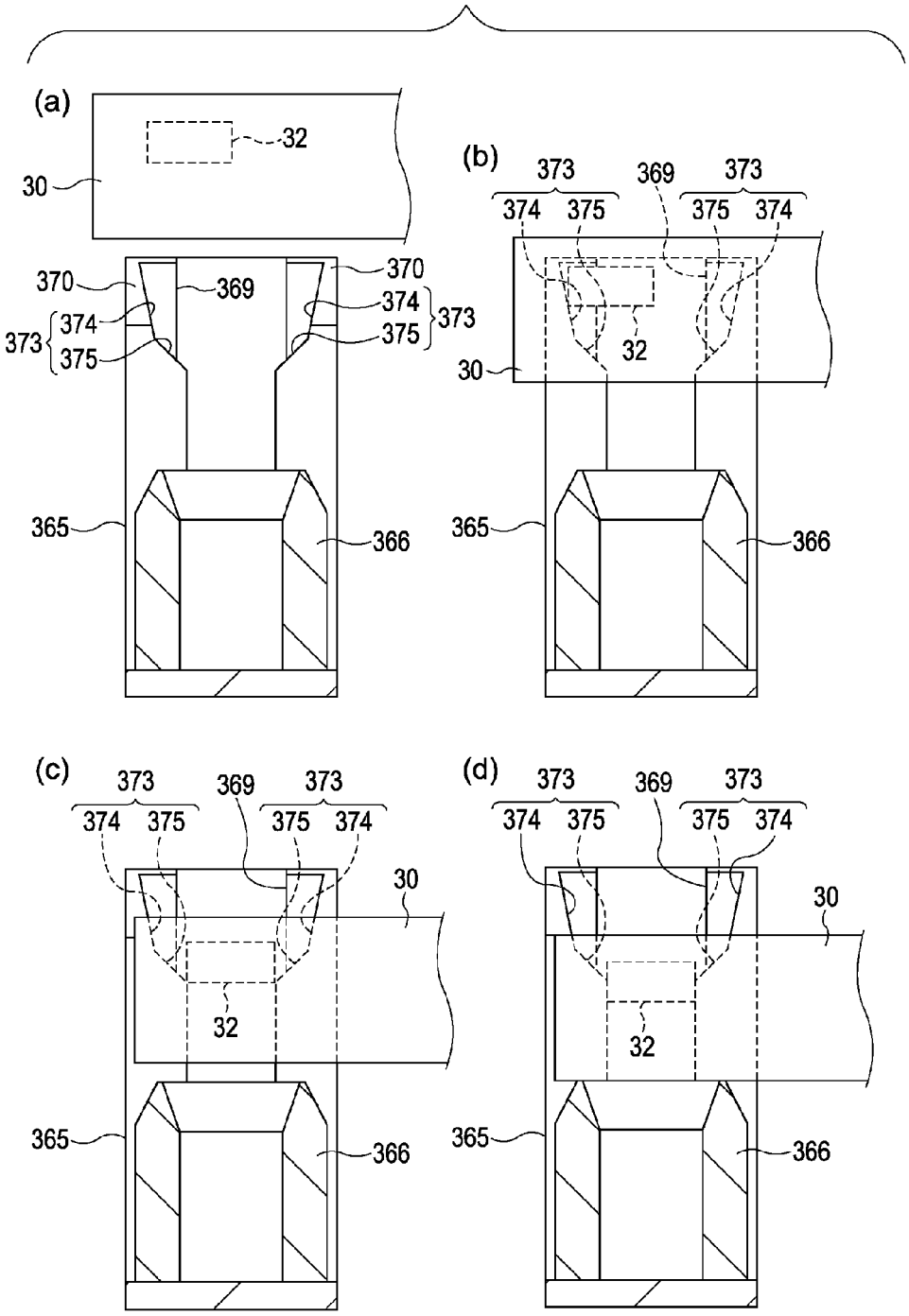
FIG. 20(*a*) to (*d*) are diagrams illustrating the operation of the suction cap which is positioned in the left-right direction of the liquid ejecting head.

Next, the mechanism of positioning the suction cap 350 in the liquid ejecting head 30 in the left-right direction will be described with reference to FIG. 20. FIG. 20(*a*) illustrates a state where the contact portion 366 of the cap member 365 is arranged opposite to the liquid ejecting head 30 in the up-down direction while causing a position gap with the liquid ejecting head 30 in the left-right direction.

From this state, as shown in FIG. 20(*b*), when the suction cap 350 lifts and approaches the liquid ejecting head 30, the upper side portion 374 in the third inclined surface 373 of the cap member 365 comes into contact with the protrusion 32 of the liquid ejecting head 30. In addition, when the upper side portion 374 and the lower side portion 375 in the third inclined surface 373 of the cap member 365 slides along the protrusion 32 of the liquid ejecting head 30, the contact portion 366 of the cap member 365 lifts and approaches the liquid ejecting head 30 while moving relative to the liquid ejecting head 30 in the left-right direction.

Next, as shown in FIG. 20(*c*), when the suction cap 350 further lifts and approaches the liquid suction head 30, the third inclined surface 373 of the cap member 365 runs onto the protrusion 32 of the liquid ejecting head 30. Here, in the cap member 365, the separating distance between the lower ends in the left-right direction of the lower side portion 375 of the third inclined surface 373 is almost equal to the size of the protrusion 32 of the liquid ejecting head 30 in the left-right direction. Therefore, when the third inclined surface 373 of the cap member 365 runs onto the protrusion 32 of the liquid ejecting head 30, the protrusion 32 of the liquid ejecting head 30 is inserted so as to be fitted into the recess 369 of the cap member 365. Accordingly, the cap member 365 is positioned in the liquid ejecting head 30, that is, the head unit 30*a* in the left-right direction. In this way, the mechanism of positioning the suction cap 350 in the liquid ejecting head 30 in the left-right direction is configured.

Further, as shown in FIG. 20(*d*), the cap member 365 lifts up to the position where the contact portion 366 of the cap member 365 in the state of being positioned in this way comes into contact with the liquid ejecting head 30, the closed space covering the nozzle of the liquid ejecting head 30 is reliably formed between the contact portion 366 of the cap member 365 and the nozzle-formed surface of the liquid ejecting head 30.

Figure 21:
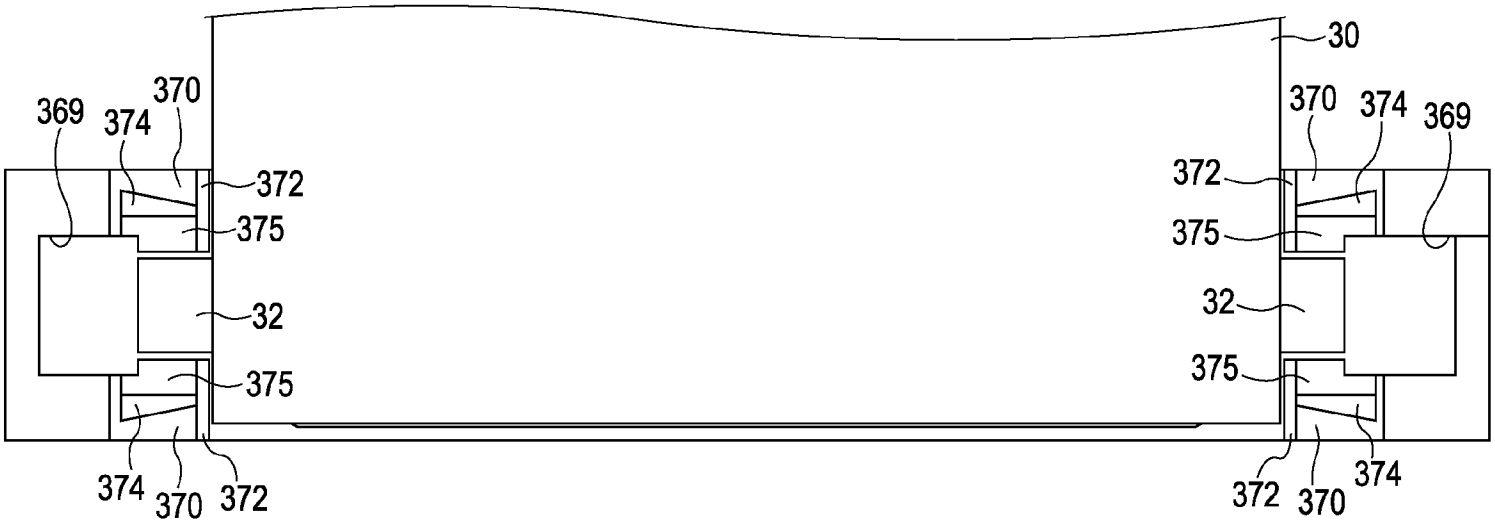
FIG. 21 is a plan view illustrating the liquid ejecting head and the suction cap when seen from above.

In the present embodiment, the positioning in the front-back direction and the positioning in the left-right direction are performed in parallel. Therefore, as shown in FIG. 21, when the cap member 365 lifts to the liquid ejecting head 30, the cap member 365 can be simultaneously positioned in the front, back, left, and right directions. That is, the cap member 365 is simultaneously positioned between the second inclined surfaces 372 which are formed at the front and back walls 368 in the front-back direction and between the lower side portions 375 of the third inclined surfaces 373 which are formed at the front and back walls 368 in the left-right direction. Further, FIG. 21 is a plan view illustrating the state where the cap member 365 is positioned in the head unit 30*a* which is positioned at the most left side of the liquid ejecting head 30 when seen from above.

Next, the structure relating to the vertical movement of the FL box (liquid containing member) 380 which is driven in the up-down direction by the rotation of the third gear 300 will be described. When the liquid ejecting head 30 vertically moves and is displaced due to the vertical movement, the gap with the liquid ejecting head 30 is adjusted to be an optimal distance for ink ejection check.

Figure 22:
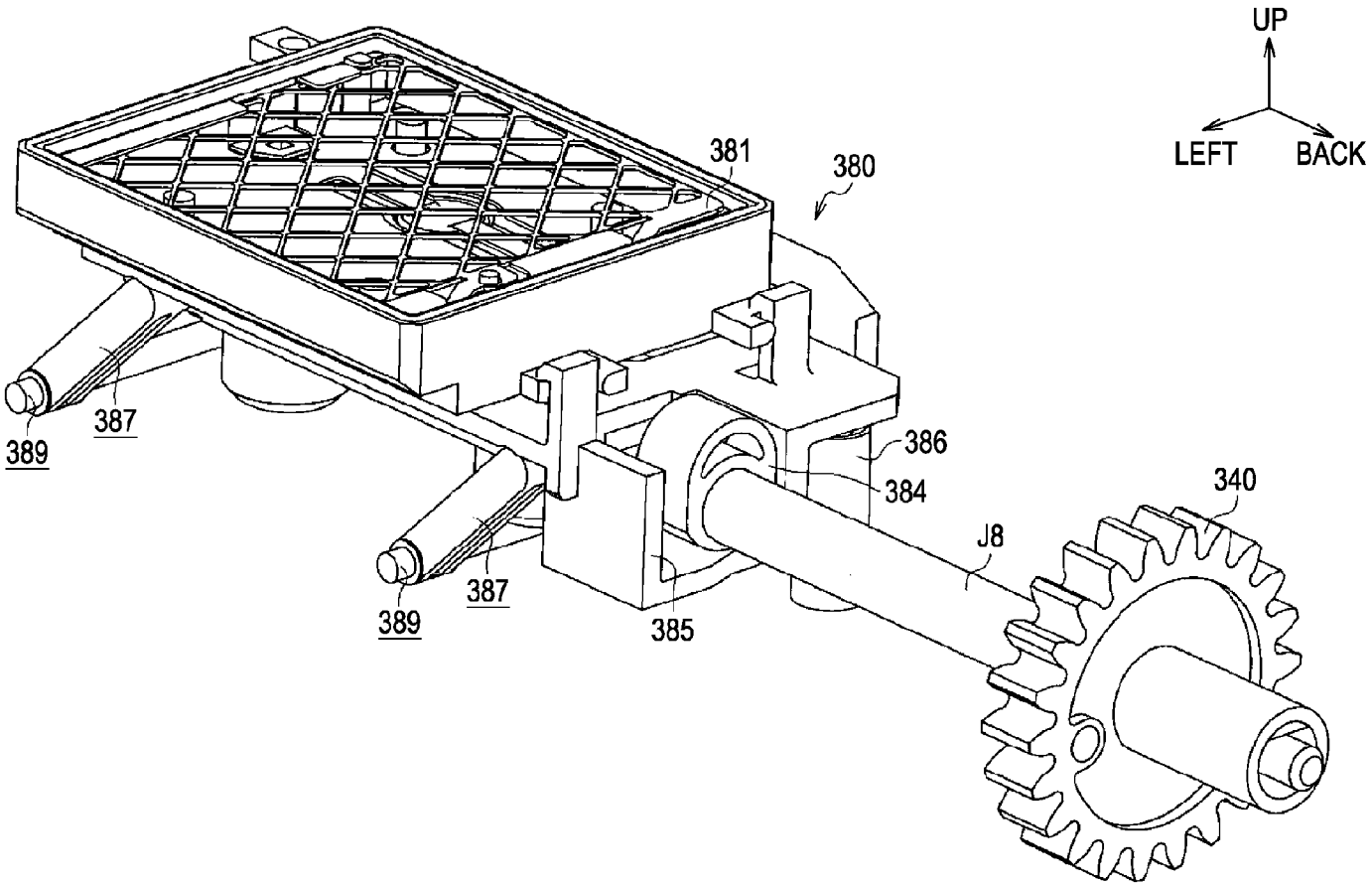
FIG. 22 is a perspective view illustrating the driving system of a cam mechanism which lifts and lowers an FL box.
Figure 23:
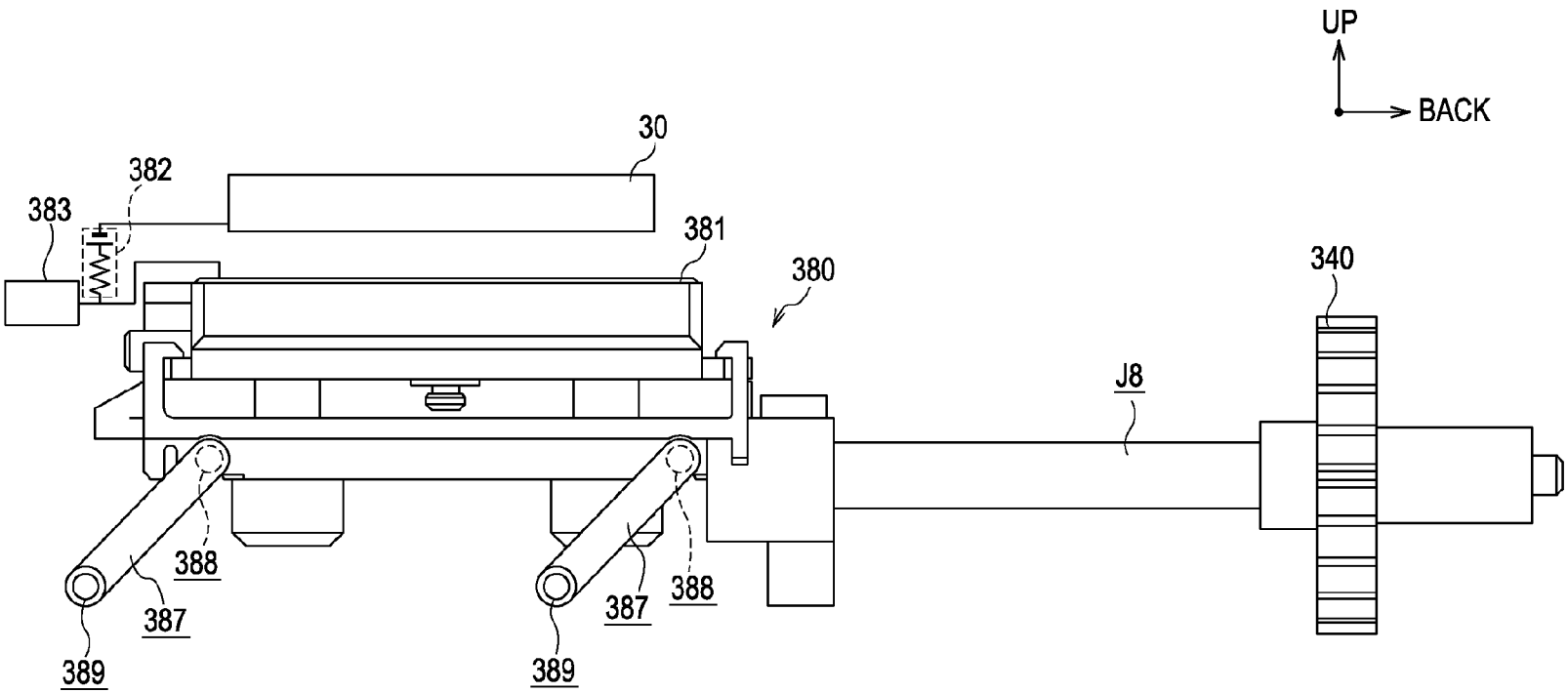
FIG. 23 is a side view illustrating the cam mechanism which lifts and lowers the FL box when seen from the left.

As shown in FIGS. 22 and 23, the FL box 380 is configured to form a bottomed box shape which is open upward in order to contain ink ejected from the liquid ejecting head 30. In addition, a grid-like electrode member 381 made of metal such as stainless steel is provided in the opening of the FL box 380 as a detection electrode. This electrode member 381 is electrically connected to a voltage applying circuit 382 provided in the printer 11 so as to apply a voltage having a predetermined potential difference between the electrode member 381 and the liquid ejecting head 30. In addition, when the voltage applying circuit 382 applies a voltage, a voltage detecting circuit 383 which detects a voltage of the electrode member 381 is provided. Further, in the present embodiment, the voltage applying circuit 382 and the voltage detecting circuit 383 are included in the controller of the printer 11. Further, they may be provided separate from the controller.

In addition, in a state where the voltage applying circuit 382 applies a voltage to the electrode member 381 and thus the predetermined potential difference is generated between the liquid ejecting head 30 and the electrode member 381, when electrically charged ink is ejected from the liquid ejecting head 30, the predetermined potential difference, that is, the voltage of the electrode member 381 is changed. In this case, the voltage detecting circuit 383 detects the voltage change of the electrode member 381 when ink is ejected from the ink ejecting head 30 to the electrode member 381. Accordingly, the ink ejection check which checks whether or not ink is actually ejected is performed. In this ink ejection check, it is important to stabilize the predetermined potential difference between the electrode member 381 and the liquid ejecting head 30 in order to improve the detection accuracy when a voltage is applied to the electrode member 381. Therefore, in the present embodiment, a mechanism which vertically moves the electrode 381, that is, the FL box 380 to the liquid ejecting head 30 in parallel is provided. The mechanism will be described with reference to FIGS. 23 and 24.

Figure 24:
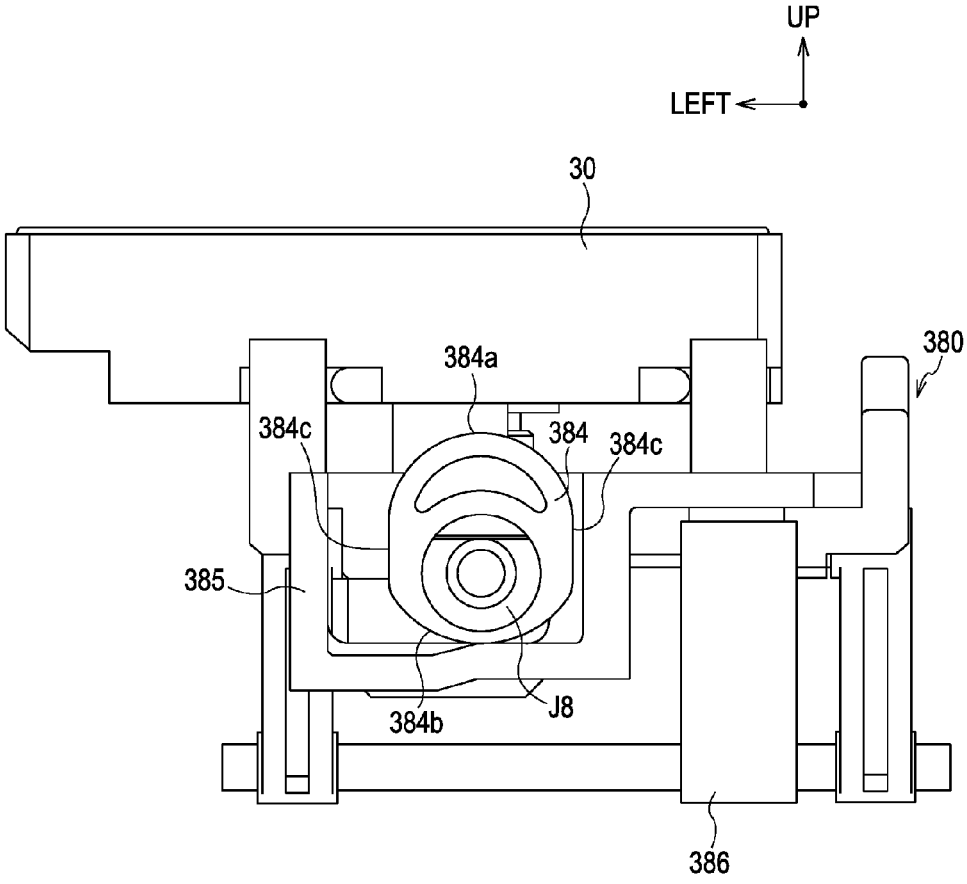
FIG. 24 is a front view illustrating the cam mechanism which lifts and lowers the FL box when seen from the back.

As shown in FIGS. 23 and 24, a cam engaging portion 385 which is engaged with the FL cam 384 including an eccentric cam fixed to the front end of the eighth rotation shaft J8 serving as a driving member is provided at the back end of the FL box 380. The cam engaging portion 385 is configured to form a recess shape which is open upward in a side view when seen from the back. In addition, a cam surface including two curved portions 384*a* and 384*b* in the circumference of the FL cam 384, and two parallel plane portions 384*c* which connect between the two curved portions 384*a* and 384*b* is engaged with the bottom surface of the cam engaging portion 385.

In addition, the curved portion 384*a* which is further distant from the rotation center of the FL cam 384 (that is, the eighth rotation shaft J8) among the two curved portions 384*a* and 384*b* in the cam surface becomes small as the rotation center of the FL cam 384 becomes close to the portion connected to the plane portion 384*c*. On the other hand, the curved portion 384*b* which is closer to the rotation center of the FL cam 384 (that is, the eighth rotation shaft J8) among the two curved portions 384*a* and 384*b* in the cam surface becomes large as the rotation center of the FL cam 384 becomes close to the portion connected to the plane portion 384*c*. In addition, a coil spring 386 which biases the FL box 380 upward is fixed to the lower outside of the FL box 380. In addition, the coil spring 386 biases the FL box 380 upward such that the bottom surface of the cam engaging portion 385 of the FL box 380 is always in close contact with the cam surface of the FL cam 384.

Figure 25:
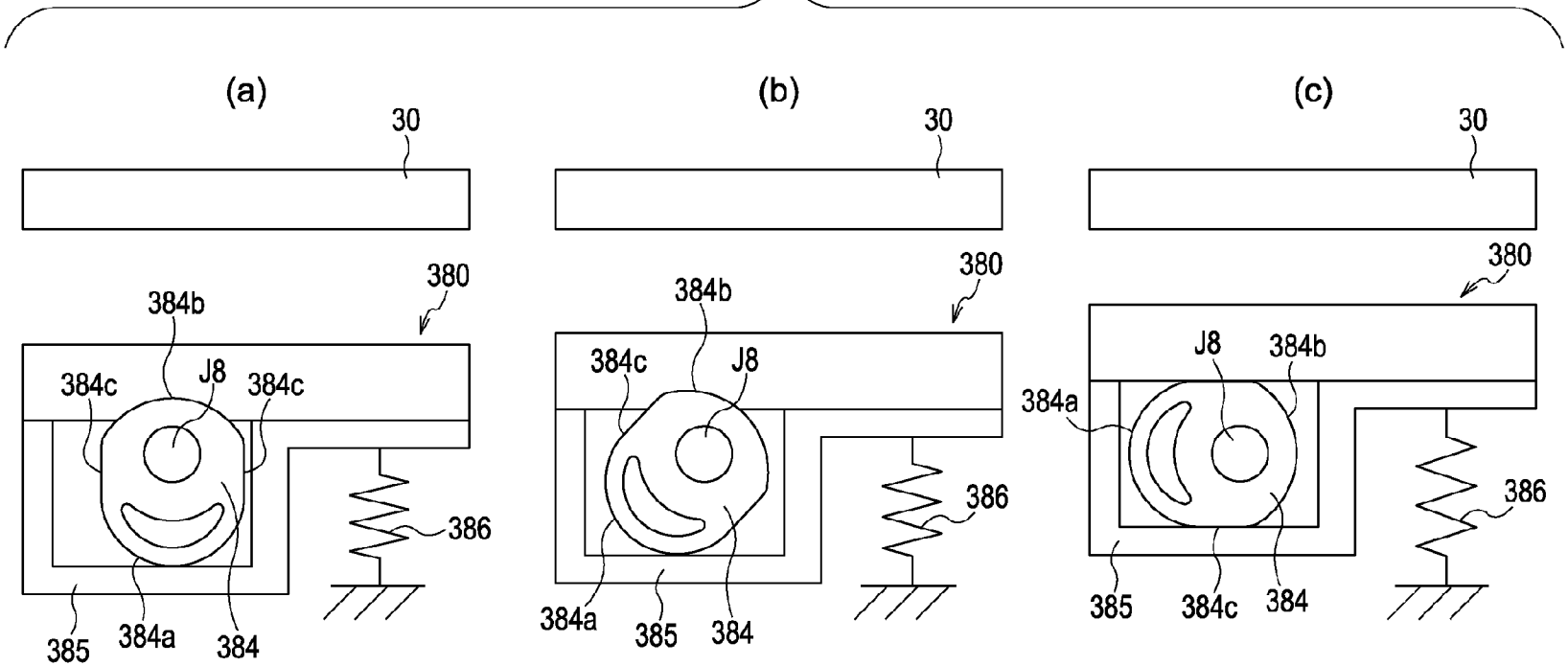
FIG. 25(*a*) to (*c*) are diagrams illustrating the operation of the cam mechanism which lifts and lowers the FL box.

Next, the lifting and lowering mechanism (displacing mechanism) of the FL box 380 which is performed by the FL cam 384 will be described with reference to FIG. 25. FIG. 25 schematically illustrates FIG. 24 for convenience of describing the lifting and lowering mechanism of the FL box 380. In addition, in the present embodiment, as shown in FIG. 22, the FL box 380 is at the highest position, that is, the highest position in the up-down direction is the reference position.

FIG. 25(*a*) illustrates a state where the FL cam 384 presses down the FL box 380 to the lowest position, that is, the curved portion 384*a* which is further distant from the rotation center of the cam surface of the FL cam 384 (the eighth rotation shaft J8) is in contact with the bottom surface of the cam engaging portion 385 of the FL box 380, that is, the lowest state in the up-down direction. In the present embodiment, in the operation of the maintenance device 100 which will be described later, the height of the FL box 380 is adjusted at the time of the ink ejection check by lifting from the lowest position.

From this state, when the FL cam 384 performs the CW rotation clockwise as shown in FIG. 25(*a*), the cam diameter of a cam surface, which is in contact with the bottom surface of the cam engaging portion 385 of the FL box 380, in the FL cam 384 (that is, the distance from the eighth rotation shaft J8 serving as the rotation center) gradually becomes small as shown in FIG. 25(*b*). Therefore, the FL box 380 gradually lifts while maintaining the contact with cam engaging portion 385 on the basis of the biasing force from the coil spring 386.

In the present embodiment, a parallel movement mechanism which can move such that the FL box 380 is not inclined toward the lower surface of the liquid ejecting head 30 during lifting is provided. As a result, the electrode member 381 inside the FL box 380 can always vertically move in a state of being parallel to the lower surface of the liquid ejecting head 30.

In the present embodiment, as shown in FIGS. 23 and 24, a link mechanism which includes four link rods 387 having the same length is used as a parallel movement mechanism. That is, one end of each of the link rods 387 is fixed to an end of a first rotation shaft body 388 which is axially supported in the lower side of the FL box 380 so as to rotate, and the other end is fixed to an end of a second rotation shaft body 389 which is axially supported in the frame structure 90 (not shown) so as to rotate. In addition, the two first rotation shaft bodies 388, which are separated by a predetermined distance in the front-back direction in parallel, are provided in the lower side of the FL box 380. The two second rotation shaft bodies 389, which are separated by the same predetermined distance as that of the first rotation shaft body 388 in the front-back direction in parallel, are provided in the frame structure 90.

Therefore, the four link rods 387 rotate (swing) about the second rotation shaft bodies 389 serving as the rotation center which are axially supported in the frame structure 90 while maintaining the parallel state. As a result, the four first rotation shaft bodies 388 which are respectively fixed to ends of the four link rods 387 rotate while maintaining the same position in the up-down direction and vertically move the FL box 380 which is axially supported while maintaining the parallel state. In this way, the parallel movement mechanism according to the present embodiment has a so-called pantograph structure in which the distance between connected rotation shaft bodies does not change and has a configuration in which the FL box 380 can vertically move in the state of not being inclined.

Meanwhile, the FL cam 384 according to the present embodiment is formed such that the almost straight plane portions 384*c* extend parallel to each other from both ends of the curved portion 384*a* and 384*b* in the outer circumference as the cam surface. In addition, when the FL cam 384 performs the CW rotation by approximately 90 degrees, the straight plane portion 384*c* in the cam surface of the FL cam 384 is engaged with the cam engaging portion 385 of the FL box 380 shown in FIG. 24 before and after the state shown in FIG. 25(*c*). Therefore, in the cam surface of the FL cam 384, since the cam diameters of the curved portions 384*a* and 384*b* which are portions other than the straight plane portions 384*c* are changed to vary depending on the rotation degree of the FL cam 384, the lifting ratio of the FL box 380 relative to the rotation of the FL cam 384 is changed.

Thereafter, from this state, when the FL cam 384 performs the CW rotation clockwise, the cam diameter of a cam surface, which is in contact with the cam engaging portion 385 of the FL box 380, of the FL cam 384 gradually becomes small as shown in FIG. 25(*c*). Therefore, as shown in FIG. 24, the FL box 380 lifts to the highest position (reference position) where the curved portion 384*b* which is closer to the rotation center of the cam surface of the FL cam 384 (the eighth rotation shaft J8) is in contact with the bottom surface of the cam engaging portion 385 of the FL box 380 while maintaining the contact with cam engaging portion 385 on the basis of the biasing force from the coil spring 386.

In addition, in the present embodiment, the FL box 380 is configured such that the positions thereof during lifting from the lowest position to the highest position (for example, position shown in FIG. 25(*c*)) are the most optimum position when the electrode member 381 of the FL box 380 performs the ink ejection check of the liquid ejecting head 30.

Figure 26:
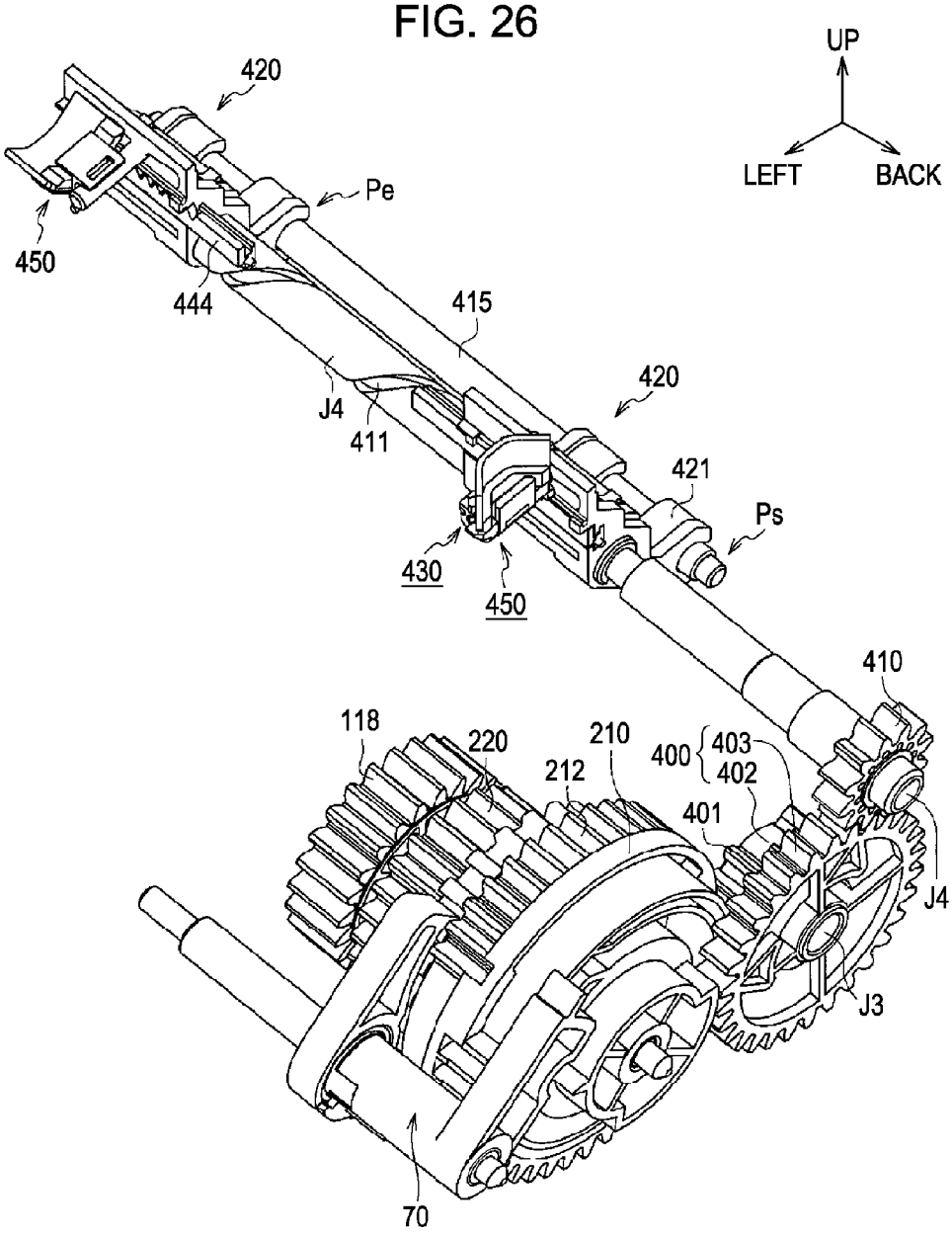
FIG. 26 is a perspective view illustrating the driving system of a wiping member which is driven by the fourth gear.

(Drive System of Wiping Member) Next, as shown in FIG. 26, the wiping member 450 according to the present embodiment includes a drive system in which the wiping member 450 moves in the front direction due to the rotation of the fourth gear 400. That is, the fourth gear 400 which meshes with the second tooth-missing gear 212 is rotated by the rotation of the first gear 210. The fourth gear 400 includes two gears including a small-diameter spur gear 402 having a small pitch diameter which meshes with the second tooth-missing gear 212 and a large-diameter spur gear 403 having a large pitch diameter and is axially supported by the third rotation shaft J3 so as to rotate. In addition, the large-diameter spur gear 403 transmits the rotation of the first gear 210 to a wiping gear 410 which is fixed to the fourth rotation shaft J4.

The fourth rotation shaft J4 is provided with a wiper unit 420 which moves along the axial direction due to the rotation of the shaft and to which the fourth rotation shaft J4 is inserted. In addition, the wiper unit 420 includes the wiping member 450, moves in the front-back direction by the fourth rotation shaft J4 rotating due to the rotation of the wiping gear 410, and moves the wiping member 450 in the front-back direction. Hereinafter, the configuration of this drive system will be described in detail.

The fourth gear 400 includes the small-diameter spur gear 402 which meshes with the second tooth-missing gear 212 of the first gear 210 and the large-diameter spur gear 403 which meshes with the wiping gear 410. Among these, the small-diameter spur gear 402 includes, as described above, the four long teeth 401 which are long in the axial direction and mesh with the second tooth-missing gear 212 in synchronization. The rotation of the small-diameter spur gear 402 is restricted by the long teeth. That is, the rotation angle of the fourth gear 400 is limited. That is, the rotation angle of the fourth rotation shaft J4 which is rotated by the wiping gear 410 meshing with the large-diameter spur gear 403 of the fourth gear 400 is also limited.

A base portion 421, which axially moves in the front-back direction due to the rotation of the fourth rotation shaft J4 where a spiral concave portion 411 is formed, is provided in the outer circumference of the wiper unit 420. A part of the base portion 421 slides along a wiper unit guide shaft 415 which is disposed substantially parallel to the fourth rotation shaft J4. Therefore, the base portion 421 moves in the front-back direction with the rotation about the fourth rotation shaft J4 restricted. In addition, the wiper unit 420 includes the wiping member 450 which includes the wiper blade 451 for wiping unnecessary ink attached to the ink ejecting head 30. Here, the wiper blade 451 is made of rubber or resin material which is elastically deformable and, even if deformed, returns to almost the original shape when released from the deformed state.

As shown in FIG. 26, the wiper unit 420 reciprocates from a movement start position Ps in the back to a movement end position Pe in the front in response to the rotation angle of the fourth rotation shaft J4. In addition, the wiper blade 451 rises in the up-down direction in a state the wiper unit 420 is in the movement start position Ps. In addition, in a state the wiper unit 420 is in the movement end position Pe, the wiper blade 451 falls forward due to a sliding member 444 which slides from forward to backward in the base portion 421.

Here, the configuration of the wiper unit 420 will be described with reference to FIGS. 27 and 28. As shown in the upper section of FIG. 27, the wiper unit 420 includes the base portion 421, the sliding member 444, a holding member 430, the wiping member 450, and an elastic rod body 446. Among these, the sliding member 444, the holding member 430, and the elastic rod body 446 are attached into an attaching surface 422 which has a main surface in a direction substantially perpendicular to the left-right direction in which the base portion 421 is provided. The wiping member 450 is attached to the holding member 430.

The sliding member 444 has a substantially rectangular shape. A rack having a predetermined number of teeth is formed in a substantially central upper end in the longitudinal direction of the sliding member 444. The sliding member 444 is housed in the base portion 421 so as to move in the front-back direction. In addition, an attaching shaft portion 425 which protrudes from the attaching surface 422 and rises is formed in the base portion 421. In the holding member 430, a substantially fan-shaped portion 431, in which a pinion meshing with the rack of the sliding member 444 is formed at the tip end, and a shaft-shaped portion 432, in which an attaching shaft hole 435 which has a longitudinal direction in the left-right direction at the base end corresponding to the main part of the fan and which penetrates in the left-right direction are integrally formed. The holding member 430 is attached to the base portion 421 in a state where the pinion and the rack mesh with each other by engaging the attaching shaft hole 435 with the attaching shaft portion 425 of the base portion 421.

In addition, after the holding member 430 is attached to the base portion 421, the elastic rod body 446 is attached to locking portions 423 and 424 which are provided in the base portion 421. Since the elastic rod body 446 is attached, the holding member 430 is suppressed from moving in the left direction and escaping. In addition, when the holding member 430 rotates about the attaching shaft hole 435 by about 90 degrees, two protrusions 433 which are provided in the shaft-shaped portion 432 in the up-down direction are biased by engaging the elastic rod body 446 with the protrusions 433. Accordingly, the postures of the holding member 430 before and after the rotation can be stabilized.

In addition, in the shaft-shaped portion 432 of this holding member 430, among the front and the back serving as the wiping direction, a concave strip portion 436 which is open forward is formed in the front and a convex strip portion 437 expanding backward is formed in the back. In addition, a shaft-shaped convex portion 456 which is provided in the wiping member 450 is inserted into the concave strip portion 436 from the front so as to be engaged. Therefore, the shaft-shaped convex portion 456 functions as a rotation shaft portion and the concave strip portion 436 functions as a bearing portion of the shaft-shaped convex portion 456.

Thereafter, when the wiping member 450 performs the CW rotation about the shaft-shaped convex portion 456 when seen from the back, that is, from the left direction, a rectangular opening hole 457 which is in a lower end of a knob-shaped portion 452 provided in the back of the wiping member 450 is engaged with the convex strip portion 437. In this way, the wiping member 450 is attached to the holding member 430 by the engagement between the opening hole 457 as an engaging portion which is provided in the wiping member 450 and the convex strip portion 437 as an engaged portion which is provided in the holding member 430 as a moving member. In this way, the wiping member 450 is attached by the engagement between the convex strip portion 437 and the opening hole 457 due to the CW rotation when seen from the left direction.

Therefore, when the wiper blade 451 wipes ink, a CW rotation force about the shaft-shaped convex portion 456 is applied to the wiping member 450. Accordingly, a force is not applied in directions releasing both the engagement between the concave strip portion 436 and the shaft-shaped convex portion 456 and the engagement between the convex strip portion 437 and the opening hole 457. Originally, the wiping member 450 is attached in a state where the CCW rotation about the shaft-shaped convex portion 456 is restricted by the engagement between the convex strip portion 437 and the opening hole 457.

Therefore, in other words, when the engagement between the convex strip portion 437 and the opening hole 457 is released and the wiping member 450 performs the CCW rotation reverse to the CW rotation, the wiping member 450 can be removed from the holding member 430. That is, in the wiping member 450 of the present embodiment, when an operator picks an upper end portion of the knob-shaped portion 452 shown in FIG. 28(*a*), the upper end of the knob-shaped portion 452 is bent in the front direction and the lower end of the knob-shaped portion 452 is displaced in the back direction. In addition, due to this displacement, the engagement between the opening hole 457 and the convex strip portion 437 of the holding member 430 is released to perform the CCW rotation. In this way, a portion of the upper end of the knob-shaped portion 452 is a releasing portion which releases the attached state of the wiping member.

Figure 28:
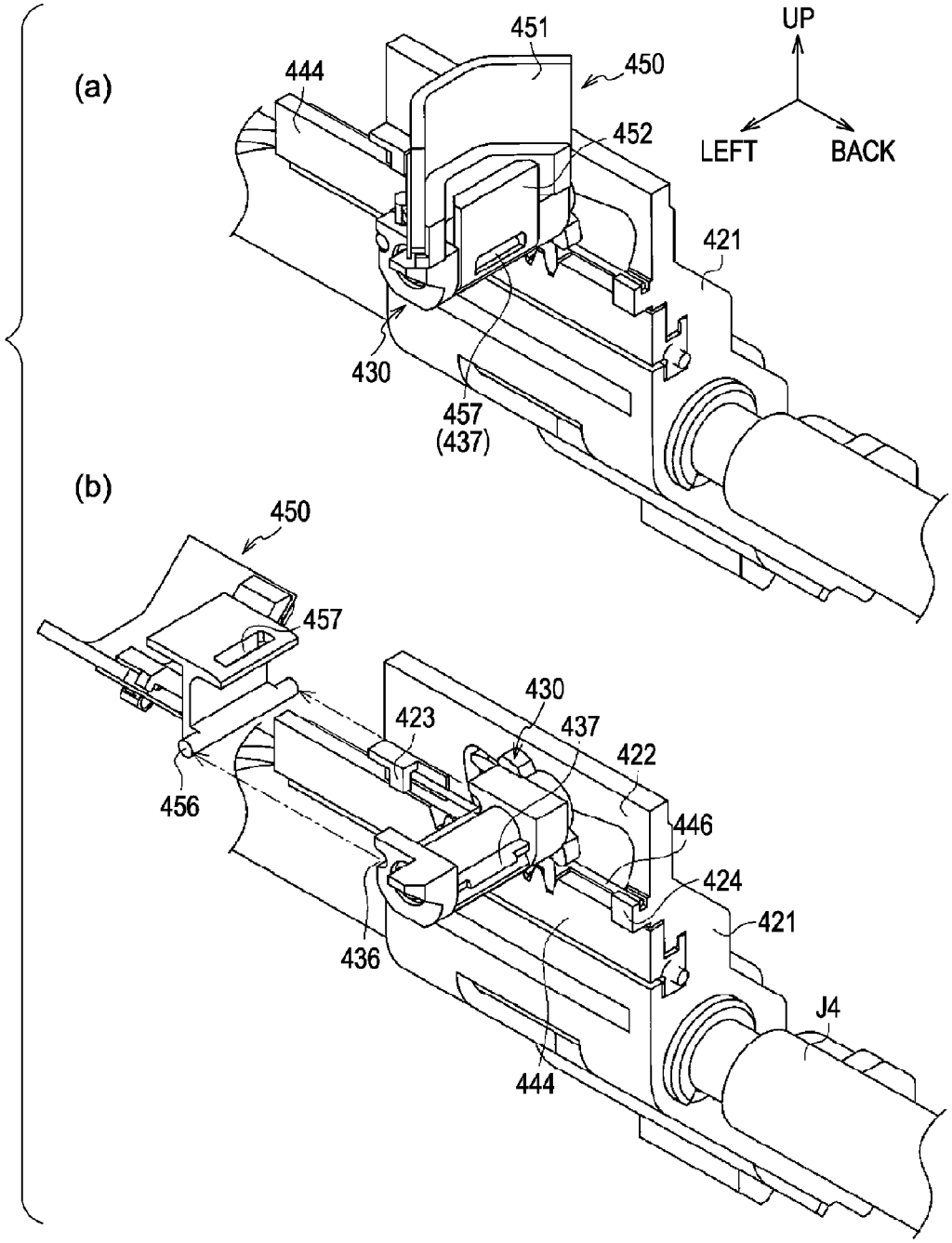
FIG. 28 is a perspective view illustrating an attachable and detachable structure of a wiping member in which (a) is an attached state and (b) is a detached state.

Therefore, when the operator performs the CCW rotation while picking the portion of the upper end of the knob-shaped portion 452, that is, the releasing portion, it is possible to pull out the shaft-shaped concave portion 456 of the wiping member 450 from the concave strip portion 436 as shown in FIG. 28(*b*). In this way, the wiping member 450 can be removed from the holding member 430.

Figure 27:
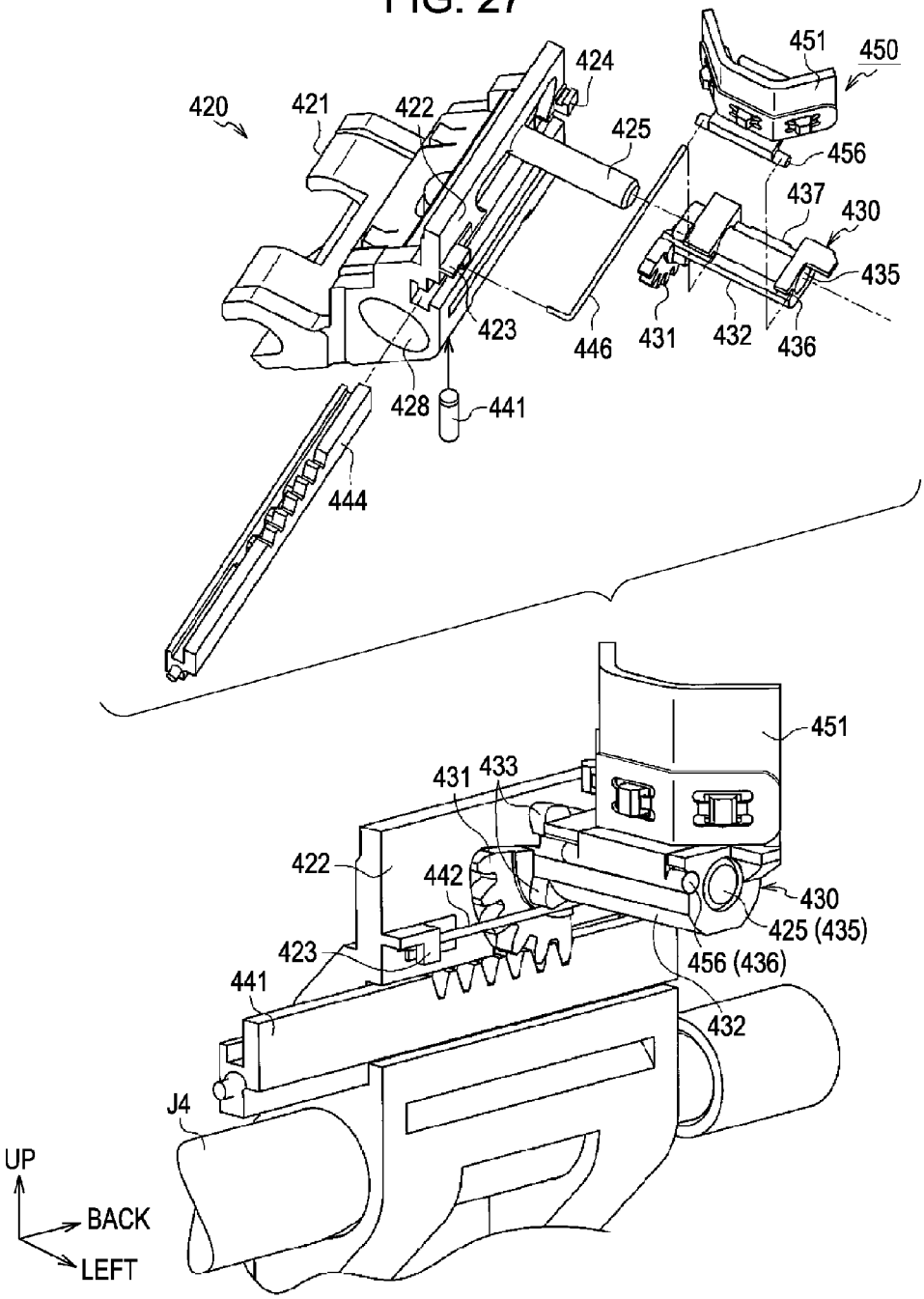
FIG. 27 is a perspective view illustrating components constituting the wiping member.

As shown in FIG. 27, a guide hole 428 through which the fourth rotation shaft J4 penetrates is formed in the base portion 421. An engaging pin 441 is inserted from below so as to protrude from the upper end of the guide hole 428 in the hole center direction by a predetermined amount. When the engaging pin 441 is engaged with the spiral concave portion 411 formed in the fourth rotation shaft J4, the base portion 421, that is, the wiper unit 420 reciprocates in the front-back direction along the fourth rotation shaft J4.

Figure 29:
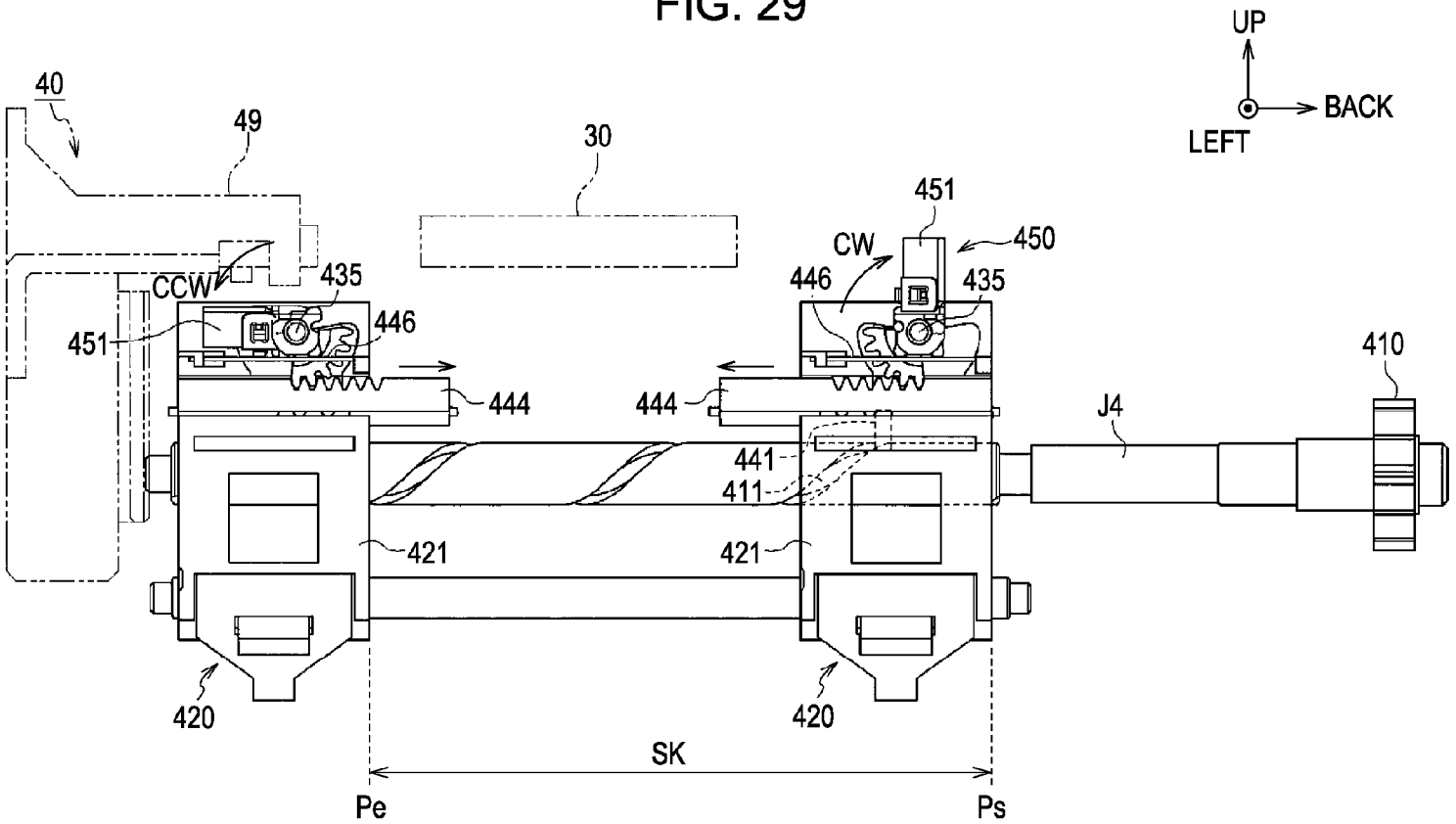
FIG. 29 is a side view illustrating the movement state of the wiping member in the front-back direction.

Next, the mechanism of the reciprocation of the wiper unit 420 will be described with reference to FIG. 29. FIG. 29 is a side view illustrating the wiper unit 420 which reciprocates when seen from the left direction. As shown in FIG. 29, in a so-called screw cam mechanism in which the spiral concave portion 411 which is formed in a spiral shape on the surface of the fourth rotation shaft J4 is engaged with the engaging pin 441 which is inserted into the base portion 421 of the wiper unit 420, the wiper unit 420 moves forward and backward along the fourth rotation shaft J4. At this time, as described above, since the rotation angle of the fourth rotation shaft J4 is limited to a predetermined angle, the wiper unit 420 moves along the fourth rotation shaft J4 in a stroke SK which is limited between the movement start position Ps in the back and the movement end position Pe in the front as shown in the drawing.

First, when the wiper unit 420 is at the movement start position Ps, the back of the sliding member 444 are in contact with the frame structure 90 (not shown) and the sliding member 444 slides in the front direction in the base portion 421. In this state, the wiper blade 451 of the wiping member 450 rises in the up-down direction.

In addition, the wiper unit 420 moves forward due to a predetermined angle of rotation of the fourth rotation shaft J4 and is at the movement end position Pe, the front of the sliding member 444 are in contact with the frame structure 90 (not shown) and the sliding member 444 slides in the back direction in the base portion 421. Then, since the rack formed in the sliding member 444 moves in the back direction, the pinion meshing with the rack performs the CCW rotation when seen from the left direction by about 90 degrees. As a result, when the holding member 430 performs the CCW rotation about the attaching shaft hole 435 of the shaft-shaped portion 432 and performs the CCW rotation of the held wiping member 450, the wiper blade 451 falls forward by about 90 degrees and is in the lying state. Originally, as described above, this state is stably maintained by the elastic rod body 446.

In addition, when the fourth rotation shaft J4 reversely rotates by a predetermined angle, the wiper unit 420 moves backward from the movement end position Pe in the front and returns to the movement start position Ps. Due to the return of the wiper unit 420, the sliding member 444 moves in a state of being slid in the back direction of the base portion 421. In addition, when reaching the movement start position Ps, the rack formed in the sliding member 444 is in contact with the frame structure 90 and moves in the front direction. Therefore, the pinion meshing with the rack performs the CW rotation when seen from the left direction by about 90 degrees. As a result, when the holding member 430 performs the CW rotation about the attaching shaft hole 435 of the shaft-shaped portion 432 and performs the CW rotation of the held wiping member 450, the wiper blade 451 rises from the lying state and returns to a state for wiping the liquid ejecting head 30. Originally, as described above, this rising state is stably maintained by the elastic rod body 446.

Due to the reciprocation of the wiper unit 420, the wiping member 450 can wipe the head units of the liquid ejecting head 30 one by one. That is, as shown in FIG. 29, at the time of forward movement moving from the back to the front, the wiper blade 451 is engaged with the liquid ejecting head 30 in the up-down direction by moving to the movement end position Pe in the rising state. In this way, unnecessary ink of the liquid ejecting head 30 can be wiped. On the other hand, at the time of backward movement moving from the front to the back, the wiper blade 451 moves in the lying state of not being engaged with the liquid ejecting head 30 in the up-down direction. In this way, the wiper blade 451 is not in contact with and does not contaminate the liquid ejecting head 30 which has been already wiped for maintenance, and the wiper unit 420 can return to the movement start position Ps.

Furthermore, in the maintenance device 100, as shown in FIG. 29, the ink absorption body 40 receiving and absorbing ink which is wiped and acquired by the wiper blade 451 is disposed on the movement end position Pe side of the wiper unit 420. The ink absorption body 40 is configured in which plural ink absorption materials (for example, a member made of porous resin, pulp, or the like) are incorporated into an absorption body case 49.

Figure 30:
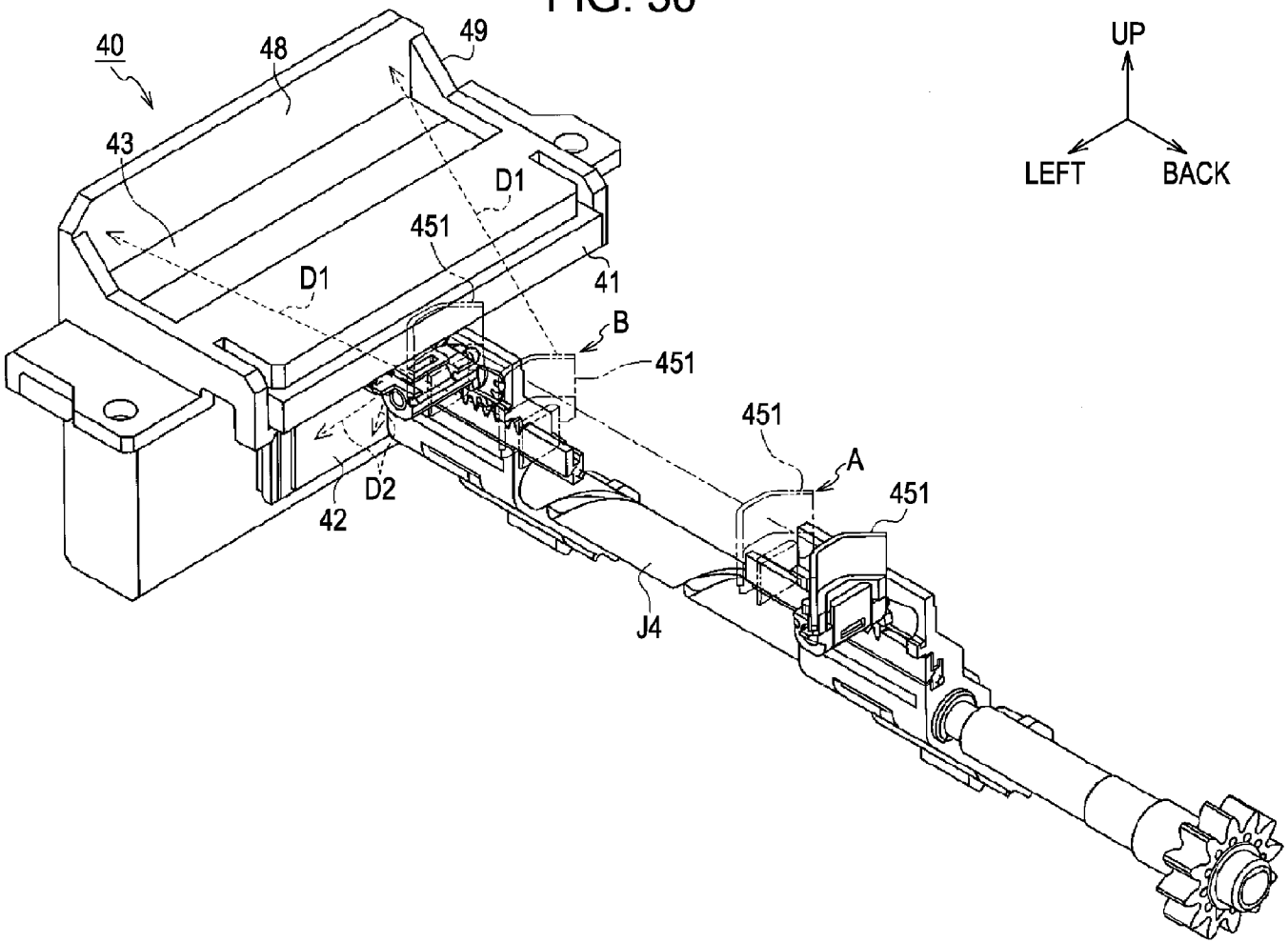
FIG. 30 is a perspective view illustrating the configuration of an ink absorption body.

The specific configuration of the ink absorption body 40 will be described with reference to FIG. 30. As shown in FIG. 30, above the absorption body case 49 of the ink absorption body 40, a wall 48 which receives ink scattered from the wiper blade 451 when the wiper blade is separated from the liquid ejecting head 30 is provided. That is, the wiper blade 451 raised from the position indicated by the arrow A in the drawing is elastically deformed and starts wiping the liquid ejecting head 30 while falling. When being separated from the liquid ejecting head 30 at the position indicated by the arrow B in the drawing, the wiper blade 451 returns to the rising state from falling backward. At this time, when the wiper blade 451 rapidly returns, there is a case where ink acquired by the wiper blade 451 is scattered widely in the left-right direction as indicated by the arrow D1 in the drawing. Therefore, the wall 48 has a width in the left-right direction wider than the width of the wiper blade 451 in the left-right direction in order to receive the scattered ink. In addition, below the wall 48, a third absorption material 43 absorbing ink which lowers along the wall 48 is incorporated into the main case while exposing one end thereof upward.

In addition, a first absorption material 41, which comes into contact with the wiper blade 451 moving forward after being separated from the liquid ejecting head 30 and which directly wipes and absorbs ink acquired by the wiper blade 451, is incorporated into the absorption body case 49 while exposing one end thereof backward as an ink absorption surface.

In addition, in the ink absorption body 40, the exposed end of the first absorption material 41 is positioned and disposed such that the wiper blade 451 comes into contact with the absorption surface of the first absorption material 41 as shown in FIG. 30 in the moving process of the wiper blade 451 from the rising state to the lying state. Therefore, similar to the case when being separated from the liquid ejecting head 30, the wiper blade 451 falls forward below the first absorption material 41 when being separated from the first absorption material 41. For that reason, as indicated by the broken line arrow D2 in the drawing, there is a case where ink is scattered from the wiper blade 451 in the lower forward direction. Therefore, in order to receive and absorb the scattered ink, a second absorption material 42 which has an exposed surface 45 facing backward in a lower section than the exposed end of the first absorption material 41 as an ink absorption surface, is incorporated into the absorption body case 49.

The width of the exposed surface 45 of the second absorption material 42 in the left-right direction is narrower than that of the wall 48 which is provided in the absorption body case 49 in the left-right direction since the distance from the wiper blade 451 is short. In addition, in the present embodiment, the tip end of the fourth rotation shaft J4 is in contact with the exposed surface 45 of the second absorption material 42. In this way, when the scattered ink is attached to the fourth rotation shaft J4, the attached ink can be absorbed from the tip end of the fourth rotation shaft J4.

The second absorption material 42 according to the present embodiment is formed such that ink absorbed in the first absorption material 41 is moved to the third absorption material 43. Further, in order to easily move ink absorbed in the second absorption material 42 to the third absorption material 43, a fourth absorption material 44 connecting between the absorption materials is provided. Each of the ink absorption materials including the fourth absorption material 44 will be described with reference to FIG. 31.

Figure 31:
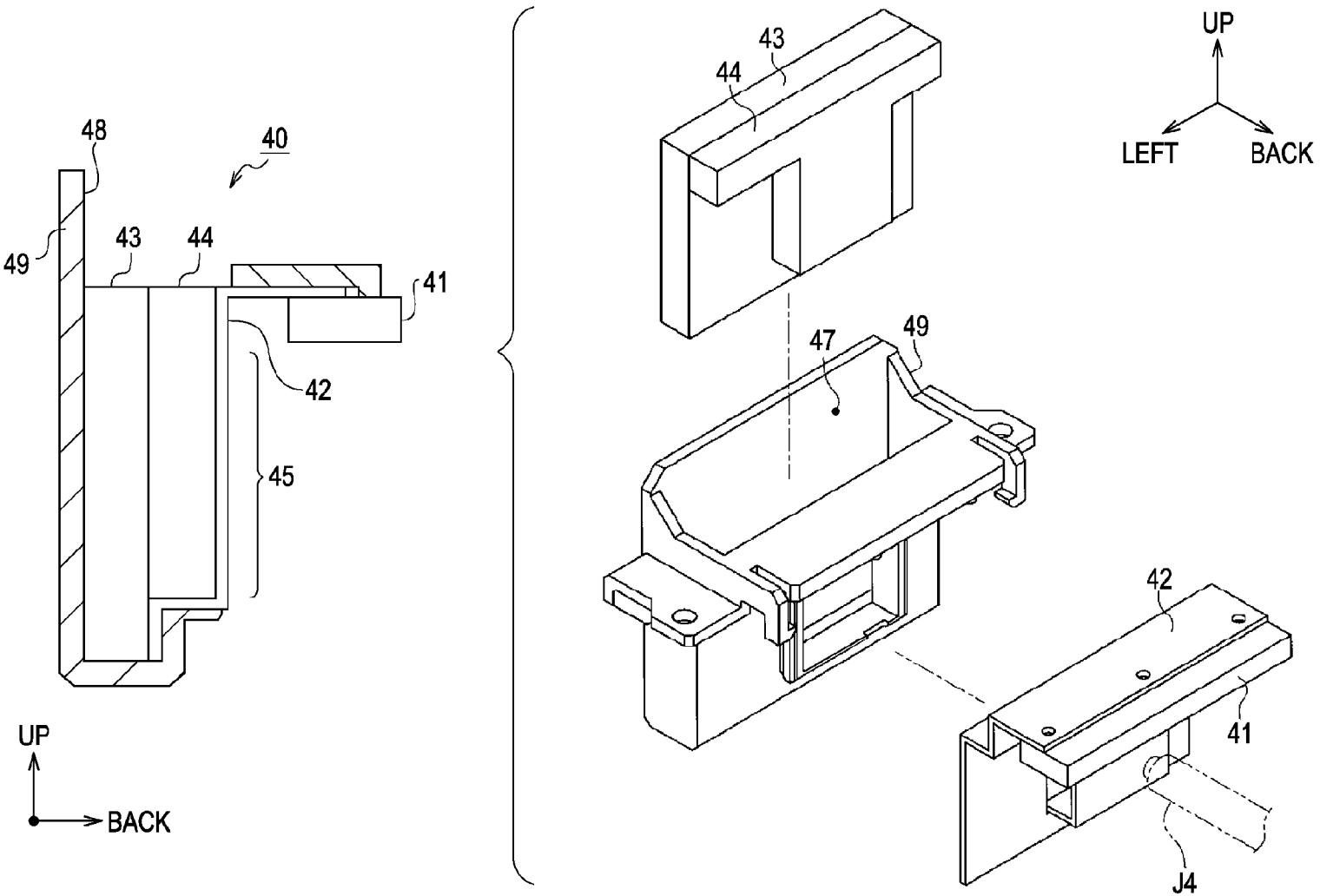
FIG. 31 is a perspective view illustrating the configuration of an ink absorption member housed in the ink absorption body.

As shown in FIG. 31, the third absorption material 43 has a substantially rectangular shape. The fourth absorption material 44 has a substantially T-shape in which the upper side has almost the same width as that of the third absorption material 43 in the left-right direction and the lower side has a narrower width than that in the upper side. The lower side portion having the narrow width corresponds to the exposed surface 45 described above.

The first absorption material 41 has a rectangular shape having almost the same width as that of the third absorption material 43. The second absorption material 42 has a substantially thin plate shape, and one end thereof is in contact with and fixed to the upper front side of the first absorption material 41 so as to be connected to each other and to move ink. In addition, the second absorption material 42 has bent portions having different step shapes. In addition, an area corresponding to the exposed surface 45 is provided in the step-shaped bent portions. The area corresponding to the exposed surface 45 is exposed backward in the ink absorption body 40.

The first absorption material 41, the second absorption material 42, the third absorption material 43, and the fourth absorption material 44 which are connected in this way are attached to a housing space 47 provided in the absorption body case 49 as shown in the right section of the drawing.

Specifically, from an attaching space (not shown) for attaching the first absorption material 41 which is on the back side of the ink absorption body 40 in the housing space 47, first, an end opposite to a side of the first absorption material 41 which is connecting to the second absorption material 42 is inserted to the housing space 47. Thereafter, by positioning and inserting the first absorption material 41 into the attaching space, the second absorption material 42 and the first absorption material 41 are attached to the housing space 47 of the absorption body case 49. Thereafter, the third absorption material 43 and the fourth absorption material 44 are inserted and attached into the housing space 47 from the upper side of the absorption body case 49. At this time, the inserted third absorption material 43 is in contact with the second absorption material 42 which is attached to the housing space 47 in the front-back direction. In addition, the inserted fourth absorption material 44 is in contact with the third absorption material 43 in the front-back direction and is in contact with the second absorption material 42 in the front-back direction in the area of the expose surface 45. Therefore, as shown in the cross-sectional view on the left side of FIG. 31, the ink absorption body 40 can move ink between the ink absorption materials in a state where all the absorption materials including the first absorption material 41 to fourth absorption material 44 are attached. For example, ink absorbed in the first absorption material 41 can be moved to another absorption material (for example, third absorption material 43).

Figure 32:
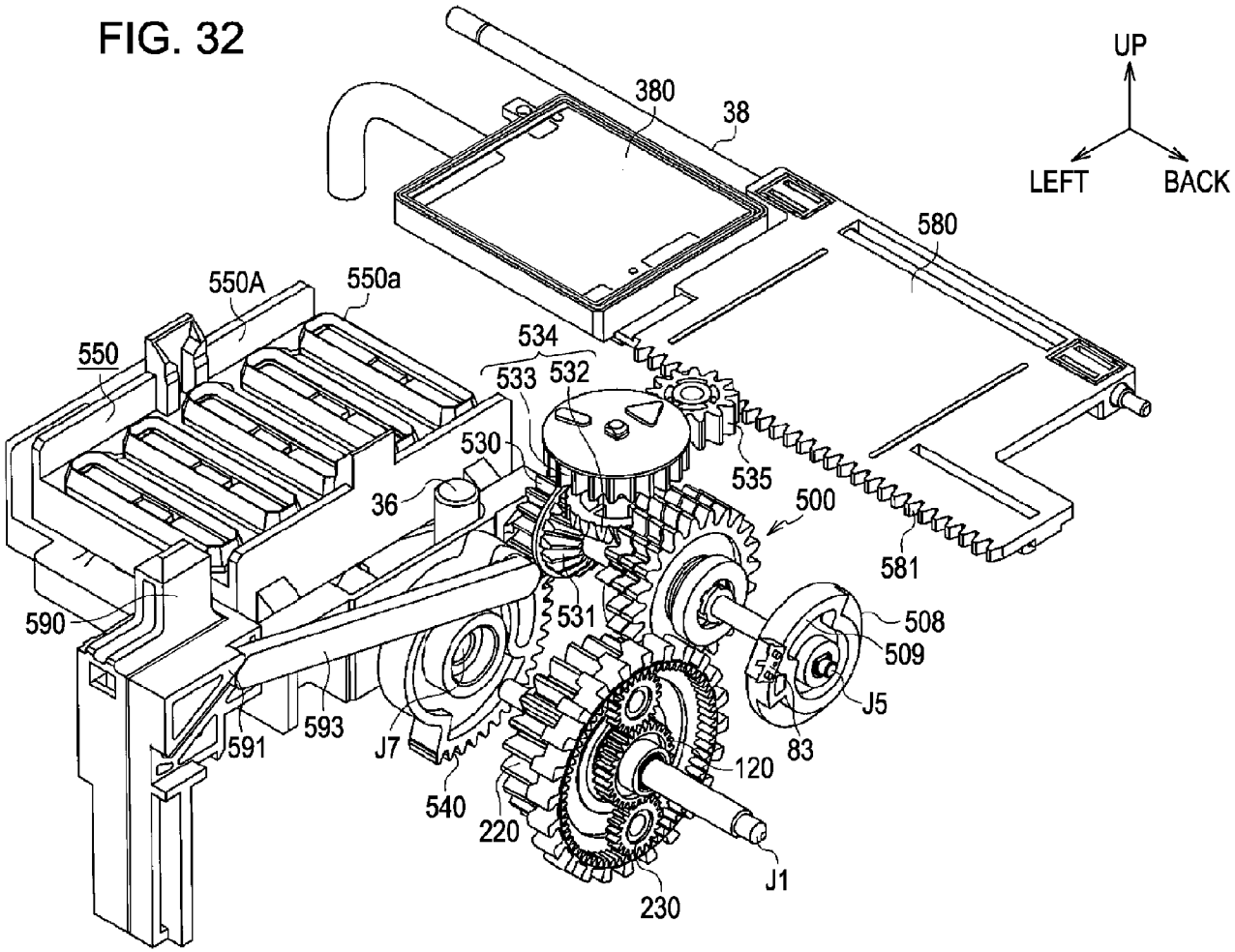
FIG. 32 is a perspective view illustrating the driving system of a leaving cap, a carriage lock body, and an FL box cover which are driven by the fifth gear.

(Drive System of Leaving Cap, Carriage Lock Body, and FL Box Cover) Next, as shown in FIG. 32, the maintenance device 100 according to the present embodiment includes a drive system in which the leaving cap 550 is driven in the up-down direction due to the rotation of the fifth gear 500 which meshes with the second gear 220. That is, when a fifth rotation shaft J5 rotates due to the rotation of the fifth gear 500, a fifth transmitting gear 530 which is fixed to the fifth rotation shaft J5 rotates. Then, a sixth transmitting gear 540 which meshes with the fifth transmitting gear 530 rotates. The sixth transmitting gear 540 is fixed to a seventh rotation shaft J7, and the rotation of the sixth transmitting gear 540 is transmitted to the vertical movement of the leaving cap 550 by a cam mechanism which is provided in the seventh rotation shaft J7. As a result, the leaving cap 550 vertically moves along the leaving cap guide rod 36 fixed to the frame structure 90 and moves between the contact position where the leaving cap is in contact with the liquid ejecting head 30 (not shown) and the separating position where the leaving cap is separated from the liquid ejecting head 30.

Furthermore, the drive system is configured such that the carriage lock body 590 vertically moves due to the rotation of the sixth transmitting gear 540. That is, the carriage lock body 590 is moved in the up-down direction by a cam mechanism formed between a rod member 593 which moves substantially in the left-right direction due to the rotation of the sixth transmitting gear 540 and an inclined surface 591 which is formed in the carriage lock body 590.

In addition, the drive system is configured such that the FL box cover 580 moves in the left-right direction due to the rotation of the fifth transmitting gear 530. That is, when the fifth transmitting gear 530 rotates, a seventh transmitting gear 534 rotates in which one end has a driven-side bevel gear 532 which meshes with the a driving-side bevel gear 531 formed in the fifth transmitting gear 530 and the other end has a spur gear 533. In addition, an eighth transmitting gear 535 which is a pinion meshing the spur gear 533 of the seventh transmitting gear 534 rotates. A rack 581 is formed in the front-back direction at an edge on the eighth gear transmitting gear 535 side in the FL box cover 580 so as to mesh with the eighth transmitting gear 535. Therefore, due to the rotation of the eighth transmitting gear 535, the FL box cover 580 is supported in the frame structure 90 and is guided along a cover guide shaft 38 which is provided along an edge opposite to the rack 581 so as to move in the front-back direction.

Further, in the present embodiment, the rotation angle of the fifth gear 500 which is rotated by the second gear 220 is restricted. Due to the restriction for the rotation angle of the fifth gear 500, the FL box cover 580 moves in the left-right direction by a predetermined amount, for example, moves from the back to the front by a predetermined amount to cover the top surface of the FL box 380. Originally, the movement amount of the rod member 593 in the left-right direction or the movement amount of the leaving cap 550 in the up-down direction is also restricted.

Further, in the present embodiment, in order to detect the rotation state of the fifth rotation shaft J5, a rotation detecting vehicle 508 for detecting the rotation is attached to the back end of the fifth rotation shaft J5. A detecting cam portion 509 which expands and protrudes backward so as to have a step in the radial direction is formed in the outer circumference of the rotation detecting vehicle 508. The detecting cam portion 509 is engaged with the third detecting means 83 which outputs a detection signal. The specific configuration of the detection will be described later.

Figure 33:
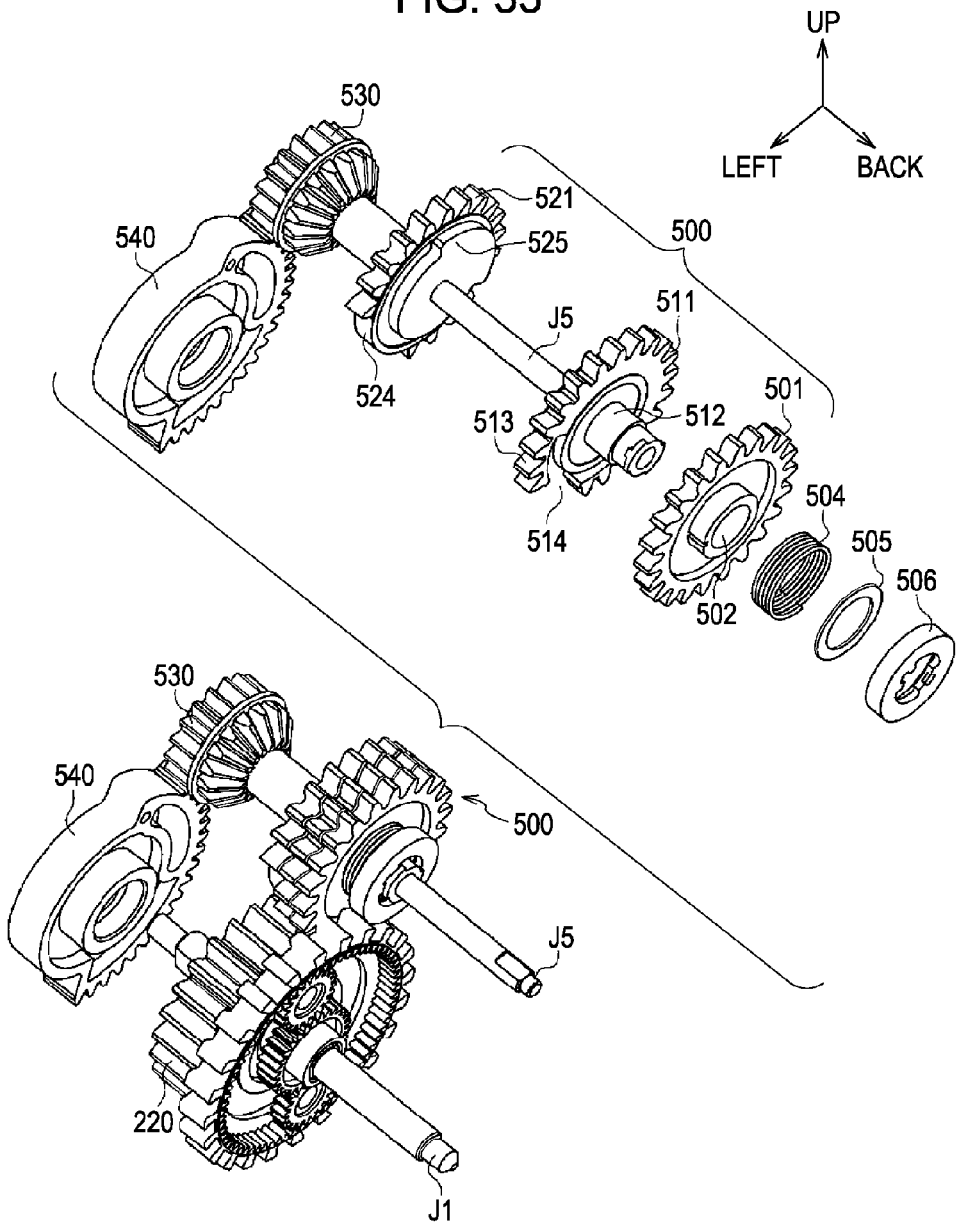
FIG. 33 is a perspective view illustrating the configuration of the fifth gear.

Next, the configuration of the fifth gear 500 will be described with reference to FIG. 33. As shown in FIG. 33, the fifth gear 500 has a configuration in which three gears having different shapes overlap each other in the front-back direction. That is, the fifth gear 500 includes the three gears including a rotation transmitting gear 501 which always meshes with the second gear 220 and transmits the rotation thereof, a driving tooth-missing gear 511 which overlaps the front of the rotation transmitting gear 501 and rotates, and a driven tooth-missing gear 521 which overlaps the front of the driving tooth-missing gear 511 and rotates.

The driving tooth-missing gear 511 includes a tooth-missing portion 514 which is partially in a tooth-missing state and a thin tooth portion 513 which has plural teeth (herein, three) formed at both ends of the tooth-missing portion and in which the center side of the fifth rotation shaft J5 is cut out. In addition, the driven tooth-missing gear 521 also has a tooth-missing portion 524 which is partially in a tooth-missing state. Further, the number of tooth-missing gears in the tooth-missing portion 524 (herein, three) is more than the number of tooth-missing gears in the tooth-missing portion 514.

The rotation transmitting gear 501 and the driving tooth-missing gear 511 can rotate about the fifth rotation shaft J5. In addition, the rotation transmitting gear 501 is biased from backward to forward and is pressed against the driving tooth-missing gear 511 by a coil spring 504 of which the movement in the back direction is restricted by a washer 505 and a fixing ring 506. The driven tooth-missing gear 521 is fixed to the fifth rotation shaft J5. In the driven tooth-missing gear 521, an outward protrusion 525 which has a protrusion shape protruding in the outer circumferential direction from the center is provided in a predetermined circumferential range. On the other hand, in the front surface of the driven tooth-missing gear 511, inward protrusions 515 (see FIG. 34) which has a predetermined-width protrusion shape protruding by a predetermined amount in the center direction from the outer circumference are formed at two positions which are substantially opposite to each other centering on the fifth rotation shaft J5. In addition, when one of the inward protrusions 515 is in contact with the outward protrusion 525 during the rotation, the driven tooth-missing gear 521 is rotated by the driving tooth-missing gear 511.

Therefore, in the fifth gear 500, when the rotation of the rotation transmitting gear 501 which always meshes with the second gear 220 is transmitted to the rotation of the driven tooth-missing gear 521, the rotation of the second gear 220 is transmitted to the rotation of the fifth rotation shaft J5. In addition, the rotation angle of the fifth gear 500 (fifth rotation shaft J5) is restricted by the tooth-missing portion formed in the driven tooth-missing gear 521 and the driving tooth-missing gear 511.

Figure 34:
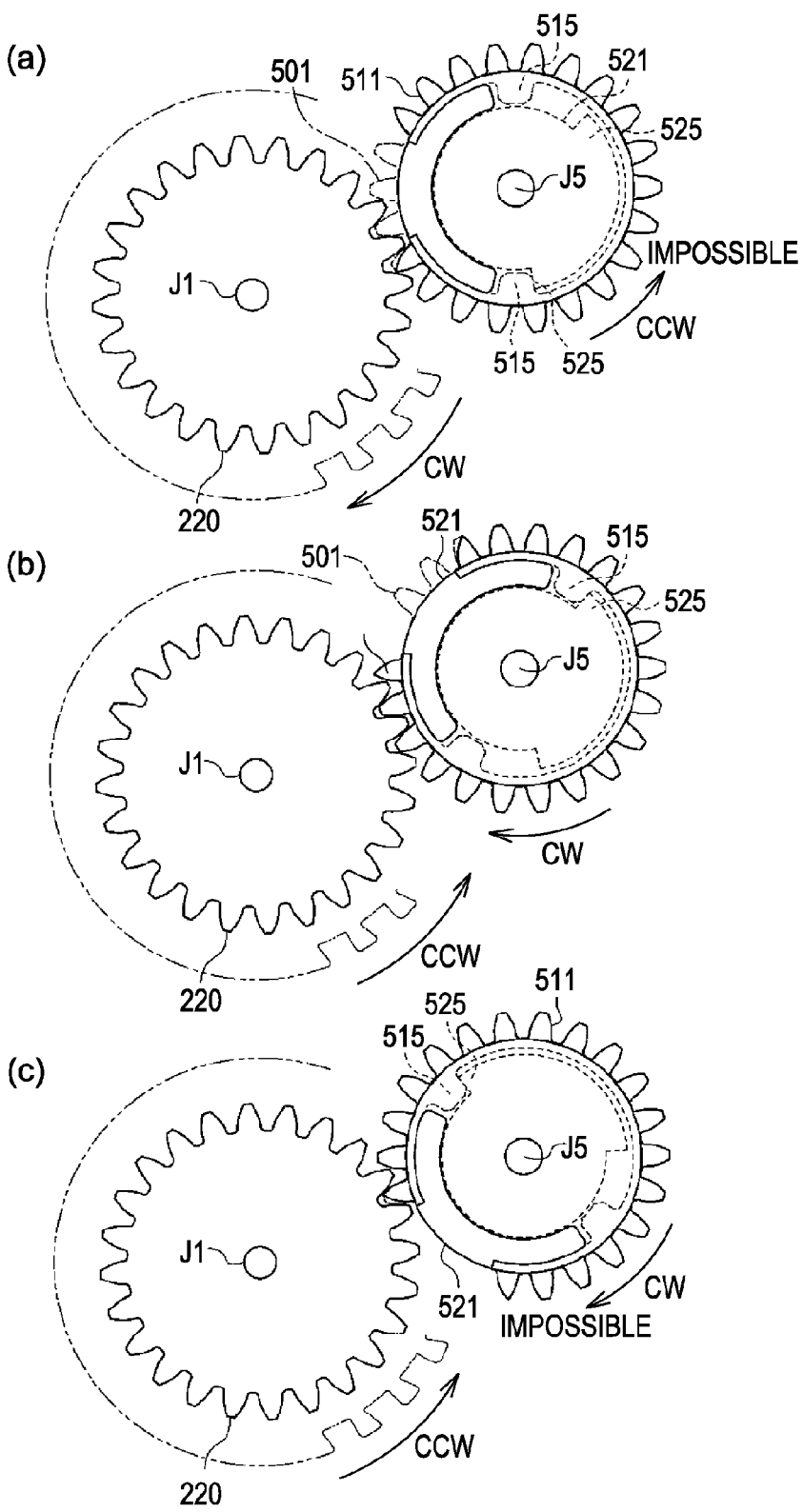
FIG. 34(*a*) to (*c*) are diagrams schematically illustrating the behavior of the rotation of the fifth gear.

Here, the mechanism of restricting the rotation angle using the three gears constituting the fifth gear 500 will be described with reference to FIG. 34. As shown in FIG. 34(*a*), when the driven tooth-missing gear 521 (driving tooth-missing gear 511) performs the CCW rotation due to the CW rotation of the second gear 220 to reach the tooth-missing position, the driven tooth-missing gear 521 is not rotated by the rotation of the second gear 220. At this time, even when the rotation transmitting gear 501 continuously performs the CCW rotation, the driving tooth-missing gear 511 cannot perform the CCW rotation and the rotation thereof stops since the rotational force (torque) which rotates the driving tooth-missing gear 511 is not transmitted. Therefore, the driven tooth-missing gear 521 does not also rotate and the fifth rotation shaft J5 is in a state where the CCW rotation is restricted.

Next, as shown in FIG. 34(*b*), when the second gear 220 is converted from the CW rotation to the CCW rotation, the rotation of the rotation transmitting gear 501 which performs the CW rotation due to the second gear 220, that is, the rotational force (torque) caused by the friction of the press contact is transmitted to the driving tooth-missing gear 511. As a result, the driving tooth-missing gear 511 performs the CW rotation, a tooth adjacent to the tooth-missing portion starts meshing with the second gear 220. In addition, when plural teeth (herein, three) are meshed from start meshing, the inward protrusion 515 of the driving tooth-missing gear 511 comes into contact with the outward protrusion 525 of the driven tooth-missing gear 521. Through this contact, the driven tooth-missing gear 521 performs the CW rotation due to the driven tooth-missing gear 511 and starts meshing with the second gear 220. Thereafter, the driven tooth-missing gear 521 continuously performs the CW rotation in synchronization with the driving tooth-missing gear 511.

In addition, when the driving tooth-missing gear 511 performs the CW rotation and starts meshing with the second gear, there is a case where the meshing timing is shifted and the interference between teeth occurs. Therefore, in the present embodiment, as described above, the thin tooth portion 513, in which the radial center side of the gear in a portion where plural teeth are formed is cut out, is formed such that the teeth are easily bent in the rotation center direction of the gear until the plural teeth (herein, three) are meshed from starting meshing in the driving tooth-missing gear 511. In addition, the description of the tooth shape is omitted, but the tip portion of an initial tooth where the mesh starts has a shape which is slightly thinner than the other teeth.

In addition, as shown in FIG. 34(*c*), the driven tooth-missing gear 521 (driving tooth-missing gear 511) performs the CW rotation due to the CCW rotation of the second gear 220 to reach the tooth-missing position, the driven tooth-missing gear 521 is not rotated by the rotation of the second gear 220. At this time, even when the rotation transmitting gear 501 continuously performs the CW rotation, the driving tooth-missing gear 511 cannot perform the CW rotation and the rotation thereof stops since the rotational force (torque) which rotates the driving tooth-missing gear 511 is not transmitted. Therefore, the driven tooth-missing gear 521 also does not rotate and the fifth rotation shaft J5 is in a state where the CW rotation is restricted. In this way, in the fifth gear 500, that is, the fifth rotation shaft J5, the CCW rotation and the CW rotation are restricted. Accordingly the rotation angle thereof is restricted.

Next, the configurations of the leaving cap 550, the carriage lock body 590, and the FL box cover 580 which are driven by the rotation of the fifth rotation shaft J5 where the rotation angle is restricted are sequentially described. First, the mechanism relating to the vertical movement of the leaving cap 550 will be described with reference to FIGS. 35 to 40.

Figure 35:
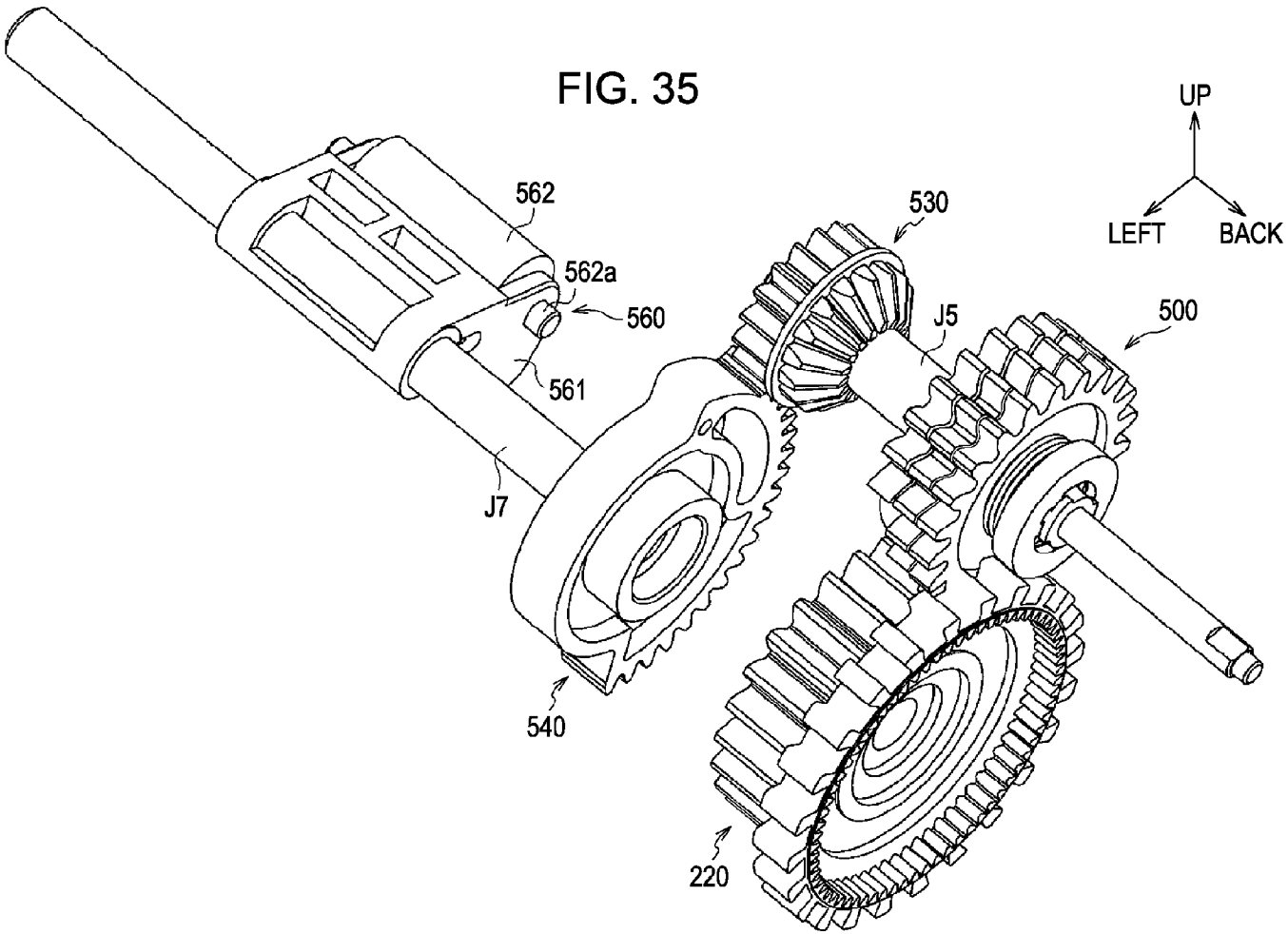
FIG. 35 is a perspective view illustrating the driving system of the cam mechanism which lifts and lowers the leaving cap.

As shown in FIG. 35, a cam mechanism 560 of the leaving cap 550 includes a cam frame 561 which has a substantially slim triangle shape in a side view and of which a base end is fixed to the intermediate section of the seventh rotation shaft J7 having one end in which the sixth transmitting gear 540 is supported. In addition, the tip end of the cam frame 561 is axially supported such that a shaft portion 562*a* of a cam roller 562 can rotate. The shaft portion 562*a* of the cam roller 562 penetrates the cam frame 561 in the front-back direction and protrudes from both of front and back surfaces of the cam frame 561 in the front-back direction. In addition, when the sixth transmitting gear 540 rotates along with the rotation of the second gear 220, the rotation of the sixth transmitting gear 540 is transmitted to the cam frame 561 through the seventh rotation shaft J7. As a result, since the cam frame 561 rotates about the seventh rotation shaft J7, the cam roller 562 which is axially supported at the tip end of the cam frame 561 performs the revolving movement about the seventh rotation shaft J7. In the present embodiment, using the cam frame 561 and the cam roller 562 of which the shaft portion 562*a* is supported in the cam frame in the cam mechanism 560, a lifting member which lifts and lowers the leaving cap 550 due to the rotation is configured. At the time, as an engaging portion with the leaving cap 550, the cam roller 562 is a first engaging portion and the shaft portion 562*a* is a second engaging portion.

Figure 36:
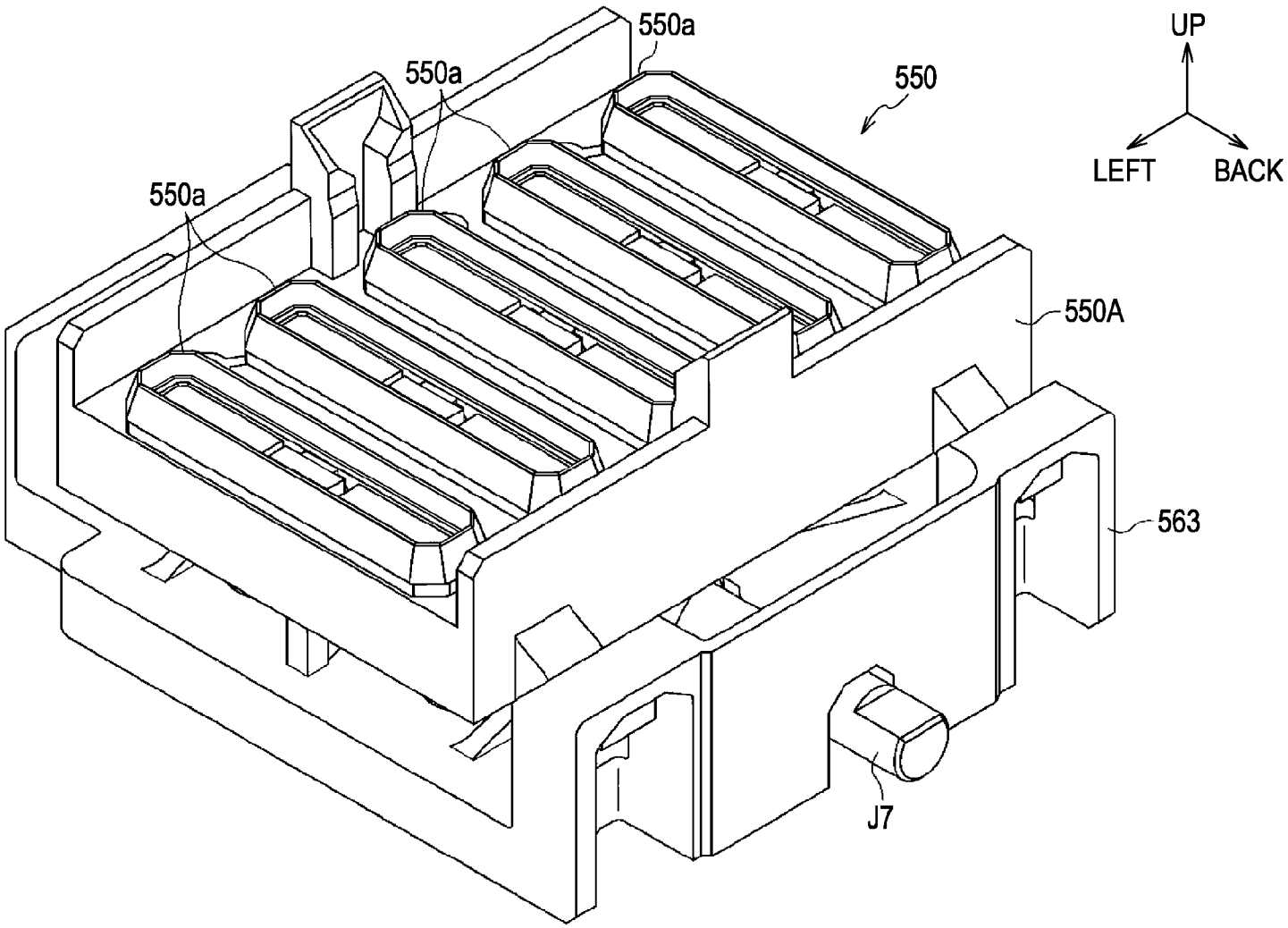
FIG. 36 is a perspective view illustrating the leaving cap when seen from oblique above.
Figure 37:
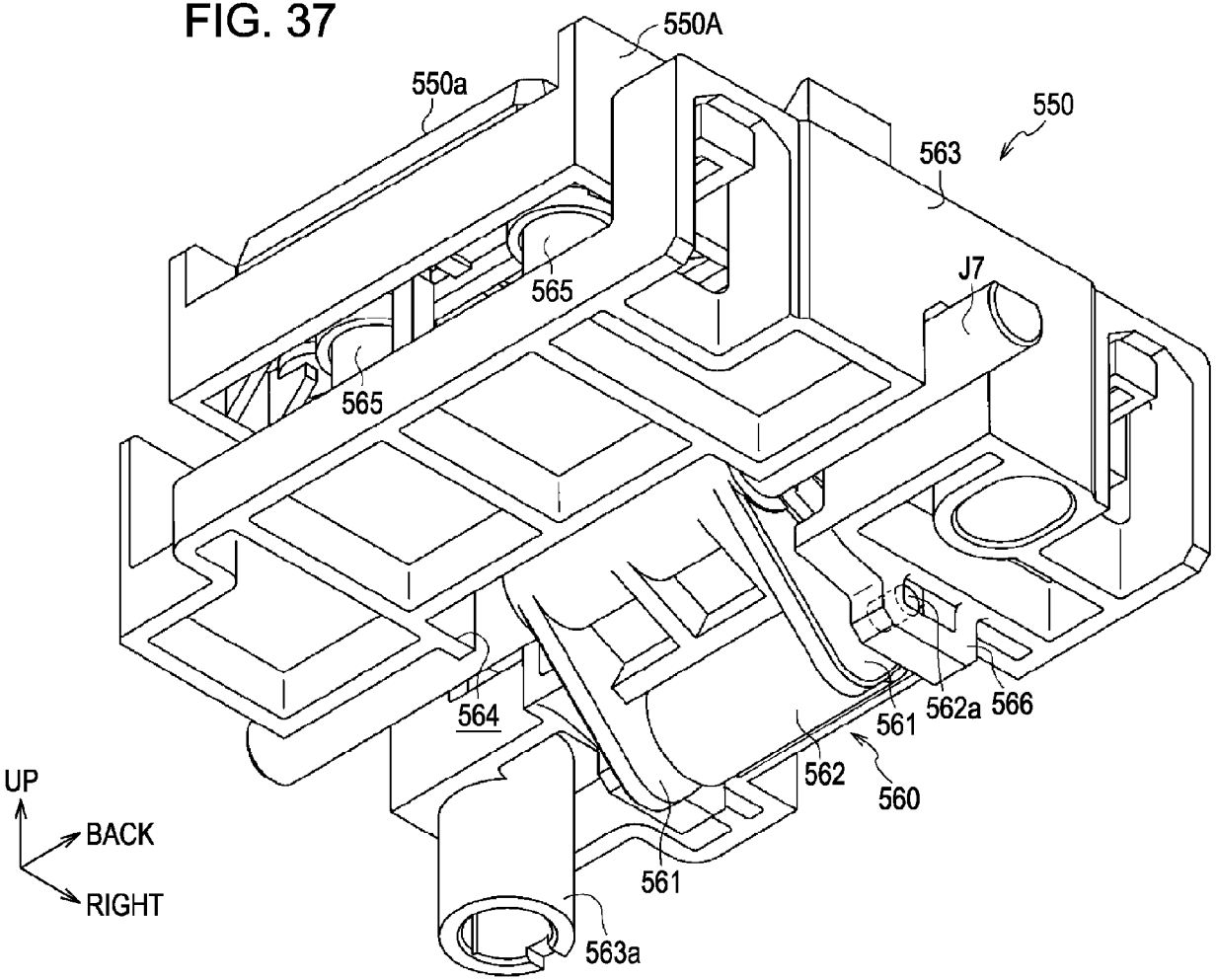
FIG. 37 is a perspective view illustrating the cam mechanism which lifts and lowers the leaving cap when seen from oblique below.

In addition, as shown in FIGS. 36 and 37, a recess 564 as a first engaged surface is formed so as to be open downward at the substantially intermediate section of the bottom surface in the cap holder (holding member) 563 of the leaving cap 550. In addition, the cam mechanism 560 of the leaving cap 550 is inserted from below into the recess 564. Further, a substantially cylindrical guide portion 563*a* protrudes downward at the position which is front right corner of the bottom surface in the cap holder 563 of the leaving cap 550. In addition, the leaving cap guide rod 36 fixed to the frame structure 90 is freely fitted and inserted into the guide portion 563*a*. Accordingly, the cap holder 563 is guided while the inclination thereof is suppressed in the up-down direction, thereby smoothly sliding. Further, a cap member 550A of the leaving cap 550 is attached above the cap holder 563 through a coil spring 565 serving as biasing means. In addition, the coil spring 565 allows the movement of the cap member 550A in the up-down direction relative to the cap holder 563. In this way, in the leaving cap 550 as a cap device, a capping unit which can integrally move up and down is configured by the cap holder 563, the coil spring 565, and the cap member 550A. Further a contact portion 550*a* made of elastic material which can come into contact with the nozzle-formed surface of the liquid ejecting head 30 so as to cover the nozzle is provided above the cap member 550A for each head unit.

Figure 38:
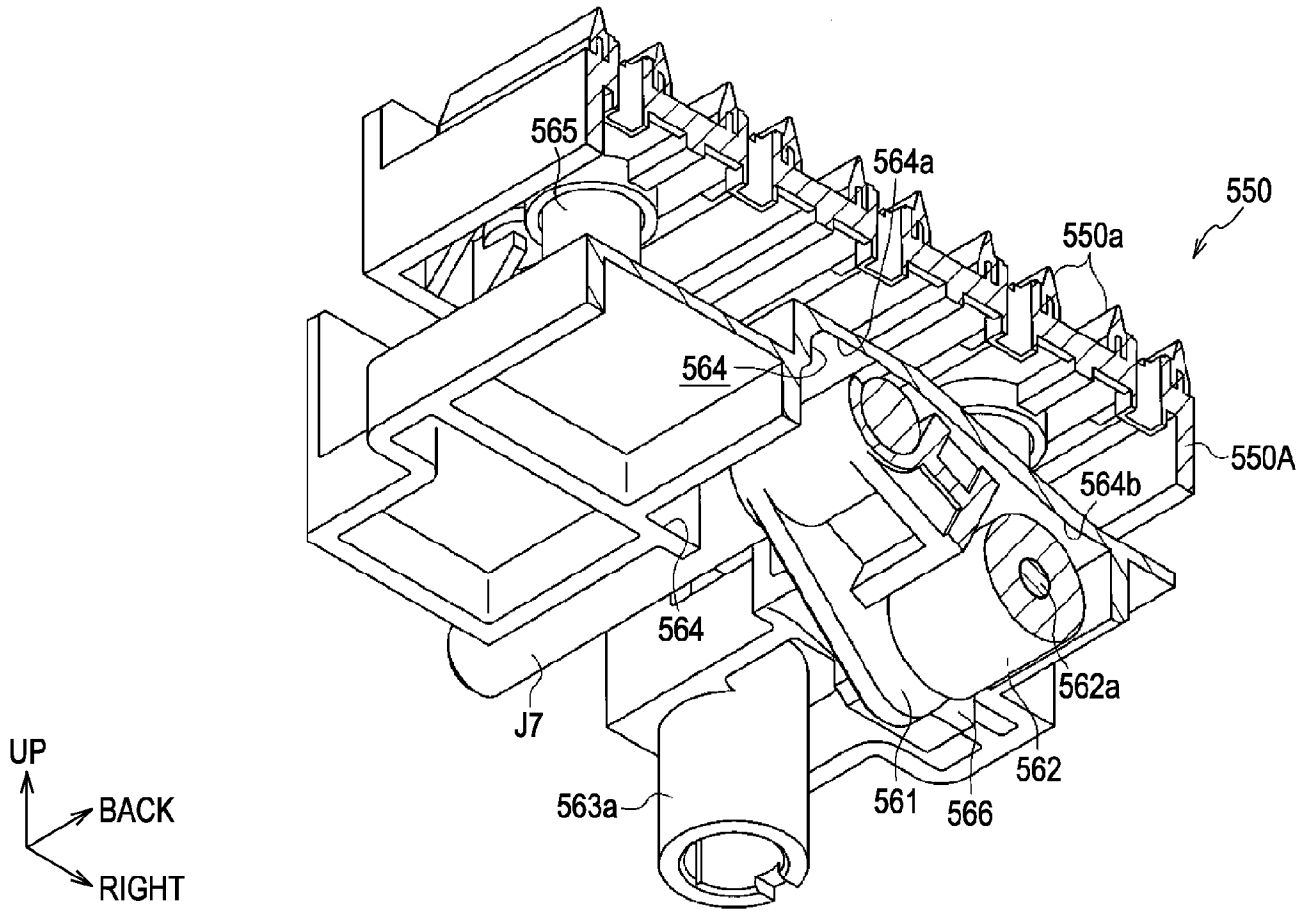
FIG. 38 is a cross-sectional perspective view illustrating the cam mechanism which lifts and lowers the leaving cap when seen from oblique below.

More specifically, as shown in FIG. 38, a plane portion 564*a* which is positioned to the left and an inclined surface portion 564*b* which is inclined downward to the right from the plane portion 564*a* are formed in the bottom surface of the recess 564 of the cap holder 563. In addition, in a state where the cap holder 563 is attached to the cam mechanism 560, the circumferential surface of the cam roller 562 which is fixed to the tip end of the cam frame 561 comes into contact with the plane portion 564*a* of the bottom surface of the recess 564 to support the cap holder 563 from below.

Figure 39:
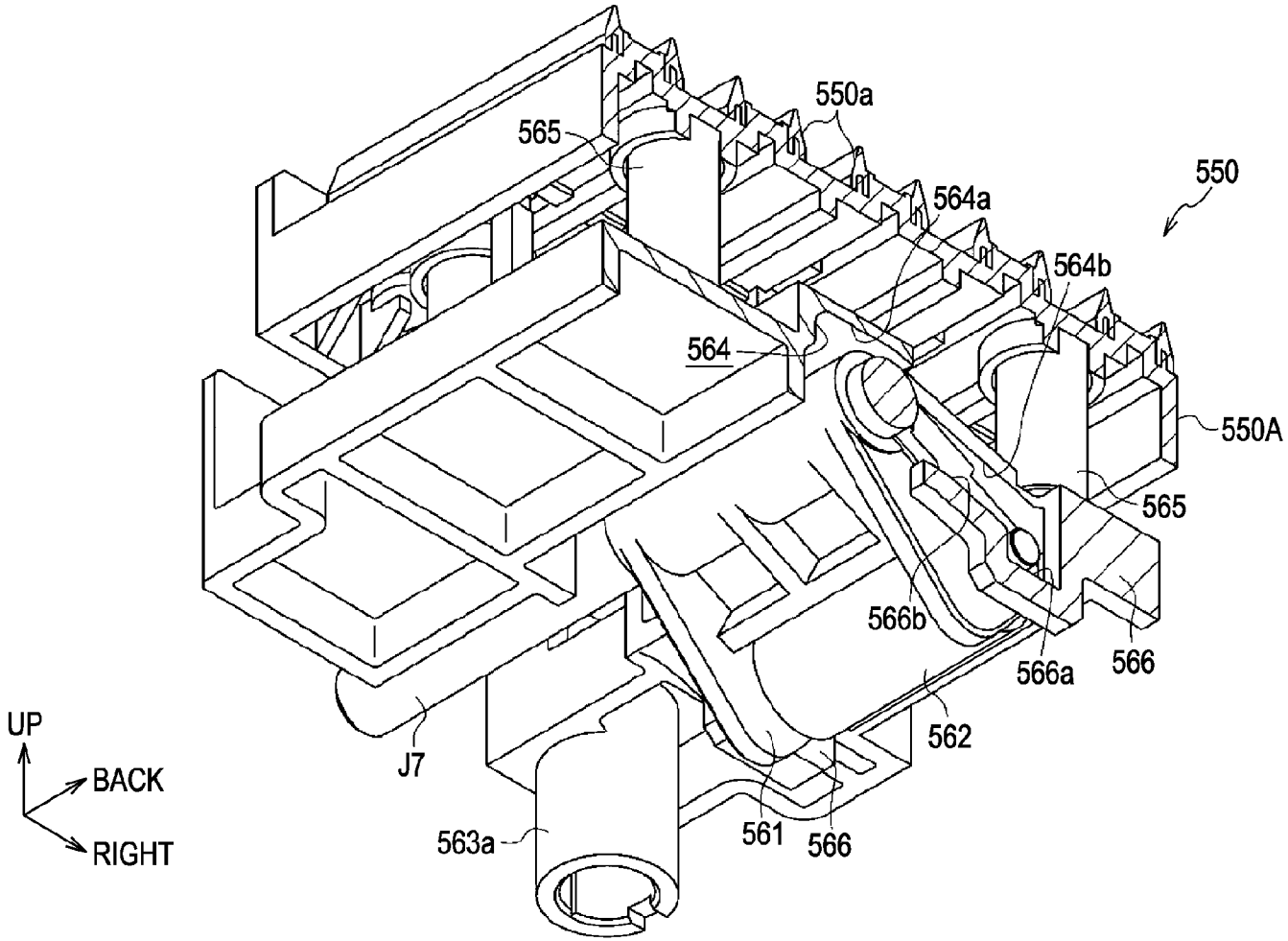
FIG. 39 is another cross-sectional perspective view illustrating the cam mechanism which lifts and lowers the leaving cap when seen from oblique below.

Further, as shown in FIG. 39, a pair of walls 566 are formed along the vertical direction in the right section of the bottom surface of the cap holder 563. The walls 566 includes a concave surface portion 566*a* which has a concave shape downward in the vicinity of the right internal surface of the recess 564 and an inclined surface portion 566*b* which extends so as to be inclined in the upper left direction from the concave surface portion 566*a*. The tip end of the inclined surface portion 566*b* of the wall 566 (left end in FIG. 39) is positioned further to the right than the left side plane portion 564*a* of the recess 564. That is, in the cap holder 563, the plane portion 564*a* which is a part of the bottom surface of the recess 564 facing downward is a non-overlapped area which does not overlap a surface (surface including the concave surface portion 566*a* and the inclined surface portion 566*b*) serving as a second engaged surface of the wall 566 which faces upward so as to be opposite to the recess 564, in the left-right direction perpendicular to both of the lifting and lowering direction of the leaving cap 550 and the axial direction of the seventh rotation shaft J7. In addition, the walls 566 are disposed so as to be separated from each other in the same direction by a distance almost equal to the size of the cam frame 561 in the front-back direction.

Further, in a state where the cap holder 563 is attached to the cam mechanism 560, the shaft portion 562*a* of the cam roller 562 is disposed in the concave surface portion 566*a* of the wall 566. Therefore, even when the cap holder 563 is attempted to lift or move left and right in this state, the shaft portion 562*a* of the cam roller 562 is locked in the concave surface portion 566*a* of the wall 566 in the up direction and the left-right direction. Accordingly, the operation of removing the cap holder 563 from the cam mechanism 560 is restricted.

Figure 40:
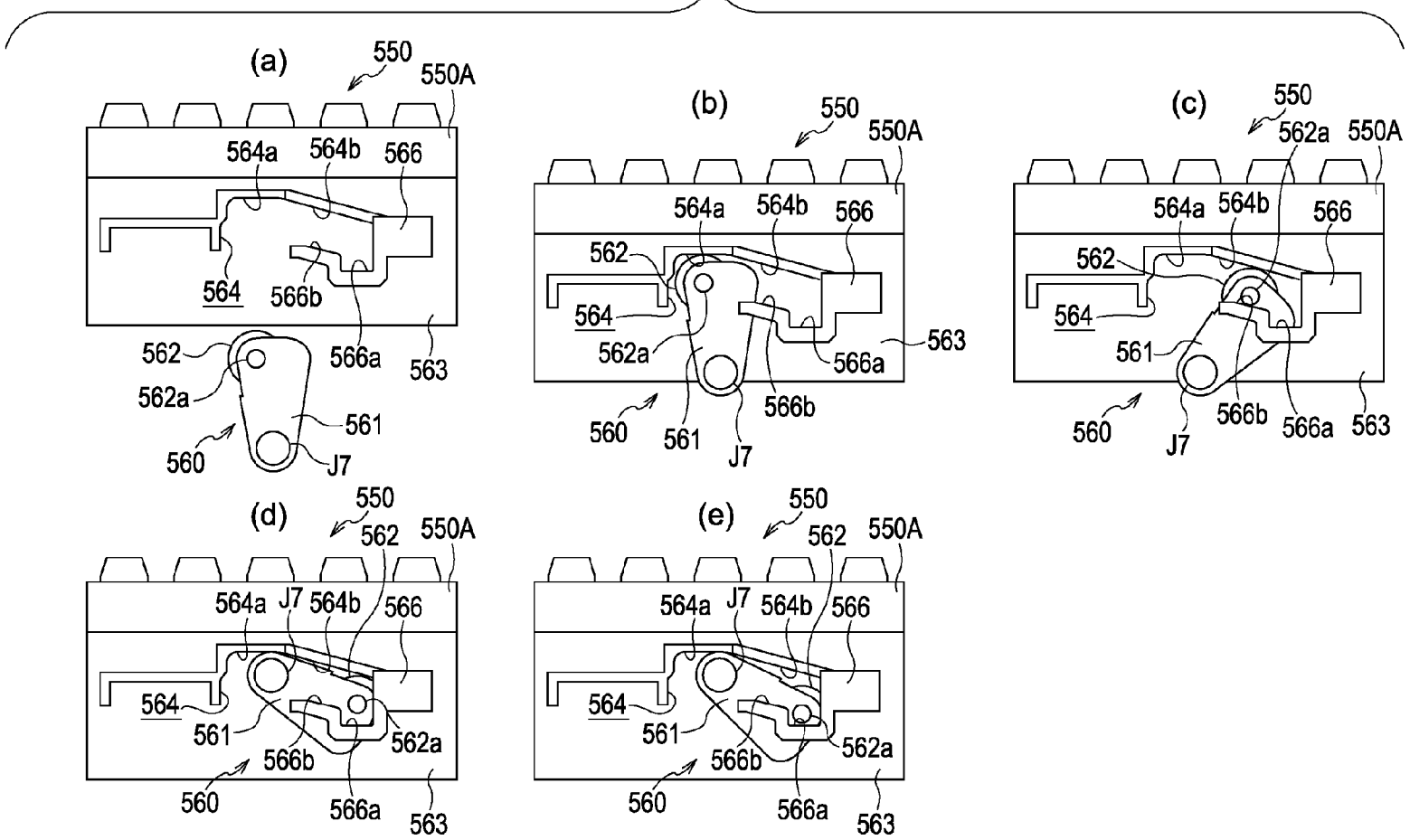
FIG. 40(*a*) to (*e*) are diagrams illustrating the operation of the cam mechanism which is engaged with the leaving cap.

Next, the mechanism of the operation of mounting the leaving cap 550 in the cam mechanism will be described with reference to FIG. 40. FIG. 40(*a*) illustrates a state where the cam mechanism is disposed to be separated from the cap holder 563 in the up-down direction while the cam roller 562 is disposed at the highest position.

From this state, as shown in FIG. 40(*b*), when the cap holder 563 is moved in the vertical direction, the cam roller 562 of the cam mechanism 560 is inserted from below into the recess 564 of the cap holder 563. In this case, in the recess 564 of the cap holder 563, the shaft portion 562*a* of the cam roller 562 is inserted into the recess 564 through the lower space range of the plane portion 564*a* which is the non-overlapped area not overlapping the wall 566 in the left-right direction. In addition, the circumferential surface of the cam roller 562 comes into contact with the plane portion 564*a* of the recess 564 of the cap holder 563 to support the cap holder 563 from below.

In addition, as shown in FIG. 40(*c*), when the seventh rotation shaft J7 rotates clockwise as shown in FIG. 40(*c*), the cam roller 562 rolls along the inclined surface portion 564*b* of the recess 564. Then, the shaft portion 562*a* of the cam roller 562 is disposed opposite to the inclined surface portion 566*b* of the wall 566 of the cap holder 563 in the up-down direction. Therefore, even when the cap holder 563 lifts in this state, the shaft portion 562*a* of the cam roller 562 is locked from above in the inclined surface portion 566*b* of the wall 566. Accordingly, the operation of removing the cap holder 563 from the cam mechanism 560 is restricted.

In addition, as shown in FIG. 40(*c*), when the shaft portion 562*a* of the cam roller 562 moves so as to follow the rotation track about the seventh rotation shaft J7 in the down direction separating from the liquid ejecting head 30, the shaft portion 562*a* of the cam roller 562 applies the pressing force to the inclined surface portion 566*b* of the wall 566 of the cap holder 563 from the upper left direction to the lower right direction. That is, the cap holder 563 lowers while being guided by the leaving cap guide rod 36 in the up-down direction, the shaft portion 562*a* of the cam roller 562 comes into press contact with the inclined surface portion 566*b* of the wall 566 of the cap holder 563 from above to press down the cap holder 563. As a result, the lowering movement of the cap holder 563 is reliably performed.

Next, as shown in FIG. 40(*d*), when the seventh rotation shaft J7 further rotates clockwise as shown in FIG. 40(*d*), the height of a portion which supports the inclined surface portion 564*b* of the recess 564 of the cam roller 562 lowers in the vertical direction. Then, the shaft portion 562*a* of the cam roller 562 is disposed opposite to the right side concave surface portion 566*a* of the wall 566 of the cap holder 563 in the up-down direction. Therefore, in this state, the circumferential surface of the base end of the cam frame 561 comes into contact with the plane portion 564*a* of the recess 564 from below. That is, the bottom surface of the recess 564 of the cap holder 563 is supported at two positions from below by the cam roller 562 and the cam frame 561.

Then, as shown in FIG. 40(*e*), when the seventh rotation shaft J7 further rotates clockwise as shown in FIG. 40(*e*), the cam roller 562 performs the revolving movement about the seventh rotation shaft J7 so as to be separated below from the inclined surface portion 564*b* of the recess 564 with respect to the cap holder 563 in which the plane portion 564*a* of the recess 564 is supported by the circumferential surface of the base end of the cam frame 561. In addition, the shaft portion 562*a* of the cam roller 562 is engaged with the internal surface of the concave surface portion 566*a* of the wall 566 in the cap holder 563 from above. Then, in the cap holder 563, the plane portion 564*a* of the recess 564 is supported at the base end in the cam frame 561 from below and the concave surface portion 566*a* of the wall 566 is locked by the shaft portion 562*a* of the cam roller 562 from above. Accordingly, the cap holder 563 is connected to the cam mechanism in a state where the backlash is suppressed in the up-down direction and the left-right direction.

Figure 41:
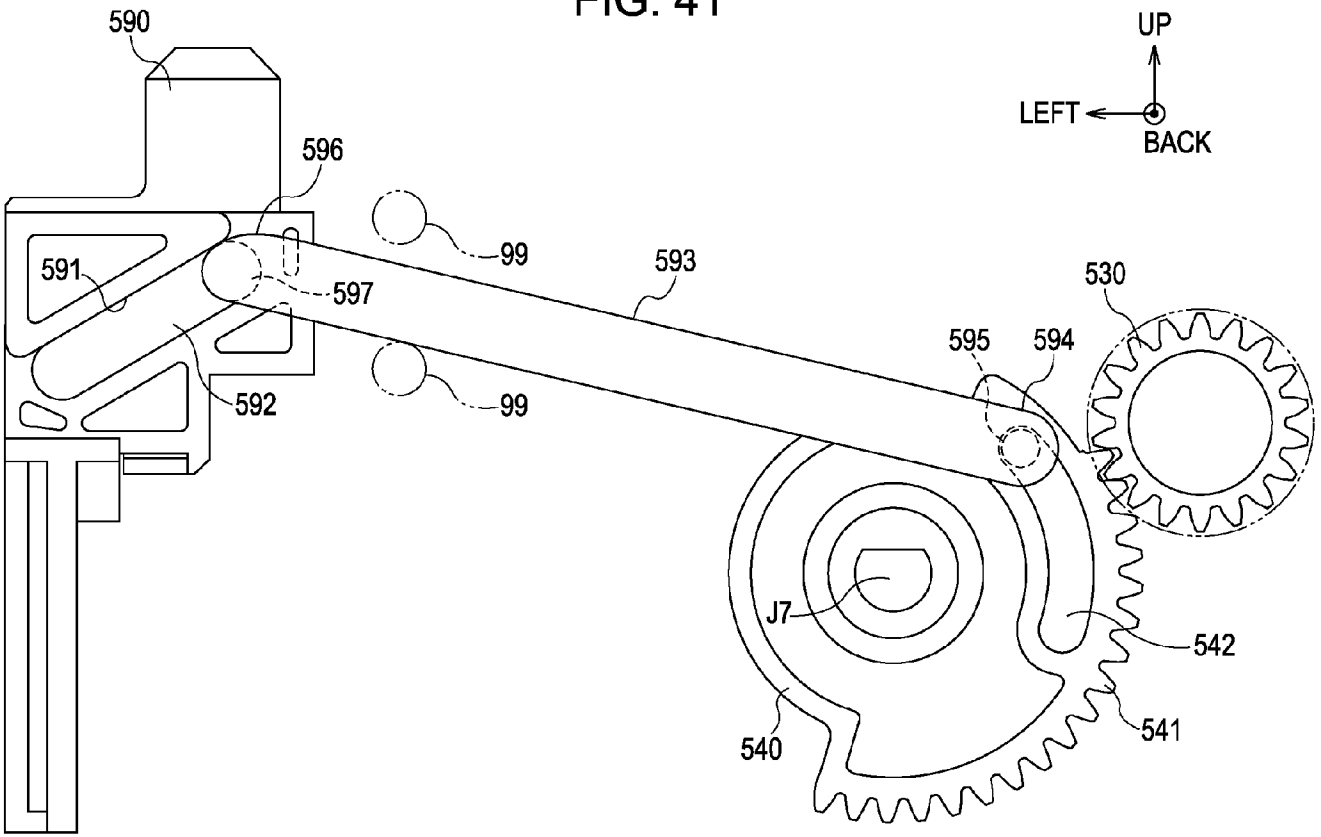
FIG. 41 is a diagram schematically illustrating the state before the carriage lock body moves upward.

Next, the mechanism relating to the vertical movement of the carriage lock body 590 will be described with reference to FIGS. 41 to 43. As shown in FIG. 41, the carriage lock body 590 moves in the up-down direction by a predetermined amount along with the rotation of the sixth transmitting gear 540 which is rotated by the fifth transmitting gear 530 by a predetermined angle.

That is, a gear 541 is formed in a predetermined range in the outer circumference of the sixth transmitting gear 540 so as to mesh with the fifth transmitting gear 530 and rotate by a predetermined angle. In addition, an arc-shaped groove 542 which is an arc-shaped groove having a predetermined width is provided in the outer circumferential end area of the sixth transmitting gear 540. The rod member 593 which has a cylindrical first protrusion 595 at a first end 594 on the right side thereof is provided in the maintenance device 100 so as to be engaged with the arc-shaped groove 542. In addition, a straight groove 592 which has a predetermined width and is inclined from upper right to left lower direction is formed in the carriage lock body 590. An inclined surface portion 591 which protrudes backward (front direction in the drawing) in an eaves shape is formed along the upper side of the straight groove 592. In addition, a second end 596 on the left side of the rod member 593 slides into contact with the inclined surface 591. A cylindrical second protrusion 597 is provided even in the second end 596 to slide along the straight groove 592 formed in the carriage lock body 590. In addition, the movement of the rod member 593 in the up-down direction is restricted by the cylindrical surfaces of two cylindrical ribs 99 which extend in the front-back direction in the frame structure 90. Further, the carriage lock body 590 can slide in the up-down direction along a guide portion (not shown) which is also provided in the frame structure 90.

With this configuration, when the second end 596 of the rod member 593 moves in the left direction, the carriage lock body 590 moves in the up direction due to a cam mechanism formed between the inclined surface 591 and the second end 596 so as to be in the locked state where the movement in the left-right direction of the carriage 14 (see FIG. 1) which is provided with the liquid ejecting head 30 is restricted. The mechanism of becoming locked state will be described with reference to FIGS. 42 and 43.

Figure 42:
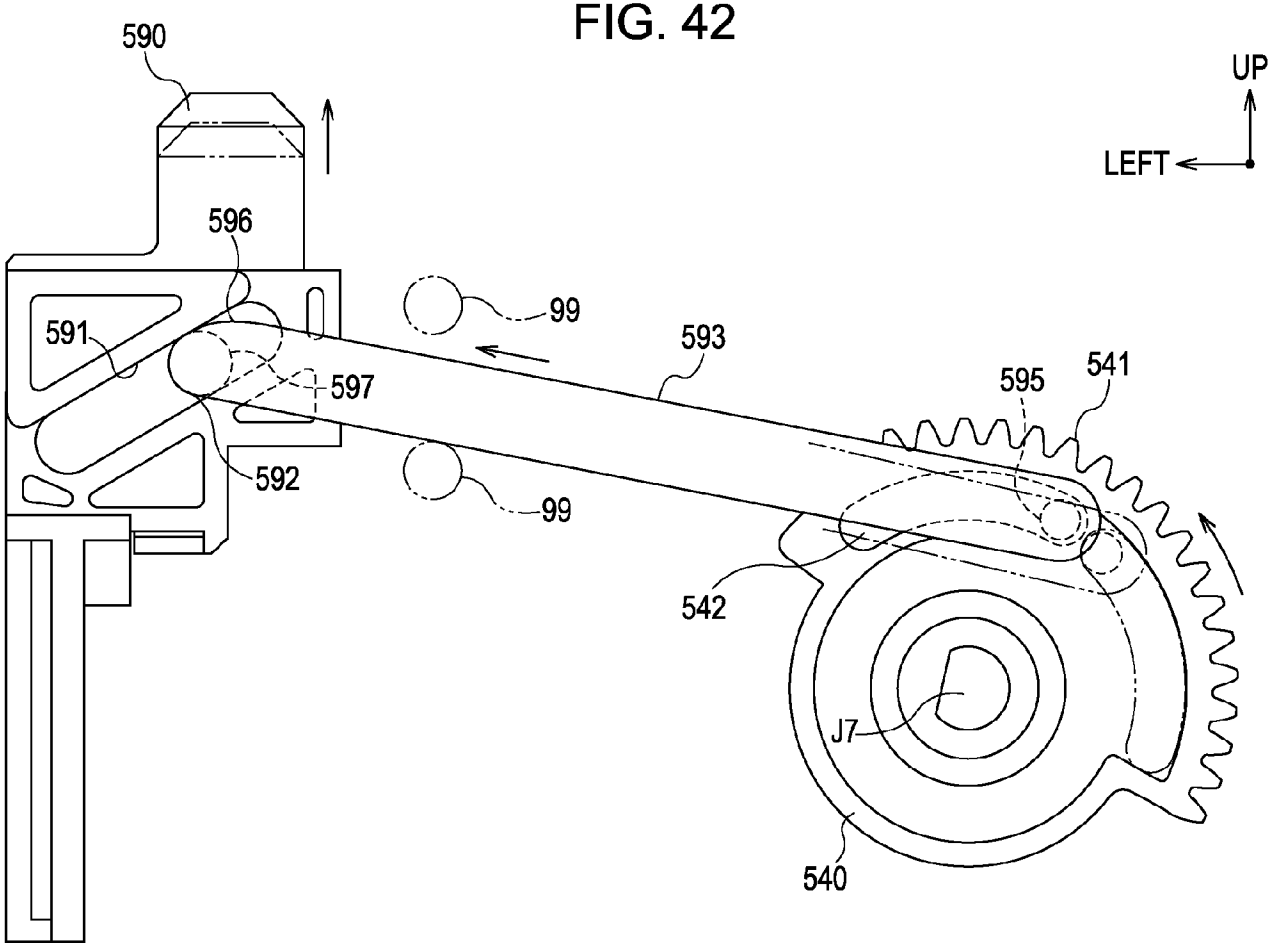
FIG. 42 is a diagram schematically illustrating the state where the carriage lock body is moving upward.

As shown in FIG. 42, when the arc-shaped groove 542 performs the CCW rotation along with the CCW rotation of the sixth transmitting gear 540, the first protrusion 595 of the first end 594 is pressed and moved in the left direction by the right end of the arc-shaped groove 542. During this movement, since the downward movement of the rod member 593 is restricted by the cylindrical rib 99, the second end 596 moves approximately in the left direction without moving downward. As a result, the inclined surface portion 591 is lifted by the second end 596 which moves in the left direction, the carriage lock body 590 starts moving upward.

Figure 43:
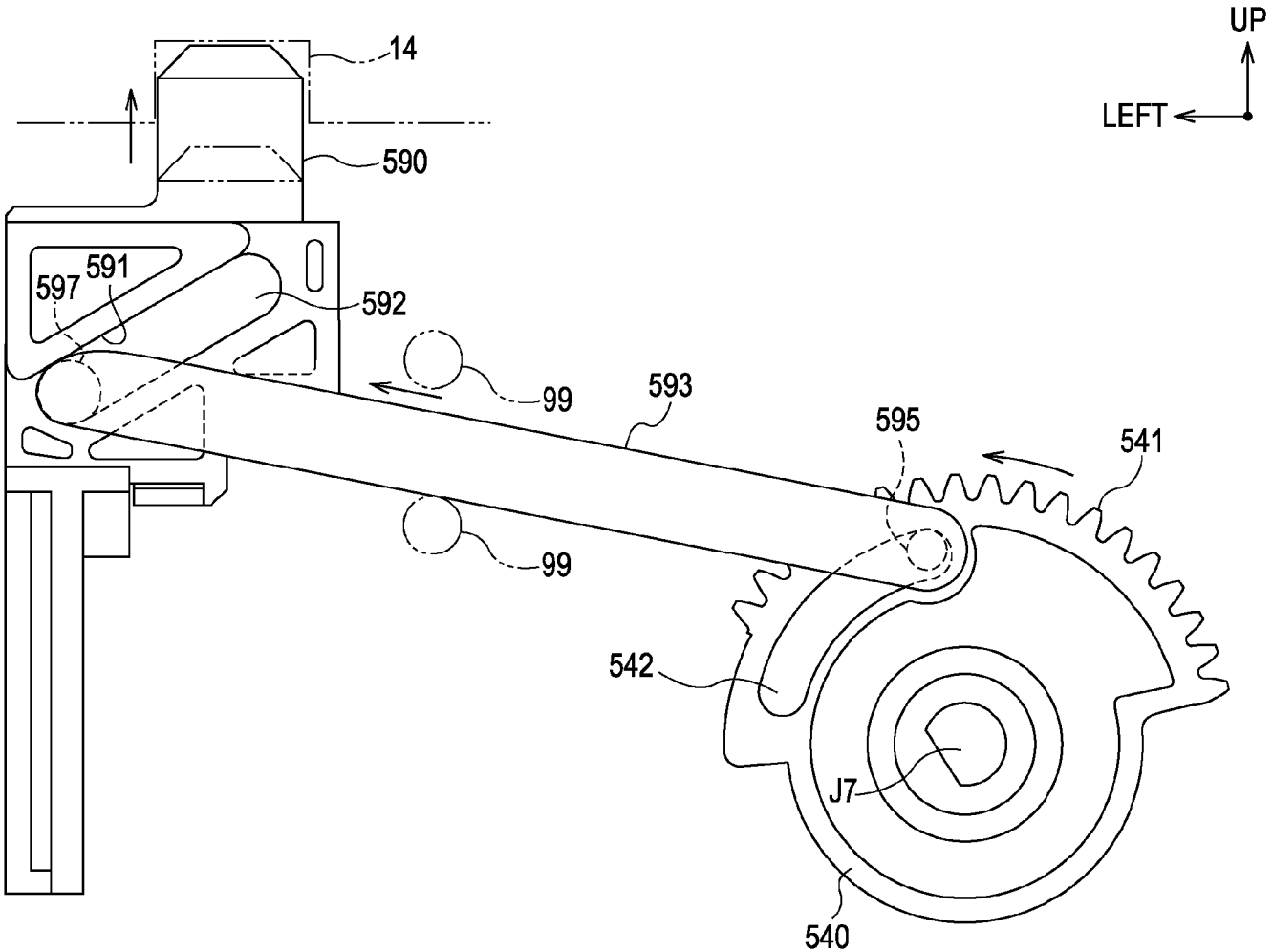
FIG. 43 is a diagram schematically illustrating the state after the carriage lock body moved upward.

In addition, as shown in FIG. 43, when the sixth transmitting gear 540 performs the CCW rotation by a predetermined angle to the end, the first protrusion 595 of the first end 594 is further pressed and moved in the left direction by the right end of the arc-shaped groove 542. In addition, in response to this movement, the second end 596 of the rod member 593 slides along the inclined surface portion 591 of the carriage lock body 590 and moves approximately to the end of the inclined surface or until the cylindrical second protrusion 597 reaches the left end of the straight groove 592. As a result, the inclined surface portion 591 of the carriage lock body 590 moves upward by a predetermined amount from the position before start moving in response to the movement of the second end 596 and the carriage lock body 590 is engaged with the carriage 14 where the liquid ejecting head 30 is provided so as to restrict the movement of the carriage 14 in the left-right direction, thereby becoming the so-called locked state.

Thereafter, although not shown in the drawing, when the second end 596 moves in the left, the carriage lock body 590 moves in the down direction from the state of being moved upward by a predetermined amount to release the locked state of the carriage 14. That is, the carriage lock body 590 is moved in the down direction by the cam mechanism which is formed between the second protrusion 597 formed in the second end 596 of the rod member 593 and the straight groove 592. In addition, at this time, the movement of the rod member 593 in the up direction is restricted by the cylindrical rib 99.

Figure 44:
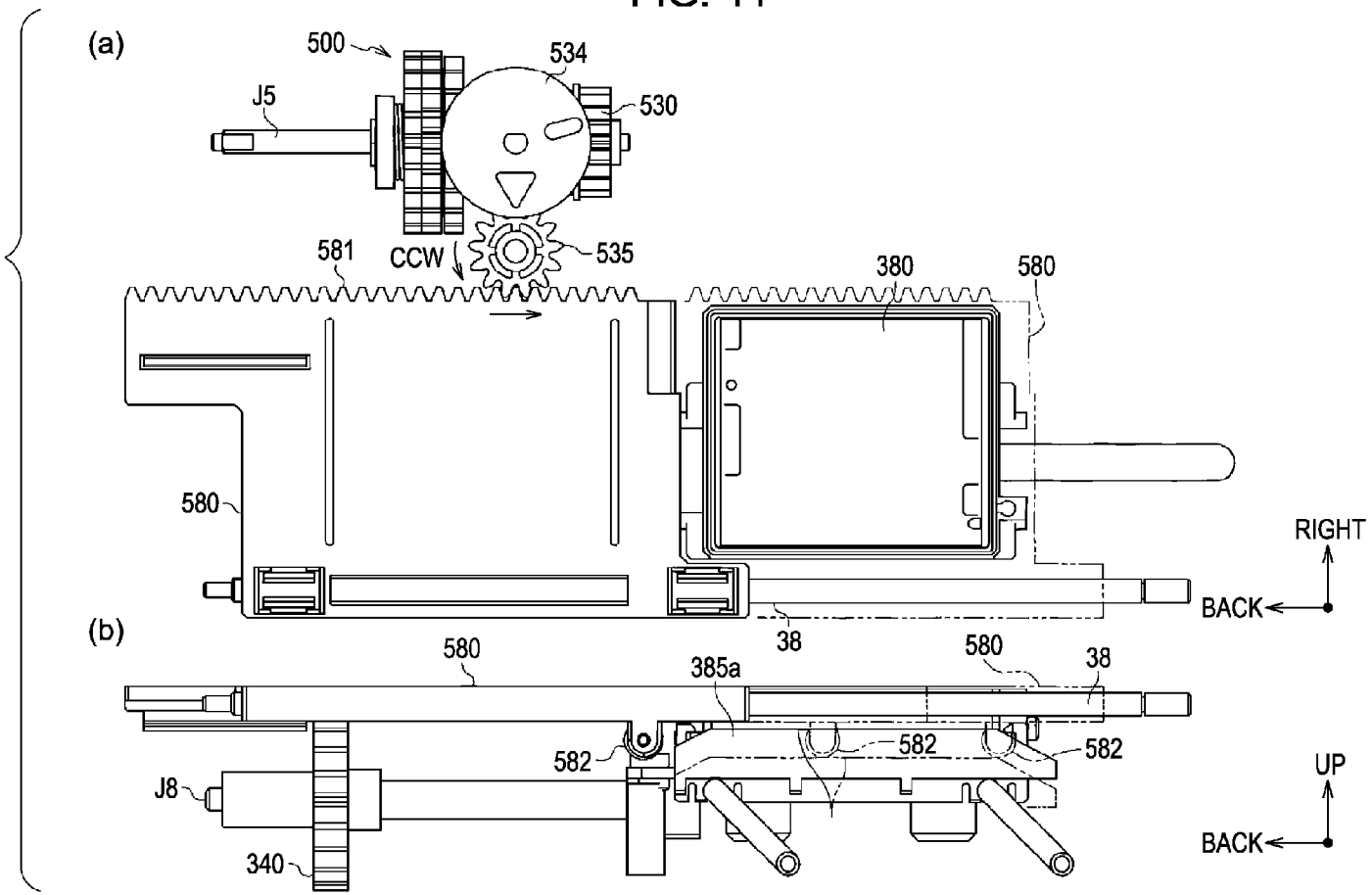
FIG. 44 is a diagram schematically illustrating the movement state of the FL box cover in which (a) is a plan view and (b) is a side view.

Next, the mechanism relating to the forward and backward movement of the FL box cover 580 will be described with reference to FIG. 44. As shown in FIG. 44(*a*), when the eighth transmitting gear 535 performs the CCW rotation when seen from above, the FL box cover 580 moves the meshed rack from backward to forward. As a result, the FL box cover 580 where the rack is formed moves forward to move from the state of not covering the upper side of the FL box to the state of covering the FL box 380. In addition, as described above, the rotation angle of the fifth rotation shaft J5 is restricted by the fifth gear 500. Therefore, when the fifth rotation shaft J5 rotates by the restricted rotation angle, the FL box cover 580 moves to a position to move from the state of not covering the FL box 380 to the state of covering the FL box 380.

Further, as shown in FIG. 44(*b*), a cover roller 582 which is axially supported so as to rotate to the lower surface side is provided at the right end of the FL box cover 580. In addition, when the FL box cover 580 covers the FL box 380, the roller surface of the cover roller 582 comes into contact with a guide rib 385*a* which is formed in a wall shape in the up-down direction at the right end of the FL box cover 380 from above. Due to this contact, the cover roller 582 presses down the FL box 380 as indicated by the two-dot chain line in the drawing. In this way, the FL box cover 580 moves to the upper section of the FL box 380, the FL box cover 580 is not engaged with the FL box 380.

Figure 45:
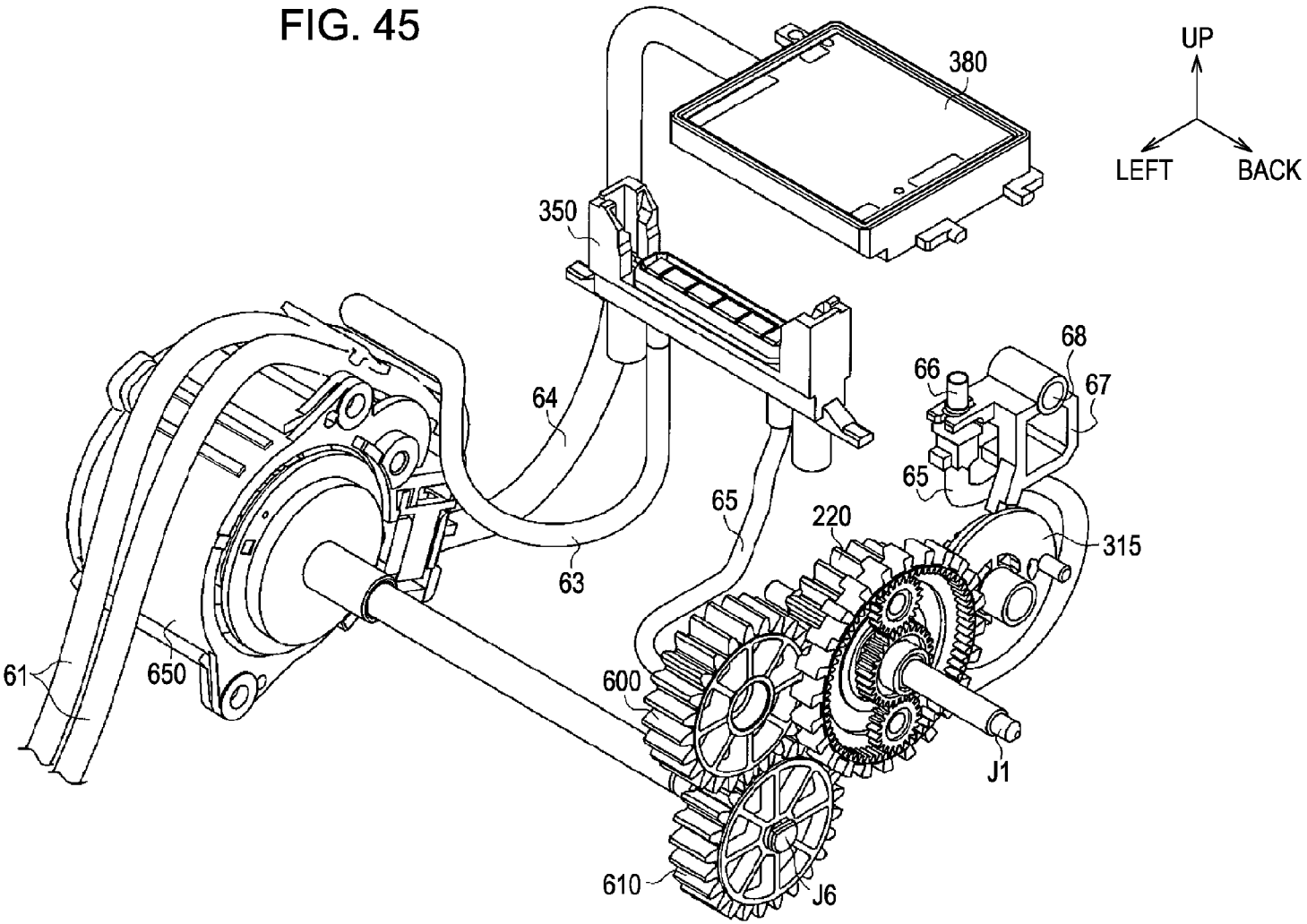
FIG. 45 is a perspective view illustrating the driving system of a suction pump which is driven by the sixth gear.

(Drive System of Suction Pump) Next, as shown in FIG. 45, the suction pump 650 according to the present embodiment includes a drive system which is rotated by the rotation of the sixth gear 600 meshing with the second gear 220. That is, a ninth transmitting gear 610 meshing with the sixth gear 600 is rotated by the rotation of the sixth gear 600. The ninth transmitting gear 610 is fixed to the sixth rotation shaft J6, and the suction pump 650 is operated by the sixth rotation gear J6 rotating along with the rotation of the ninth transmitting gear 610.

In the present embodiment, the suction pump 650 suctions ink in the suction cap 350 through a tube 63 and suctions ink in the FL box 380 through a tube 64. In addition, the suctioned ink is discharged to a waste ink tank (not shown) or the like through the discharging tube 61.

In the present embodiment, when ink in the suction cap 350 is suctioned, the pressure of the closed space formed by the suction cap 350 being in contact with the liquid ejecting head 30 is reduced to suction ink in the liquid ejecting head 30 and an atmosphere-opened suction in which ink is suctioned in a state where the closed space is opened to the atmosphere through the tube 65 is performed.

Figure 46:
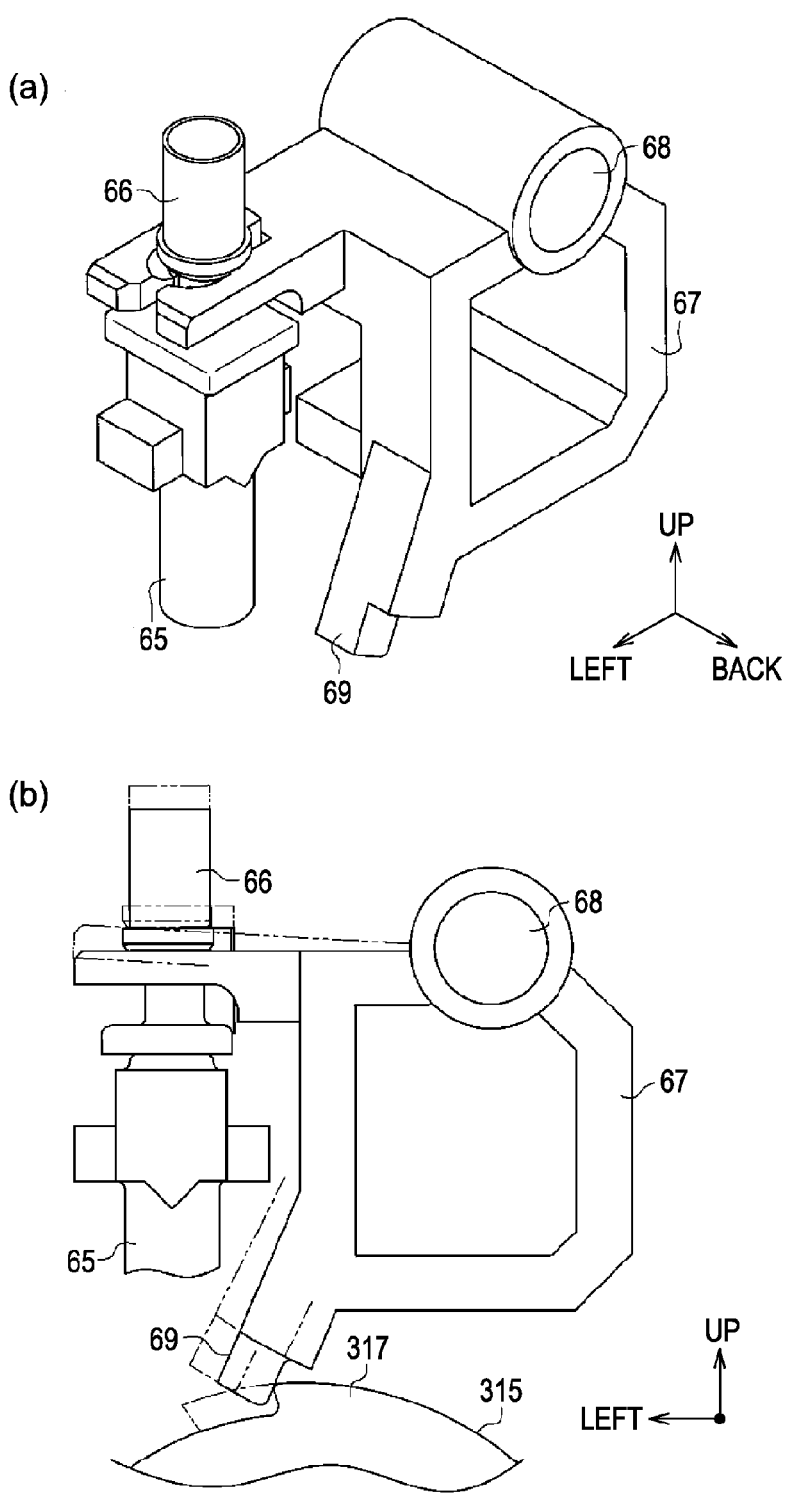
FIG. 46 is a diagram illustrating an opening mechanism of an atmosphere open valve in which (a) is a perspective view and (b) is a diagram illustrating the operation.

The atmosphere opening in the closed space is performed by opening the atmosphere opening valve 66 provided in an end of the tube 65. The mechanism relating to the opening of the atmosphere opening valve 66 will be described with reference to FIG. 46. As shown in FIG. 46(*a*), the atmosphere opening valve 66 is pinched by an arm portion protruding in the left direction in the valve opening and closing member 67. The valve opening and closing member 67 is axially supported in the frame structure by a shaft hole 68 so as to rotate. In addition, a protrusion 69 is provided in the lower end.

As shown in FIG. 46(*b*), the protrusion 69 comes into contact with the cam-shaped portion 317 (see FIG. 12) provided in the front side of the clutch plate 315 in response to the CCW rotation of the clutch plate and performs the CW rotation about the shaft hole 68 due to the contacted cam-shaped portion 317. The valve opening and closing member 67 lifts the pinched atmosphere opening valve 66 due to the rotation of the protrusion 69 to open the end of the tube 65 to the atmosphere.

As described above, the maintenance device 100 includes the plural drive systems for operating the plural function components by switching between the gears which are driven by the rotation of the single motor 110. In addition, in the present embodiment, in order to operate the drive systems at an appropriate timing, the maintenance device 100 includes a mechanism which detects the rotation states of the first gear 210, the second gear 220, and the fifth rotation shaft J5.

Figure 47:
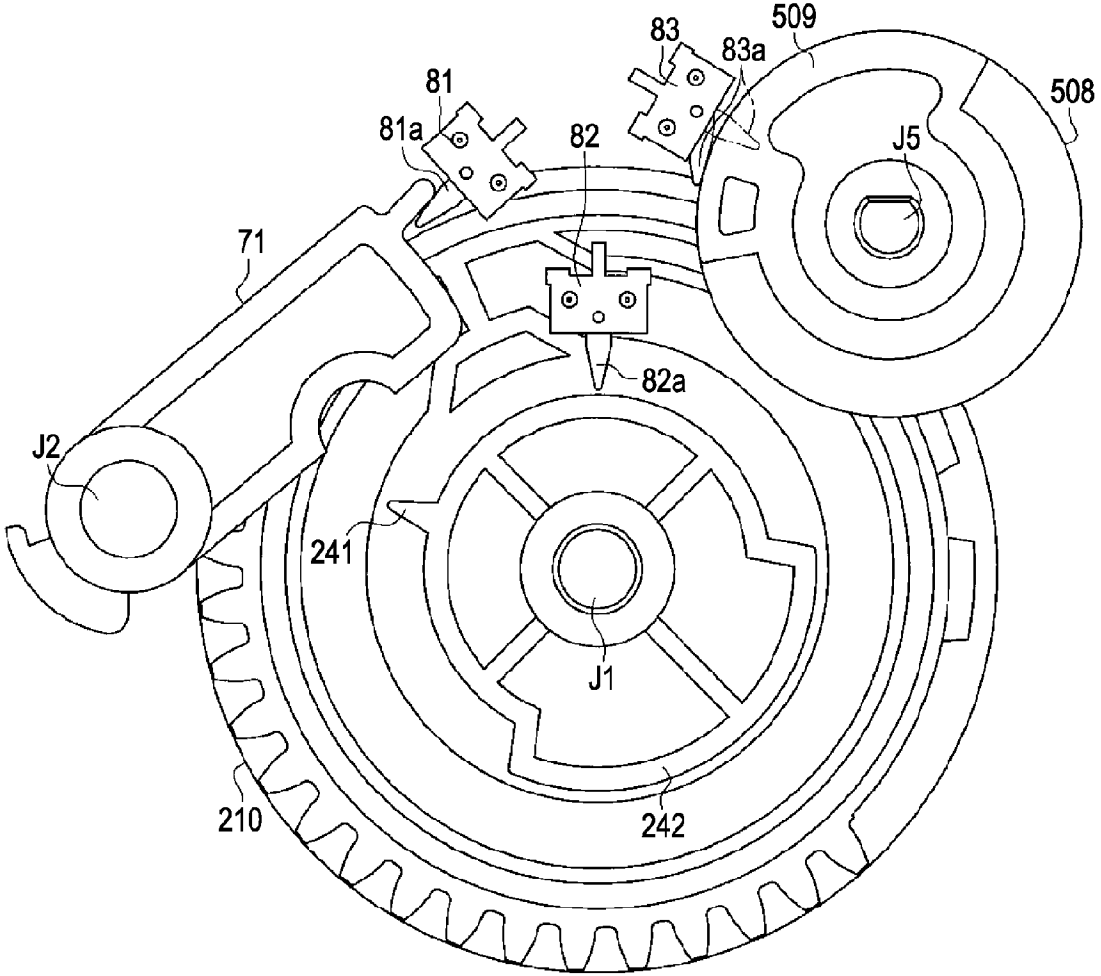
FIG. 47 is a diagram illustrating the arrangement configuration of detecting means which detects the rotation states of a gear.

Specifically, as shown in FIG. 47, the maintenance device 100 is provided with the first detecting means 81, the second detecting means 82, and the third detecting means 83 which detect each rotation state. The first detecting means 81, the second detecting means 82, and the third detecting means 83 output a predetermined voltage as a detection signal using the first hook portion 71, the first gear, and the above-described rotation detecting vehicle 508, respectively. All of the detecting means are provided in the circuit substrate 50 which is attached to the frame structure 90. In addition, in the present embodiment, each of the detecting means employs a small switch which controls short and break of an electrical circuit by a displacement (swing) of a detecting lever.

The first detecting means 81 outputs a detection signal according to an engagement degree between a detecting lever 81*a* and the first hook portion 71. That is, in a state where the rotation of the first gear 210 is restricted and stopped, the first detecting means 81 does not output a voltage by not engaging with the first hook portion 71. On the other hand, when the first gear 210 rotates, the first hook portion 71 performs the CW rotation about the second rotation shaft J2 and is engaged with the detecting lever 81*a*. Accordingly, the detecting lever 81*a* is displaced and the first detecting means 81 outputs a predetermined voltage. In this way, using the detection signal of the first detecting means 81, it is possible to check whether the first gear 210 or the second gear 220 rotates.

The second detecting means 82 outputs a detection signal according to a rotation state of the first gear 210 about the first rotation shaft J1. That is, in a state where a first cam-shaped portion 241 and a second cam-shaped portion 242 which protrude outward in the radial direction of the first gear 210 are engaged with a detecting lever 82*a* of the second detecting means 82, the second detecting means 82 outputs a predetermined voltage by the detecting lever 82*a* being displaced. On the other hand, in a state of not being engaged, the second detecting means 82 does not output a voltage. In addition, the suction cap 350 reaches the suction position in which the closed space formed by coming into contact with the liquid ejecting head 30 is suctioned, the second detecting means 82 is engaged with the first cam-shaped portion 241 to output a predetermined voltage. In addition, when the wiper unit 420 starts moving, the second detecting means 82 is engaged with the second cam-shaped portion 242 to displace the detecting lever 82*a*, thereby outputting a predetermined voltage. In addition, the predetermined voltage is continuously output during the movement of the wiper unit 420.

The third detecting means 83 outputs a detection signal according to a rotation state of the rotation detecting vehicle 508 which is attached to the fifth rotation shaft J5 for detecting the rotation state of the fifth rotation shaft J5. That is, in a state where the detecting cam portion 509 which protrudes in the radial direction of the rotation detecting vehicle 508 is engaged with the three detecting means 83, the three detecting means 83 output a predetermined voltage by the detecting lever 83*a* being displaced as shown in the drawing. On the other hand, in a state of not being engaged, the three detecting means 83 do not output a voltage. In addition, when the rotation detecting vehicle 508 rotates by a predetermined angle after the movement of the FL box cover 580 starts, the third detecting means 83 moves from the state of being engaged with the detecting cam portion 509 to the state of not being engaged with the detecting cam portion 509 to stop outputting the predetermined voltage which has been output. Further, from the time when the rotation angle of the rotation detecting vehicle 508 until the movement of the FL box cover 580 ends becomes a predetermined angle, the detecting lever 83*a* of the third detecting means 83 moves from the state of not being engaged with the detecting cam portion 509 to the state of being engaged with the detecting cam portion 509. In this way, the third detecting means 83 starts outputting the predetermined voltage which has been not output until then.

(Operation of Maintenance Device) As described above, in the maintenance device 100 according to the present embodiment, the gears which are rotated by driving the single motor 110 are switched and the function components corresponding to the rotated gears operate. Therefore, the operations (actions) of the function components which are performed in the maintenance device 100 will be sequentially described below according to the flowchart shown in FIGS. 49 to 53 while referring to the timing chart shown in FIG. 48 as needed.

Here, in the following descriptions, in the maintenance device 100, the state where the leaving cap 550 and the carriage lock body 590 are lowered and the open state where the FL box cover 580 is positioned backward are referred to a suction home position (suction HP). On the other hand, in the maintenance device 100, the state where the leaving cap 550 and the carriage lock body 590 are lifted and the closed state where the FL box cover 580 is positioned forward are referred to a maintenance home position (maintenance HP). Therefore, in the suction HP, the maintenance device 100 performs the operations of maintaining and recovering the ejection performance of ink from the liquid ejecting head 30 so as to make the liquid ejecting head 30 in the state where an image is formed onto the sheet S appropriately eject ink. In addition, in the maintenance HP, the liquid ejecting head 30 in the state where an image is not formed onto the sheet S is covered with the leaving cap 550, the carriage 14 transporting the liquid ejecting head 30 is locked, and further the FL box 380 is covered with the FL box cover 580. Due to being in this state, it is possible to maintain the ejection characteristics of ink from, for example, the liquid ejecting head 30 over a long period of time.

Figure 49:
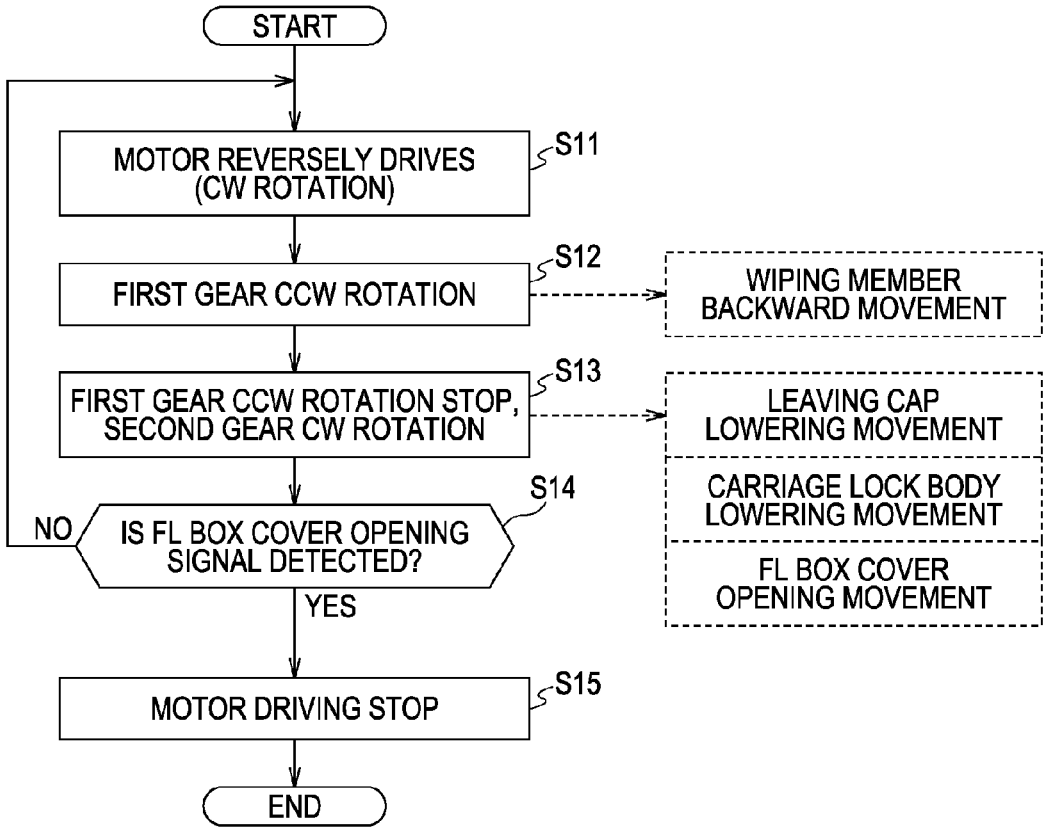
FIG. 49 is a flowchart illustrating the operation of shifting from a maintenance HP to a suction HP.

(Operation of Shifting from Maintenance HP to Suction HP) First, assuming that the maintenance device 100 is currently in the maintenance HP, the operation of shifting from the maintenance HP to the suction HP for forming an image onto the sheet S will be described according to the flowchart shown in FIG. 49 illustrating the rotation operation of the gear train. In addition, this operation and the rotation operation of the gear train in the maintenance device 100 which will be described hereinafter are performed by the above-described controller of the printer 11. Further, since the operations of the function components are controlled by changing the rotation direction of the single motor 110, for convenience of the description, the CCW rotation and the CW rotation of the motor are referred to as a forward rotation and a reverse rotation, respectively.

When the shifting operation starts, the reverse driving (CW rotation) of the motor is performed (Step S11). That is, the controller applies a driving voltage for the reverse rotation to the motor 110. Due to this, the operations are performed as shown in the timing chart from the maintenance HP shown in the left side of the timing chart to the suction HP shown in the right side along the broken line arrow illustrating the CW rotation of the motor 110. That is, the first gear 210 performs the CCW rotation (Step S12). Due to this rotation, the wiping member 450 performs the backward movement. Next, the first gear 210 rotates to the end and stops the CCW rotation, and then the second gear 220 performs the CW rotation (Step S13). Due to this rotation, as shown in the timing chart, the leaving cap 550 and the carriage lock body 590 perform the lowering movement. Further, the FL box cover 580 performs the opening movement.

In addition, it is determined whether or not an opening signal indicating the open state of the FL box cover 580 is detected (Step S14). As described above, the controller detects a predetermined voltage output from the third detecting means 83 when the FL box cover 580 is in the open state. Further, the controller continues the reverse driving of the motor 110 until the voltage is output from the third detecting means 83 and the detection signal is detected (Step S14: NO). When the detection signal is detected (Step S14: YES), the controller stops applying the driving voltage and stops the driving of the motor 110 (Step S15). Due to this operation, the maintenance device 100 is shifted from the maintenance HP to the suction HP.

Figure 50:
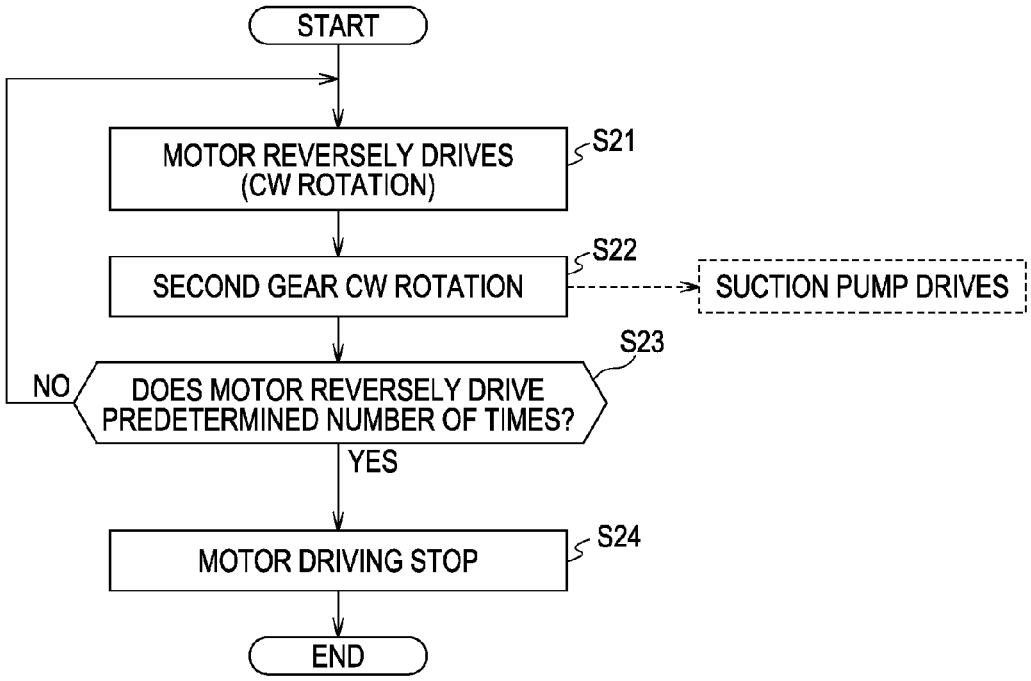
FIG. 50 is a flowchart illustrating the suction operation of the FL box.

(Suction Operation of FL Box) Next, in the suction HP, the operation of suctioning ink in the FL box 380 will be described according to the flowchart shown in FIG. 50 while referring to the timing chart. In addition, at the same time with the operation of suctioning ink in the FL box 380, ink in the suction cap 350 in an open state of being separated from the liquid ejecting head 30 is also suctioned.

When this operation starts, the reverse driving (CW rotation) of the motor 110 is first performed (Step S21). That is, the controller applies a driving voltage for the reverse rotation to the motor 110. Due to the CW rotation of the motor 110, the first gear 210 does not rotate and the second gear 220 performs the CW rotation (Step S22). As a result, as shown in the suction HP on the right side of the timing chart, the suction pump 650 performs the CW rotation and the suction operation due to the rotation of the second gear 220. Further, in this suction operation, when the FL box cover 580 is in a state before the opening movement ends (for example, closed state), the suction operation and the opening operation are simultaneously performed as shown in the timing chart.

Next, it is determined whether the motor 110 has performed the reverse rotation a predetermined number of times (Step S23). In the present embodiment, the controller counts the number of pulses output from the rotary encoder 108 of the motor 110 and determines whether the motor 110 performs the reverse rotation the predetermined number of times or not according to whether the number of pulses reaches a predetermined count number. Then, the motor 110 is continuously reversely driven until the predetermined number of times (Step S23: NO). When the motor 110 is reversely driven the predetermined number of times (Step S23: YES), the controller stops applying the driving voltage and stops the driving of the motor 110 (Step S24). Due to this operation, ink in the FL box 380 (and ink in the suction cap 350) is suctioned.

Figure 48:
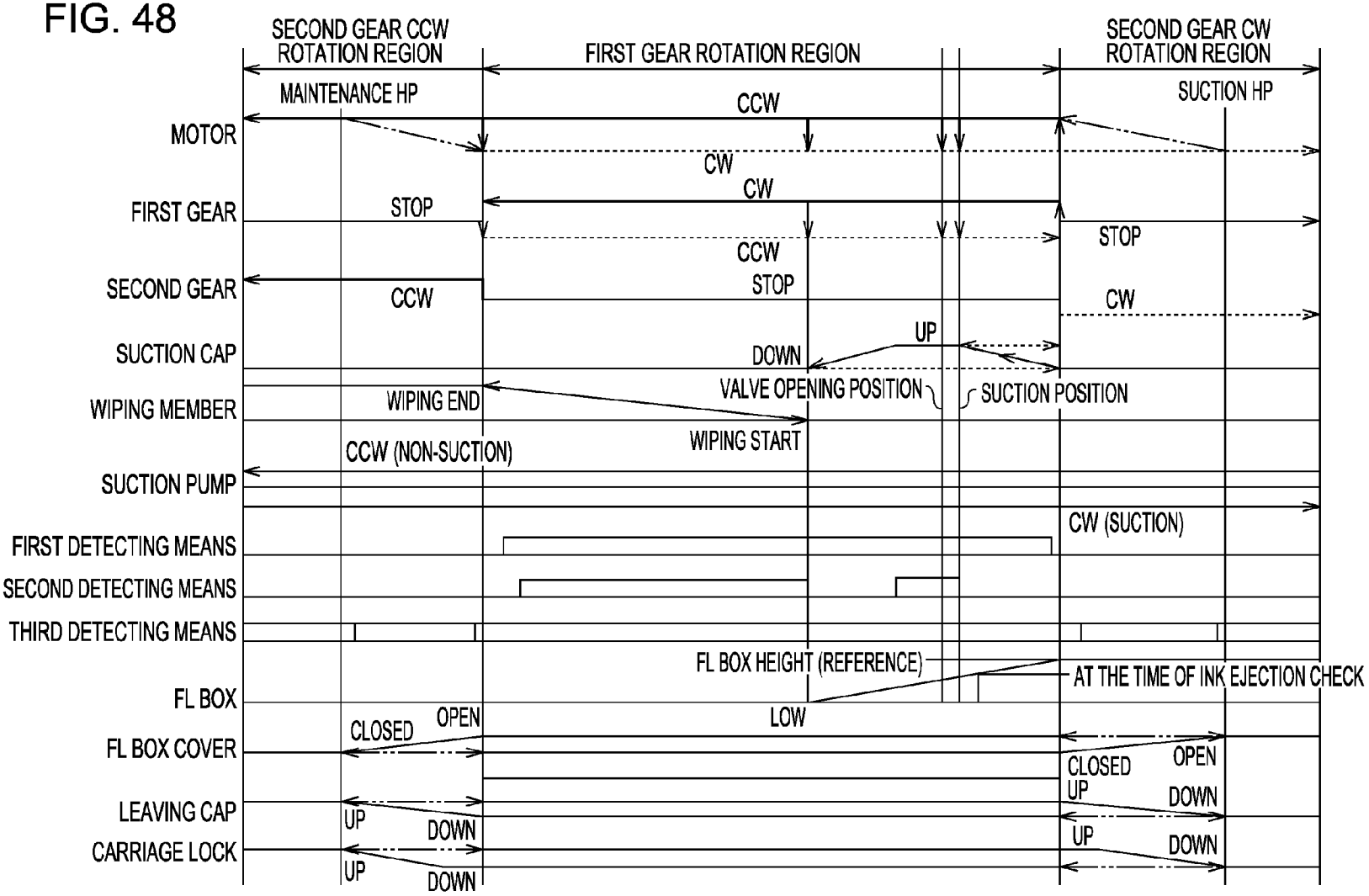
FIG. 48 is a timing chart illustrating the function operation state of the maintenance device.
Figure 51:
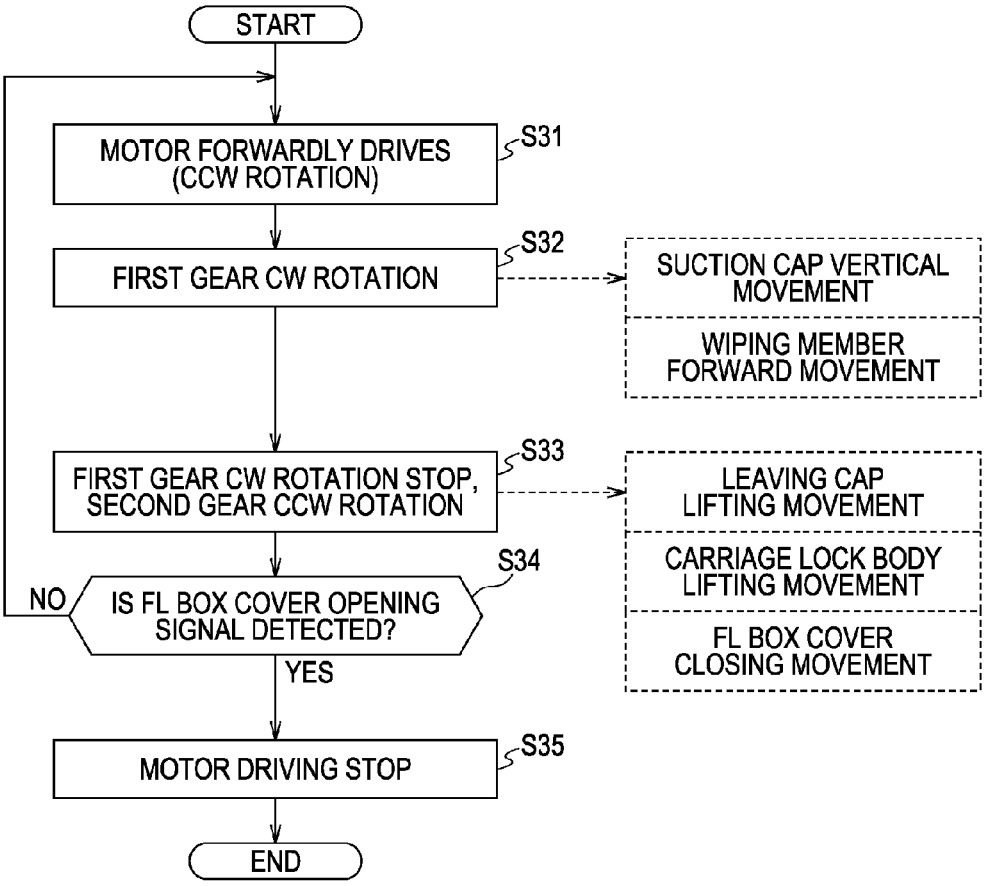
FIG. 51 is a flowchart illustrating the operation of shifting from the suction HP to the maintenance HP.

(Operation of Shifting from Suction HP to Maintenance HP) Next, assuming that the maintenance device 100 is currently in the suction HP, the operation of shifting from the suction HP to the maintenance HP since an image is not formed onto the sheet S will be described according to the flowchart shown in FIG. 51 while referring to the timing chart shown in FIG. 48.

When the shifting operation starts, the forward driving (CCW rotation) of the motor 110 is performed (Step S31). The controller applies a driving voltage for the forward rotation to the motor 110. Due to this, the operations are performed as shown in the timing chart from the suction HP shown in the right side of the timing chart to the maintenance HP shown in the left side along the thick solid line arrow illustrating the CCW rotation of the motor 110. That is, the first gear 210 performs the CW rotation (Step S32). Due to this rotation, the suction pump 350 performs the vertical movement and then the wiping member 450 performs the forward movement. Next, the first gear 210 rotates to the end and stops the CW rotation, and then the second gear 220 performs the CCW rotation (Step S33). Due to this rotation, as shown in the timing chart, the leaving cap 550 and the carriage lock body 590 performs the lifting up movement. Further, the FL box cover 580 performs the closing movement.

In addition, it is determined whether or not a closing signal indicating the closed state of the FL box cover 580 is detected (Step S34). As described above, the controller detects a predetermined voltage output from the third detecting means 83 when the FL box cover 580 is in the closed state. Further, the controller continues the forward driving of the motor 110 until the voltage is output from the third detecting means 83 and the detection signal is detected (Step S34: NO). When the detection signal is detected (Step S34: YES), the controller stops applying the driving voltage and stops the driving of the motor 110 (Step S35). Due to this operation, the maintenance device 100 is shifted from the suction HP to the maintenance HP.

Figure 52:
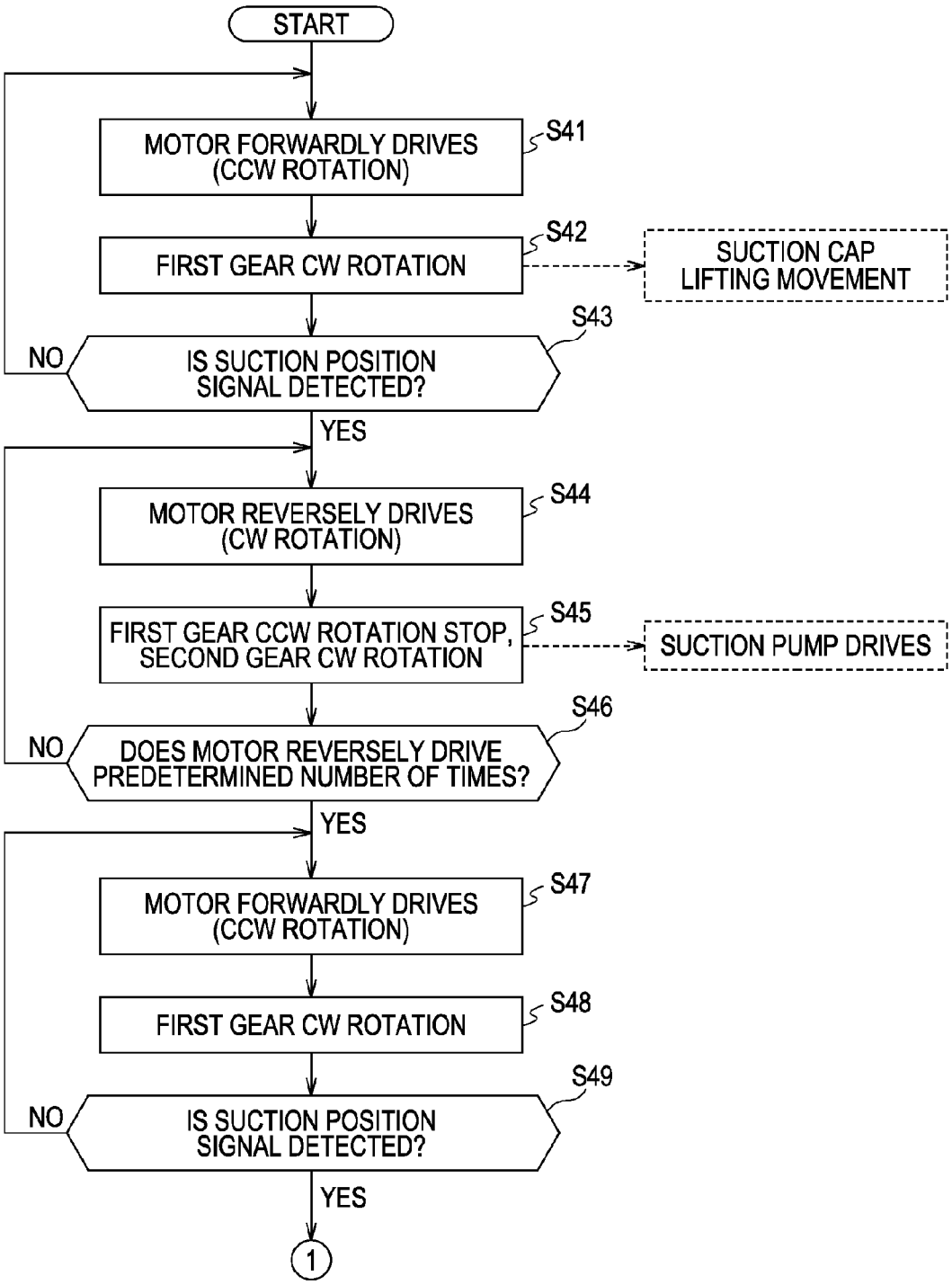
FIG. 52 is a flowchart illustrating the cleaning operation of the liquid ejecting head.
Figure 53:
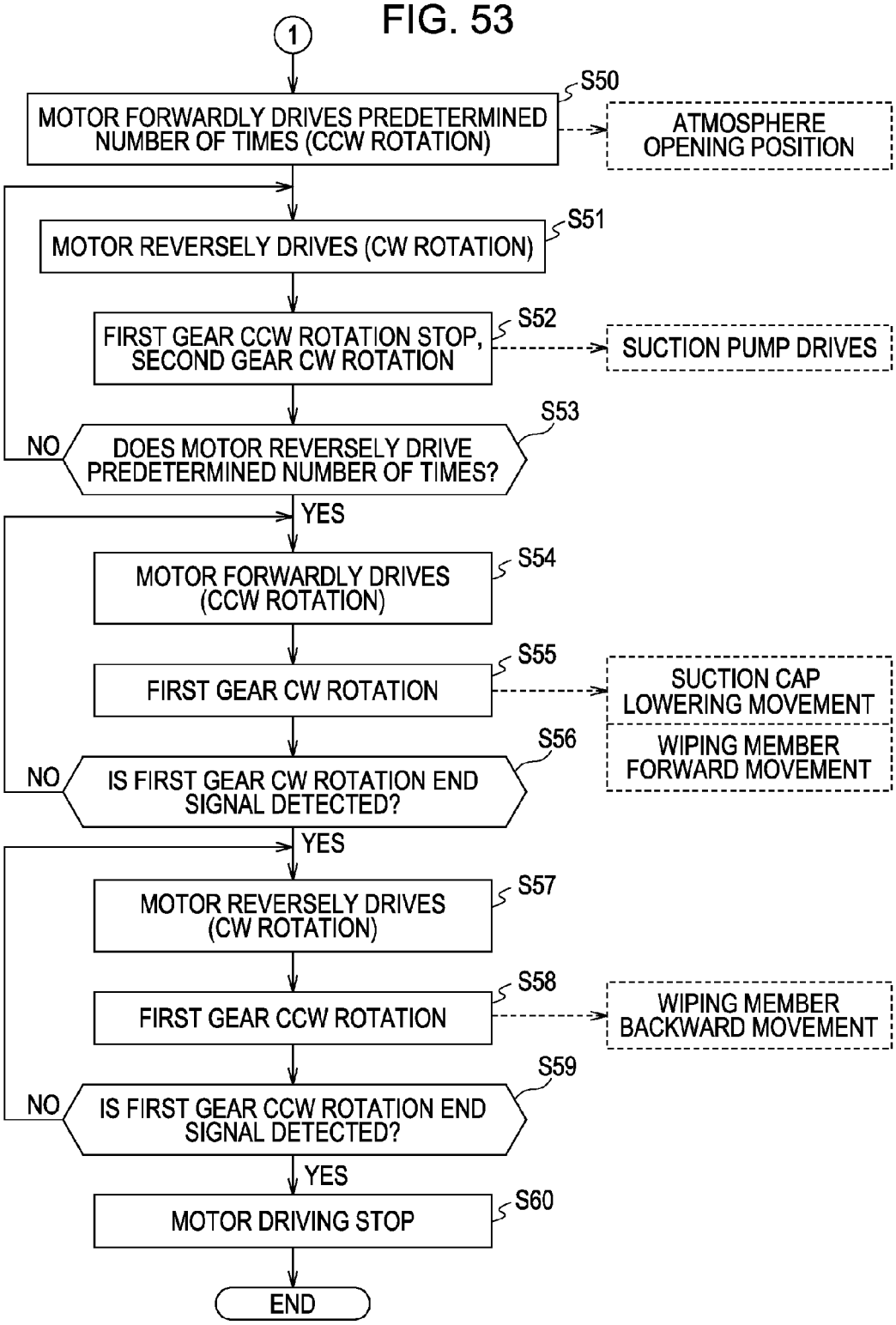
FIG. 53 is a flowchart illustrating the cleaning operation of the liquid ejecting head.

(Operation of Cleaning Liquid Ejecting Head 30) Next, when the maintenance device 100 is in the suction HP, the operation of cleaning the liquid ejecting head 30 which is performed for maintaining or recovering the ejection characteristics of the liquid ejecting head 30 in the suction HP will be described according to the flowchart shown in FIGS. 52 and 53 while referring to the timing chart shown in FIG. 48.

When the cleaning operation starts, the forward driving (CCW rotation) of the motor 110 is performed (Step S41). The controller applies a driving voltage for the forward rotation to the motor 110. Due to this, the operations are performed as shown in the timing chart from the suction HP shown in the right side of the timing chart along the thick solid line arrow illustrating the CCW rotation of the motor 110. That is, the first gear 210 performs the CW rotation (Step S42). Due to this rotation, the suction cap 350 performs the vertical movement.

Next, it is determined whether or not a suction position signal is detected (Step S43). The controller detects a predetermined voltage which is initially output from the second detecting means 82 as the suction position signal. Further, the controller continues the forward driving of the motor 110 until the voltage is output from the second detecting means 82 and the detection signal is detected (Step S43: NO). When the detection signal is detected (Step S43: YES), the controller switches the driving voltage to perform the reverse driving (CW rotation) of the motor 110 (Step S44). Due to this, the first gear 210 performs the CCW rotation. At this time, when the clutch mechanism 310 which is provided in the third gear 300 functions as a one-way clutch, the suction cap 350 is maintained at the lifted position, that is, the state of being in contact with the liquid ejecting head 30.

Next, the first gear 210 rotates to the end and stops the CCW rotation, and then the second gear 220 performs the CW rotation (Step S45). As a result, as shown in the suction HP on the right side of the timing chart, the suction pump 650 performs the CW rotation and the suction operation due to the rotation of the second gear 220.

Next, it is determined whether the motor 110 has performed the reverse rotation a predetermined number of times (Step S46). The controller counts the number of pulses output from the rotary encoder 108 of the motor 110 and determines whether the motor 110 performs the reverse rotation the predetermined number of times or not according to whether the number of pulses reaches a predetermined count number. Then, the motor 110 is continuously reversely driven until the predetermined number of rotations (Step S46: NO). When the motor 110 is reversely driven the predetermined number of times (Step S46: YES), the controller again switches the driving voltage to perform the forward driving (CCW rotation) of the motor 110 (Step S47). Due to this operation, the second gear 220 stops and the first gear 210 immediately starts the CW rotation (Step S48). During the CW rotation of the first gear 210, the suction cap 350 is already in the lifted position and is maintained at the lifted position.

Next, it is determined again whether a suction position signal is detected (Step S49). The controller detects a predetermined voltage (that is, second voltage) which is output from the second detecting means 82 as the suction position signal. In addition, the controller performs the forward driving (CCW rotation) of the motor 110 a predetermined number of times once the suction position signal is detected (Step S50). Here, the controller rotates the motor until the number of pulses output from the rotary encoder 108 reaches a predetermined number of pulses. Due to this rotation, as shown in the timing chart, in the maintenance device 100, the atmosphere opening valve 66 is opened by the cam-shaped portion 317 of the clutch plate 315 and the closed space within the suction cap 350 is in a valve opening position open to the atmosphere.

Next, in the valve opening position, the controller switches the driving voltage to perform the reverse driving (CW rotation) of the motor 110 (Step S51). Due to this, the first gear 210 performs the CCW rotation. At this time, similarly, when the clutch mechanism 310 which is provided in the third gear 300 functions as a one-way clutch, the suction cap 350 is continuously maintained at the lifted position, that is, the state of being in contact with the liquid ejecting head 30.

Next, the first gear 210 rotates to the end and stops the CCW rotation, and then the second gear 220 performs the CW rotation (Step S52). As a result, as shown in the suction HP on the right side of the timing chart, the suction pump 650 performs the CW rotation and the suction operation due to the rotation of the second gear 220 is performed again. In this case, suctioning of the closed space formed by the suction cap 350 being in contact with the liquid ejecting head 30 is performed through the tubes 63 and 65 in the state of being open to the atmosphere.

Next, it is determined whether the motor 110 has performed the reverse rotation a predetermined number of times (Step S53). The controller counts the number of pulses output from the rotary encoder 108 of the motor 110 and determines whether the motor 110 performs the reverse rotation the predetermined number of times or not according to whether the number of pulses reaches a predetermined count number. Then, the motor 110 is continuously reversely driven until the predetermined number of times (Step S53: NO). When the motor 110 is reversely driven the predetermined number of times (Step S53: YES), the controller again switches the driving voltage to perform the forward driving (CCW rotation) of the motor 110 (Step S54). Due to this operation, the second gear 220 stops and the first gear 210 immediately starts the CW rotation (Step S55). During the CW rotation of the first gear 210, the suction cap 350 performs the lowering movement after again reaching the above-described valve closing position. In addition, after the lowering of the suction cap 350 ends, the fourth gear 400 rotates this time. Therefore, when the wiper unit 420 moves to the movement end position Pe, the wiping member 450 performs the forward movement. Due to this, the wiper blade 451 wipes the liquid ejecting head 30.

Next, it is determined whether or not an end signal of the CW rotation of the first gear 210 is detected (Step S56). The controller detects the end signal indicating the end position of the CW rotation of the first gear 210 by detecting a time when a voltage which has been output from the first detecting means 81 is not output anymore. In addition, the controller continues the forward driving (CCW rotation) of the motor 110 until the voltage from the first detecting means 81 is not output anymore (Step S56: NO). When the voltage is not output anymore (Step S56: YES), the controller switches the driving voltage and performs the reverse driving (CW rotation) of the motor 110 (Step S57). Due to this, the first gear 210 performs the CCW rotation this time (Step S58).

As shown in the timing chart, due to this rotation, the fourth gear 400 reversely rotates this time, the wiper unit 420 moves to the movement start position Ps, and thus the wiping member 450 performs the backward movement. In addition, after the backward movement of the wiping member 450 ends, the third gear 300 rotates. Similarly, as shown in the timing chart, when the clutch mechanism 310 which is provided in the third gear 300 functions as a one-way clutch, the suction cap 350 is maintained at the lowered position.

In addition, it is determined whether or not an end signal of the CCW rotation of the first gear 210 is detected (Step S59). Similarly, the controller detects the end signal indicating the end position of the CCW rotation of the first gear 210 by detecting a time when a voltage which has been output from the first detecting means 81 is not output anymore. In addition, the controller continues the reverse driving (CW rotation) of the motor 110 until the voltage from the first detecting means 81 is not output anymore (Step S59: NO). When the voltage is not output anymore (Step S59: YES), the controller stops the driving of the motor 110 (Step S60). Due to this, the cleaning operation ends and the maintenance device 100 is in the suction HP.

Figure 54:
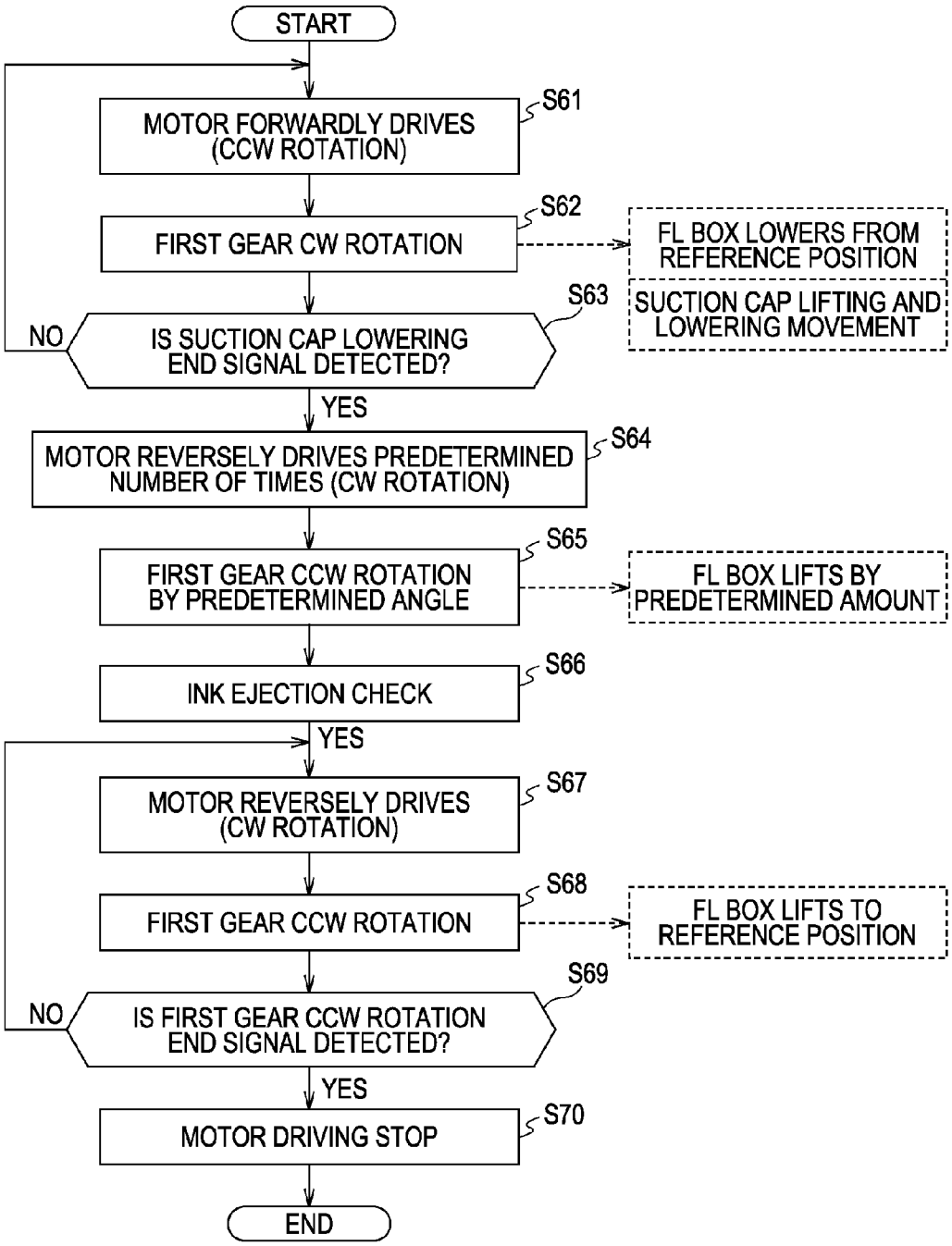
FIG. 54 is a flowchart illustrating the operation of adjusting the height of the FL box.

(Operation of Adjusting Height of FL Box) Next, when the maintenance device 100 is in the suction HP, it is checked whether or not ink is actually ejected from the liquid ejecting head 30 (that is, ink ejection check) using a voltage change in response to the ejection of ink. In the present embodiment, the ink ejection check is performed by ejecting ink into the FL box 380. For this reason, in the maintenance device 100, the distance between the FL box 380 and the liquid ejecting head 30, that is, the height in the up-down direction is adjusted. The operation of adjusting the height of the FL box 380 will be described according to the flowchart shown in FIG. 54 while referring to the timing chart shown in FIG. 48.

When this operation starts, the forward driving (CCW rotation) of the motor 110 is performed (Step S61). The controller applies a driving voltage for the forward rotation to the motor 110. Due to this, the operations are performed as shown in the timing chart from the suction HP shown in the right side of the timing chart along the thick solid line arrow illustrating the CCW rotation of the motor 110. That is, the first gear 210 performs the CW rotation (Step S62). Due to this rotation, as shown in the timing chart, during in which the suction cap 350 lifts and lowers, the FL box 380 continuously lowers from a higher position (reference position) which is a normal position in the suction HP. In addition, the position in which the suction cap 350 ends lowering is the lowest position.

Next, it is determined whether or not an end signal of the lowering of the suction cap 350 is detected (Step S63). The controller detects a predetermined voltage which is output from the second detecting means 82 engaged with the second cam-shaped portion 242 as the lowering end signal. In addition, the controller continues the forward driving of the motor 110 until the voltage from the second detecting means 82 is output and the end signal is detected (Step S63: NO). When the end signal is detected (Step S63: YES), the controller performs the reverse driving (CW rotation) of the motor 110 a predetermined number of times (Step S64). The controller reversely rotates the motor 110 a predetermined number of times by counting the number of pulses output from the rotary encoder 108 of the motor 110.

As a result, the first gear 210 performs the CCW rotation by a predetermined angle (Step S65), and the FL box 380 lifts by a predetermined amount to adjust the distance between the FL box 380 and the liquid ejecting head 30 to be a suitable distance for the ink ejection check. In addition, the third gear 300 rotates due to the CCW rotation of the first gear 210. When the clutch mechanism 310 which is provided in the third gear 300 functions as a one-way clutch, the suction cap 350 is maintained at the lowered position. Therefore, the liquid ejecting head 30 can be moved to a position opposite to the FL box 380. In addition, the ink ejection check is performed in the state where the distance is suitably adjusted (Step S66).

Next, after the ink ejection check ends, the motor 110 performs again the reverse driving (CW rotation) (Step S67).

Due to this, the first gear 210 performs again the CCW rotation (Step S68). Due to this, the FL box 380 lift and returns to the reference position.

In addition, it is determined whether or not an end signal of the CCW rotation of the first gear 210 is detected (Step S69). Similarly, the controller detects the end signal indicating the end position of the CCW rotation of the first gear 210 by detecting a time when a voltage which has been output from the first detecting means 81 is not output anymore. In addition, the controller continues the reverse driving (CW rotation) of the motor 110 until the voltage from the first detecting means 81 is not output anymore (Step S59: NO). When the voltage is not output anymore (Step S59: YES), the controller stops the driving of the motor 110 (Step S70). Due to this, the operation of adjusting the height of the FL box 380 ends and the maintenance device 100 is in the suction HP.

According to the above-described embodiment, the following effects can be obtained.

(1) When attaching and detaching the leaving cap 550, in a state where the cam roller 562 in the cap mechanism 560 is disposed so as to correspond to the plane portion 564*a* which is the non-overlapped area with the concave surface portion 566*a* and the inclined surface portion 566*b* of the wall 566 in the recess 564 of the bottom surface of the cap holder 563, the cam unit is moved such that the planer portion 564*a* is separated upward from the cam roller 562. Then, when the concave surface portion 566*a* and the inclined surface portion 566*b* of the wall 566 approaches closest to the cam roller 562, (2) in the leaving cap 550, when the cam roller 562 of the cam mechanism 560 approaches closest to the liquid ejecting head 30, the cam roller 562 is engaged with the plane portion 564*a* of the recess 564 in the cap holder 563 from below and the cap unit also approaches closest to the liquid ejecting head 30. In addition, in this case, since the contact portion 550*a* of the cap member 550A in the cap unit is in contact with the liquid ejecting head 30 from below, the cap unit is pinched by the liquid ejecting head 30 and the cam roller 562 from above and below, thereby preventing the cap unit from carelessly being removed.

(3) In the leaving cap 550, the shifting time from the state where the cam roller 562 is engaged with the recess 564 to the state where the shaft portion 562*a* is engaged with the concave surface portion 566*a* and the inclined surface portion 566*b* can be shortened, as compared to a case where one engaging portion is engaged with the recess 564 as the first engaged surface and the concave surface portion 566*a* and the inclined surface portion 566*b* as the second engaged surface which are separated from each other in the lifting and lowering direction of the cap holder 563. Accordingly, the cap unit can be moved up and down in a short period of time.

(4) When the cap holder 563 further lifts in a state where the contact portion 550*a* of the leaving cap 550 is in contact with the liquid ejecting head 30, the coil spring 565 which is interposed between the cap holder 563 and the cap member 550A is compressed to increase the biasing force to the cap member 550A. As a result, the contact portion 550*a* of the leaving cap 550 can come into close contact with the liquid ejecting head 30 on the basis of the biasing force of the coil spring 565.

(5) Ink which is scattered when the wiping member 450 is separated from the first absorption material 41 can be received in the lower side in the gravitational direction as the scattering direction. In addition, since an absorption surface (exposed surface) which receives and suctions the ink is set to have a width wider than the wiping width of the wiping means in response to the spread of the scattered ink in the scattering direction, the scattered ink can be reliably received on the absorption surface. Therefore, the suppression of contamination due to ink can be realized.

(6) Since the ink absorption body 40 can absorb liquid equivalent to a total volume which sums up a liquid volume which can be absorbed by the first absorption material 41 and a liquid volume which can be absorbed by the second absorption material 42, the ink absorption body 40 can absorb more ink than an absorption volume of the first absorption material 41. Therefore, the probability that the contamination caused by ink will occur is decreased. Further, since ink absorbed by the first absorption material 41 can be moved through the second absorption material 42, ink which is acquired in the wiping member 450 by the first absorption material 41 can always be absorbed.

(7) Ink which is scattered when the wiping member 450 is separated from the liquid ejecting head 30 can be received in the side in the wiping direction as the scattering direction. In addition, since the wall 48 is set to have a width wider than the wiping width of the wiping member 450 in response to the spread of the scattered ink in the scattering direction, the scattered ink can be reliably received. In addition, since the third absorption material 43 absorbs ink which lowers to the lower side in the gravitational direction along the wall 48 after receiving ink in the wall 48, the ink absorption body which suppresses the contamination caused by ink can be realized.

(8) The ink absorption body 40 can absorb ink equivalent to a total volume which is the sum of an ink volume which can be absorbed by the first absorption material 41 and an ink volume which can be absorbed by the third absorption material 43. Alternatively, the ink absorption body 40 can absorb ink equivalent to a total volume which is the sum of an ink volume which can be absorbed by the second absorption material 42 and an ink volume which can be absorbed by the third absorption material 43. Alternatively, the ink absorption body 40 can absorb ink equivalent to a total volume which is the sum of an ink volume which can be absorbed by the first absorption material 41, an ink volume which can be absorbed by the second absorption material 42, and an ink volume which can be absorbed by the third absorption material 43. Therefore, since the ink absorption body 40 can absorb ink to the maximum according to an absorption volume contained in each of the absorption materials, the probability that the contamination caused by ink will occur is decreased.

(9) In a state where the shaft-shaped convex portion 456 is inserted into the concave strip portion 436 from the wiping direction side and the opening hole 457 is engaged with the convex strip portion 437, the rotation about the shaft-shaped convex portion 456 of the wiping member 450 which is attached to the holding member 430 is restricted and the shaft-shaped convex portion 456 does not move from the holding member 430 in the wiping direction. Therefore, the wiping member 450 can stably wipe the liquid ejecting head 30. On the other hand, when the engagement between the convex strip portion 437 and the opening hole 457 in the wiping member 450 is released, the tip end of the wiping member 450 rotates to move in the wiping direction and thus the shaft-shaped convex portion 456 can be removed from the concave strip portion 436. Accordingly, the wiping member 450 can be easily removed from the holding member 430.

(10) Since the engagement between the opening hole 457 of the wiping member 450 and the convex strip portion 437 of the holding member 430 can be released by the portion of the upper end of the knob-shaped portion 452, an operator, for example, which performs the replacement of the wiping member 450 displaces the portion of the upper end of the knob-shaped portion 452 and thus the wiping member 450 can be easily removed from the wiping member 430 for replacement.

(11) When an operator, for example, which performs the replacement of the wiping member 450 pinches the wiping member 450 with the hand from both directions of the wiping direction and the direction opposite to the wiping direction, the portion of the upper end of the knob-shaped portion 452 can be displaced in the wiping direction. Therefore, the operator can easily remove the wiping member 450 from the holding member 430 for replacement by pinching the wiping member 450 with the hand.

(12) When the suction cap 350 lifts and approaches the liquid ejecting head 30, the liquid ejecting head 30 slides into contact with the second inclined surface 372 and the third inclined surface 373. Accordingly, the suction cap 350 is positioned by a positioning portion at a position relative to the liquid ejecting head 30 in the surface intersecting with the lifting and lowering direction. Therefore, when the suction cap 350 moves in the direction approaching the liquid ejecting head 30, the suction cap 350 accurately comes into contact with the liquid ejecting head 30 so as to cover the nozzle.

(13) At least one inclined surface of the second inclined surface 372 and the third inclined surface 373 has a shape which has a large opening toward the liquid ejecting head 30. Accordingly, when the suction cap 350 lifts and approaches the liquid ejecting head 30, the liquid ejecting head 30 reliably slides into contact with the open inclined surface. Therefore, the positioning portion can reliably position the suction cap 350 at the position relative to the liquid ejecting head 30 in the direction intersecting with the lifting direction.

(14) The liquid ejecting head 30 has an expanded shape in a plan view when seen from the direction intersecting with the lifting direction, as compared to a case where the protrusion 32 is not provided. Accordingly, the liquid ejecting head 30 can easily slide into contact with each of the sliding surfaces of the cap. Therefore, the cap can be reliably positioned at the position relative to the liquid ejecting head.

(15) In a case where the suction cap 350 lifts, when the suction cap 350 is hindered from lifting by an obstacle, the rotations of the third gear 300 as the driving side in both directions are transmitted to the third rotation shaft J3 as driven side. Accordingly, the suction cap 350 can be returned during lifting. Alternatively, in a case where the suction cap 350 is pressed by the forward driving (CCW rotation) of the motor 110 in the lowering direction when the suction cap 350 lowers, the third gear 300 rotates during the lowering movement. The suction cap 350 is hindered from lifting by the rotational load of the plural transmitting gears from the third gear 300 to the motor 110. Therefore, the suction cap 350 can be prevented from rapidly dropping during the lowering movement without using the biasing means such as a coil spring.

(16) Since the rotation of the lever member 311 is suppressed by the first suppressing wall 95 or the second suppressing wall 96, a period in which the one-way clutch does not act can be set. Therefore, the period in which the one-way clutch transmitting the rotations of the third gear 300 in both directions to the third rotation shaft J3 without using a complex clutch mechanism does not act can be easily set.

(17) In the state where the suction cap 350 is in contact with the liquid ejecting head 30, the one-way clutch can be made to act. Therefore, using the rotation of the motor 110 corresponding to the rotation in the other direction of the third gear 300 which makes the one-way clutch to act while maintaining the state where the suction cap 350 is in contact with the liquid ejecting head 30, the other function components (for example, suction pump 650) can be made to operate.

(18) In the state where the suction cap 350 is separated from the liquid ejecting head 30, the one-way clutch can be made to act. Therefore, using the rotation of the motor 110 corresponding to the rotation in the other direction of the third gear 300 which makes the one-way clutch to act while maintaining the state where the suction cap 350 is separated from the liquid ejecting head 30, the other function components (for example, suction pump 650) can be made to operate.

(19) Using the rotation of the motor 110 corresponding to the rotation of the third gear 300 in the other direction which makes the one-way clutch to act while maintaining the state where the suction cap 350 is in contact with the liquid ejecting head 30, the suction pump 650 is driven. As a result, the maintenance of the liquid ejecting head 30 can be performed by reducing the pressure of the closed space formed by being in contact with the cap to suction ink from the liquid ejecting head 30. Alternatively, using the rotation of the motor 110 corresponding to rotation of the third gear 300 in the other direction which makes the one-way clutch to act while maintaining the state where the suction cap 350 is separated from the liquid ejecting head 30, the suction pump 650 is driven. As a result, the maintenance of the suction cap 350 can be performed by suctioning ink in the suction cap 350 while the suction cap 350 is opened to the atmosphere.

(20) In the printer 11 including the suction cap (first cap) 350, the leaving cap (second cap), and the wiping member 450 which form the closed space by coming into contact with the liquid ejecting head 30 for different functional purposes, the leaving cap 550 can be moved separate from the suction cap 350 and the wiping member 450 by the single motor 110. Therefore, plural function components for maintenance of the liquid ejecting head 30 can be respectively moved by controlling the rotation of the single motor 110, for example an operation of shifting from the suction HP to the maintenance HP according to whether or not the function components is in the leaving state. As a result, the size of the head maintenance device 100 having plural maintenance functions can be decreased.

(21) Since the suction cap 350 and the wiping member 450 do not simultaneously move, the suction cap and the wiping member can move without interfering with each other. Therefore, since the suction cap 350 can share a movement area with the wiping member 450, the small head maintenance device 100 can be realized.

(22) The liquid ejecting head 30 can move to a position opposite to the leaving cap 550 using the single motor 110 without interfering with the suction cap 350 and the wiping member 450. Therefore, since the suction cap 350, the wiping member 450, and the leaving cap 550 can be disposed adjacent to each other, the small head maintenance device 100 having plural maintenance functions can be realized.

(23) The suction cap 350 can move the FL box 380 while maintaining at the separating position. Therefore, the liquid ejecting head 30 can be moved to a position opposite to the FL box 380 without interfering with the suction cap 350, and then the FL box 380 can be moved such that the distance between the FL box 380 and the liquid ejecting head 30 is a predetermined distance. Therefore, liquid ejection check which uses a potential change between the liquid ejecting head 30 and the FL box 380 can be reliably performed without increasing the number of the motor 110.

(24) The containing surface of the FL box 380 can be covered without increasing the number of the motor 110. Therefore, the small head maintenance device 100 having maintenance functions maintained can be realized by restricting, for example, drying the liquid contained in the FL box 380.

(25) The suction pump 650 can be driven by the single motor 110 to suction ink. Therefore, the small head maintenance device 100 can be realized.

(26) The lifting and lowering mechanism (displacing mechanism) including the FL cam 384 displaces the electrode member 381 as a detecting electrode in the lifting direction approaching and being separated from the nozzle of the liquid ejecting head 30. Accordingly, the distance between the nozzle and the electrode member 381 is adjusted to be a distance suitable for detecting the clogging of the nozzle. Further, in this case, since the liquid ejecting head 30 is not displaced, the distance between the liquid ejecting head 30 and the sheet S as the medium is not changed. Accordingly, after detecting the clogging of the nozzle of the liquid ejecting head 30, the process such as printing can be immediately performed on the sheet S. That is, the clogging of the nozzle of the liquid ejecting head 30 can be detected while suppressing the decrease in throughput of the process.

(27) The electrode member 381 contains the ink which is ejected into the containing portion of the FL box 380 serving as the liquid containing member as a waste liquid from the nozzle of the liquid ejecting head 30. Accordingly, the clogging of the nozzle of the liquid ejecting head 30 can be detected.

(28) In the lifting member (displacing member) including the FL cam 384, when the eighth rotation shaft J8 rotates the FL cam 384, the FL box 380 receives the pressing force from the FL cam 384 in a direction coming into contact with or being separated from the nozzle of the liquid ejecting head 30 along with the eccentric rotation of the FL cam 384. Accordingly, in the lifting member (displacing member) including the FL cam 384, the configuration in which the FL box 380 can be displaced in the direction coming into contact with or being separated from the nozzle of the liquid ejecting head 30 is realized.

(29) The biasing force is applied from the coil spring 386 to the FL box 380 so as to come into close contact with the FL cam 384 at all times. Accordingly, in the lifting member (displacing member) including the FL cam 384, the FL cam 384 reliably applies the displacing force to the FL box 380 in the direction coming into contact with or being separated from the nozzle of the liquid ejecting head 30.

(30) In a gear configuration in which the planetary gear 230 meshes with the sun gear 120 and the internal gear 222 of the second gear 220, the planetary gear 230 performs the revolving movement to rotate the first gear 210 by suppressing the rotation of the second gear 220. Meanwhile, the second gear 220 rotates by restricting the rotation of the first gear 210 and releasing the suppression for the rotation of the second gear 220. As a result, as a transmitting member transmitting the rotation of the sun gear 120 (that is, motor 110), the switching to either the first gear 210 or the second gear 220 can be performed. In this way, plural gears are selectively rotated by the single motor 110. In addition, since the rotation stop of the first gear 210 and the rotation of the second gear 220 are simultaneously performed, a driving gear can be quickly switched. Furthermore, since the planetary gears 230 are positioned between the internal gear 222 of the second gear 220 and the sun gear 120 so as to mesh with each other, tooth skipping of the planetary gear 230 can be prevented. Therefore, the driving can be reliably transmitted.

(31) The second protrusion 78 of the second hook portion 72 suppressing the rotation of the second gear 220 in response to the rotation of the first gear 210 can be displaced. Therefore, when the first gear 210 rotates, the rotation of the second gear 220 is suppressed to stop the rotation. Accordingly, a gear which is rotated by the single motor 110 can be made one. As a result, a desired driving target corresponding to, for example a rotation member which rotates can be selected and driven.

(32) In response to the rotation of the sun gear 120 (motor 110), the switching can be performed such that either the first gear 210 or the second gear 220 rotates. In addition, since the first protrusion 77 immediately shifts from the state of being engaged with the first cam portion 214 to the state of being engaged with the second cam portion 215 due to the rotation of the first gear 210, the displacement of the first protrusion 77 can be rapidly performed. As a result, since the rotation of the second gear 220 can be suppressed and the suppression thereof can be released due to the rapid displacement of the second protrusion 78 which is performed along with the first protrusion 77, the gears which are rotated by the single motor 110 can be rapidly switched.

(33) When the second protrusion 78 does not mesh with the external teeth 221 provided in the second gear 220 and comes into contact with the tip the external teeth 221, the damage of the external teeth 221 or the second protrusion 78 caused by the second protrusion 78 rotating to the first protrusion 77 is prevented.

(34) In the crank mechanism 360, when the driving lever 361 rotates about the third rotation shaft J3 on the basis of the driving force transmitted from the motor 110 as a driving source, one end 362*a* as the first connecting portion of the driven lever 362 is displaced along with the driving lever 361. In addition, the other end 362*b* as the second connecting portion of the driven lever 362 is displaced along with the displacement of one end 362*a*. Accordingly, the cap member 365 of the suction cap 350 is operated (lifted and lowered) so as to come into contact or be separated from the liquid ejecting head 30. In this case, the other end 362*b* of the driven lever 362 is displaced relative to one end 362*a* being displaced. Therefore, a relatively large lifting and lowering stroke of the cap member 365 can be secured as compared into a case where only the driving lever 361 operates the cap member 365 without the driven lever 362. That is, a large lifting and lowering stroke of the suction cap 350 can be secured while decreasing the size of the driving lever 361 and suppressing the increase in size of the entire apparatus.

(35) In the crank mechanism 360, for example, from a state where the driving lever 361 and the driven lever 362 overlap with each other in parallel, when one end 362*a* as the first connecting portion of the driven lever 362 is displaced upward to revolve about the third rotation shaft J3 along with the driving lever 361 such that one end 362*a* of the driven lever 362 is positioned at a position closer to the lower section of the driving lever 361 and the driven lever 362, the other end 362*b* of the driven lever 362 lifts so as to further approach the liquid ejecting head rather than the driving lever 361. That is, in the crank mechanism 360, since the other end 362*b* of the driven lever 362 is displaced further upward along with the operation of the driving lever 361 relative to one end 362*a* which is displaced upward, a large lifting and lowering stroke of the cap member 365 can be secured.

(36) The distance between one end 362*a* as the first connecting portion and the other end 362*b* as the second connecting portion of the driven lever 362 can be secured to the maximum. Therefore, the configuration in which the distance between both ends 362*a* and 362*b* in the longitudinal direction of the driven lever 362 is larger than the distance between the third rotation shaft J3 and one end 362*a* as the first connecting portion can be realized without increasing the size of the driven lever 362. Therefore, a large lifting and lowering stroke of the suction cap 350 can be secured while decreasing the size of the driven lever 362 and suppressing the increase in size of the entire apparatus.

In addition, each of the embodiments may be changed to the following other embodiments.

In the leaving cap 550 according to the above embodiment, only the long inclined surface portion 566*b* may be formed in parallel to the inclined surface portion 564*b* of the recess 564 without forming the concave surface portion 566*a* in the wall 566 of the cap holder 563 such that the cam roller 562 rollably comes into contact with the inclined surface portion 566*b*.

In the ink absorption body 40 according to the above embodiment, the first absorption material 41 and the third absorption material 43 may be directly in contact with each other such that ink can move without the second absorption material 42 interposed therebetween. In this way, the ink can be smoothly moved from the first absorption material 41 to the third absorption material 43. The first absorption material 41 absorbs ink of the wiping member 450 and reliably cleans the wiper blade 451.

In the above embodiment, the fourth absorption material 44 may not be provided. For example, an absorption material in which the third absorption material 43 and the fourth absorption material 44 are integrally provided may be used. In addition, an absorption material in which the second absorption material 42 and the fourth absorption material 44 are integrally provided may be used.

In the above embodiment, the first absorption material 41 and the second absorption material 42 may not be connected to each other. For example, when each of the absorption materials has a volume capable of absorbing ink, ink may not be necessarily moved between the first absorption material 41 and the second absorption material 42.

In the above embodiment, the wall 48 and the third absorption material 43 may not be provided. When the maintenance device 100 has a configuration in which ink which is acquired by the wiper blade 451 after wiping the liquid ejecting head 30 is not scattered, the wall 48 and the third absorption material 43 may not be necessarily provided.

In the above embodiment, the third absorption material 43 may not necessarily have a contact configuration in which ink can be moved between the first absorption material 41 and the second absorption material 42. For example, when each of the first absorption material 41, the second absorption material 42, and the third absorption material 43 has an appropriate amount of ink, the above-described configuration can be employed.

In the above embodiment, when the wiping member 450 is attached to the holding member 430, contrarily to the above embodiment, the engaging portion which is provided in the wiping member 450 may have a convex shape and the engaged portion which is provided in the holding member 430 may have a concave shape. For example, a convex projection may be provided in the lower end of the knob-shaped portion 452 instead of the opening hole 457 and a concave groove in the shaft-shaped portion 432 of the holding member 430 instead of the convex strip portion 437. Even in this configuration, the wiping member 450 can be removed from the holding member 430 in the same method to replace the wiping member.

In the above embodiment, the upper end of the knob-shaped portion 452 of the wiping member 450 functions as a releasing portion which releases the engagement between the opening hole 457 provided in the lower end of the knob-shaped portion 452 and the convex strip portion 437 of the holding member 430, but the upper end of the knob-shaped portion 452 may not necessarily function as the releasing portion. For example, in a configuration in which a part of the wiping member 450 such as the wiper blade 451 is pressed forward to perform the CCW rotation about the shaft-shaped convex portion 456 such that engagement between the opening hole 457 and the convex strip portion 437 is released, it is not necessary that the releasing portion is provided.

In the above embodiment, the knob-shaped portion 452 as the releasing portion may not have a configuration in which the engagement between the opening hole 457 and the convex strip portion 437 is released by being displaced in the wiping direction. For example, a configuration in which the engagement is released by being displaced in a direction intersecting with the wiping direction may be employed. Alternatively, a configuration in which the engagement is released by being displaced in a direction opposite to the wiping direction may be employed.

In the above embodiment, at least one of the first inclined surface 370 and the second inclined surface 372 may not be provided in the wall 368 of the cap member 365 of the suction cap 350. That is, the recess 369 functioning as a positioning portion of the suction cap 350 may not have an opening.

In the above embodiment, the clutch mechanism 310 may be employed for other purposes other than transmitting between the third gear and the third rotation shaft J3. For example, by mounting the clutch mechanism 310 on the fifth transmitting gear 530, the forward and reverse rotations of the motor 110 are separately used for different operations, such as the suction operation in addition to lifting operation in the leaving cap 550, through a one-way clutch mechanism.

In the above embodiment, one of the first suppressing wall 95 or the second suppressing wall 96 may not be provided. When it is necessary that the suction cap vertically moves during only either lifting or lowering of the suction cap, the above-described configuration may be used.

In the above embodiment, when the suction cap 350 is used for the same function as the leaving cap 550, the suction cap 350 does not perform the suction in a state of being contact with the liquid ejecting head 30. Therefore, in such a case, even in a case where the suction cap 350 is in contact with the liquid ejecting head 30, the first suppressing wall 95 or the second suppressing wall 96 may be formed to suppress the rotation of the lever member 311 such that the suction cap 350 can always vertically move and the one-way clutch does not act.

In the above embodiment, for example, when the maintenance device 100 have a configuration in which the atmosphere suction, that is, the vacuum suction is not performed in the separating state where the suction cap 350 does not reach the separating position, the one-way clutch may not necessarily function in the separating state. Therefore, in such a case, the first suppressing wall 95 or the second suppressing wall 96 may be formed so as to suppress the rotation of the lever member 311.

In the above embodiment, the first gear 210 may mesh with both the third gear 300 and the fourth gear 400 at the same time. In the maintenance device 100, when the movement operation of the suction cap 350 and the movement operation of the wiping member 450 can be simultaneously performed, the third gear 300 and the fourth gear 400 may simultaneously rotate.

In the above embodiment, when the suction cap 350 is in the separating position due to the rotation of the first gear 210, the leaving cap 550 lifts and moves to the contact position by switching from the rotation of the first gear 210 to the rotation of the second gear 220. For example, regardless of the movement of the wiping member 450, when the liquid ejecting head 30 can move from the position opposite to the suction cap 350 to the position opposite to the leaving cap 550, the rotation of the first gear 210 may be switched to the rotation of the second gear 220.

In the above embodiment, the flushing box 380 may not be necessarily provided as a maintenance function component which is driven due to the rotation of the third gear 300. For example, when the suction cap 350 can be also used as the flushing box 380 or when the flushing box 380 is driven by a gear other than the third gear 300 or is driven by a driving source other than the motor 110, the above-described configuration may be used.

In the above embodiment, the FL box cover 580 may not be necessarily provided as a maintenance function component which is driven due to the rotation of the fifth gear 500. For example, when the FL box cover 580 is unnecessary and not provided, or when the FL box cover 580 is driven by a gear other than the fifth gear 500 or is driven by a driving source other than the motor 110, the above-described configuration may be used.

In the above embodiment, the suction pump 650 may not be necessarily provided as a maintenance function component which is driven due to the rotation of the sixth gear 600 meshing with the second gear 220. For example, when the suction is not performed in the maintenance device 100 and not provided, or when the suction pump 650 is driven by the first gear 210 or is driven by a driving source other than the motor 110, the above-described configuration may be used.

In the above embodiment, the hand-turned gear 116 which has the external hand-turned wheel 115 having a predetermined shape may not be disposed. For example, similar to a case where the wheel 115 is hand-turned to rotate the drive transmitting gear 118 in the maintenance device 100, in a case where the drive transmitting gear 118 can be rotated by rotating the motor 110, the hand-turned wheel may not be provided.

In the above embodiment, in a configuration where the FL cam 384 is engaged with the cam engaging portion 385 of the FL box 380 as an eccentric cam during the rotation of the eighth rotation shaft J8, the shape of the cam surface of the circumferential surface thereof is not limited to the two curved surface portions 384*a* and 384*b* and the two plane portions 384*c*.

In the above embodiment, the outer circumferential groove 213 provided in the first gear 210 may be formed such that the first cam 214 of both ends thereof further approaches the first rotation shaft J1 rather than the second cam portion 215. In this case, when the first protrusion 77 reaches one end of the outer circumferential groove 213, the first hook portion 71 performs the CW rotation about the second rotation shaft J2. Therefore, in this case, when the second hook portion 72 performs the CW rotation, the rotation of the second gear 220 may not be restricted.

In the above embodiment, the first rotation member and the second rotation member can be embodied as the first gear 210 and the second gear 220, but at least one of the rotation members may not be a gear. For example, a pulley, a cam or the like may be used. In short, any components which can drive a target by the rotation may be used.

In the above embodiment, one planetary gear 230 may be provided, or three or more of planetary gears 230 may be provided in plural. Further, when the plural planetary gears 230 are provided, the planetary gears are disposed point-symmetrical about the first rotation shaft J1 at regular intervals so as to mesh with the sun gear 120. In this way, the probability that the rotational force of the sun gear 120 is balanced through the planetary gear 230 and is transmitted to the first gear 210 or the second gear 220 is increased. Accordingly, each of the rotations is stabilized.

In the above embodiment, the restriction for the rotation of the second gear 220 is performed by the first cam portion 214 and the second cam portion 215 of the outer circumferential groove 213 which are provided in the first gear 210 and the first protrusion 77 which is provided in the first hook portion 71, but it is needless to say that the invention is not necessarily limited to this configuration. For example, a configuration in which a detecting sensor for detecting the rotation state of the first gear 210 is provided in the first hook portion 71, the second hook portion 72 performs the CW rotation due to an actuator, and the rotation of the second gear 220 is restricted may be used.

In the above embodiment, the suppression for the rotation of the second gear 220 is performed by the engagement between the external teeth 221 of the second gear 220 and the second protrusion 78 of the second hook portion 72, but it is needless to say that the invention is not necessarily limited to this configuration. For example, a configuration in which a circle hole having a predetermined pitch is formed in the outer circumferential surface of the second gear 220 and the cylindrical second protrusion 78 is inserted into this hole may be used. Alternatively, a configuration in which a disk is formed in the outer circumferential surface of the second gear 220 and this disk is pinched by a so-called disk brake to suppress the rotation may be used.

In the above embodiment, the distance between the driving lever 361 and the driven lever 362 of the crank mechanism 360, and one end 362*a* and the other end 362*b* of the driven lever 362 may be equal to the distance between the portion of the driving lever 361 connected to the other end 362*b* of the driven lever 362 (first connecting portion) and the third rotation shaft J3 as the rotation center.

In the above embodiment, the liquid ejecting apparatus is embodied as the ink jet printer 11, but may be embodied as a liquid ejecting apparatus which ejects or discharges liquid other than ink. The invention may be used as various liquid ejecting apparatuses having a liquid ejecting head which ejects a minute amount of liquid or the like. Further, liquid droplet means the state of liquid which ejects from the liquid ejecting apparatus, and the examples thereof include liquid which has a trail in a granular shape, a tear shape, and a thread shape. In addition, the liquid described herein can be any liquid as long as it is ejected from the liquid ejecting apparatus. For example, a material in the liquid phase state may be used, and the examples thereof include, in addition to fluid or a material of which the state is temporally liquid, such as liquid having a high or low viscosity, sol, gel water, other inorganic solvents, organic solvents, a solution, a liquid resin, and liquid metal (metal melt), a material in which particles of a functional material including solid content such as a pigment or metal particles is dissolved, dispersed, or mixed into a solvent. In addition, typical examples of the liquid include ink described in above the embodiment and liquid crystal. Here, ink includes general water-based and oil-based ink and various liquid compositions such as gel ink and hot melt ink. Specific examples of the liquid ejecting apparatus include a liquid ejecting apparatus ejecting liquid which includes in the form of dispersion or dissolution an electrode material, or a color material used for manufacturing a liquid crystal display, an EL (electroluminescence) display, a surface-emitting display, and a color filter. Alternatively, a liquid ejecting apparatus which ejects bio-organic matters used for manufacturing a biochip, a liquid ejecting apparatus which ejects sample liquid used as high-precision pipette, a printing machine, and a microdispenser may be used. Further, a liquid ejecting apparatus which accurately ejects lubricant to a high-precision machine such as a time-keeping device and a camera, a liquid ejecting apparatus which ejects transparent resin solution such as UV-curable resin onto a substrate in order to form a micro hemispheric lens (optical lens) or the like used for an optical communication device, and a liquid ejecting apparatus which ejects etchant such as acid or alkali for etching a substrate or the like may be used. In addition, the present invention can be applied to a kind of liquid ejecting apparatuses among these.

The invention claimed is:

1. A cap device comprising:

a cap unit that can come into contact with a liquid ejecting head having a nozzle, which ejects liquid, so as to cover the nozzle, the cap unit being lifted and lowered between the liquid ejecting head, the cap unit has a first engaged surface facing downward in the lifting and lowering direction of the cap unit, and a second engaged surface facing upward at a position lower than the first engaged surface in the lifting and lowering direction of the cap unit;

a shaft perpendicular to the lifting and lowering direction and to which a driving force from a driving source is transmitted; and a lifting member that rotates about the shaft on the basis of a driving force from a driving source, the lifting member moves the cap unit in the lifting and lowering direction approaching and separating from the liquid ejecting head and has an engaging portion engaged with the cap unit, wherein, in response to the rotation in one direction about the shaft, in the lifting member, the engaging portion is engaged from below with the first engaged surface and engaging portion moves so as to follow the rotation trajectory about the shaft in the upward direction approaching the liquid ejecting head, wherein, in response to the rotation in the other direction about the shaft, the engaging portion moves so as to follow the rotation trajectory about the shaft in the downward direction separating from the liquid ejecting head and the engaging portion is engaged from above with the second engaged surface, and wherein the first engaged surface has a non-overlapped area does not overlap the second engaged surface in a direction perpendicular to both of the lifting and lowering direction and the shaft direction in a range of the rotation trajectory about the shaft and wherein the engaging portion of the lifting member moves while following the rotation trajectory about the shaft in the upward direction approaching the liquid ejecting head and is engaged with the non-overlapped area with the first engaged surface in the cap unit in a state of approaching closest to the liquid ejecting head.

2. The cap device according to claim 1, wherein the lifting member separately includes a first engaging portion that is engaged with the first engaged surface and a second engaging portion that is engaged with the second engaged surface.

3. The cap device according to claim 2, wherein the cam unit includes a cap member having:

a holder member that has the first engaged surface and the second engaged surface; a biasing member that is supported by the holder member along the lifting and lowering direction as a biasing direction; and a contact portion that is supported by the holder member through the biasing member and comes into contact with the liquid ejecting head to cover the nozzle in a state where the engaging portion of the lifting member is engaged with the non-overlapped surface of the first engaged surface in the holder member.

4. A liquid ejecting apparatus comprising:

a liquid ejecting head having a nozzle which ejects liquid; and a cap device comprising:

a cap unit that can come into contact with a liquid ejecting head having a nozzle, which ejects liquid, so as to cover the nozzle, the cap unit being lifted and lowered between the liquid ejecting head, the cap unit that has a first engaged surface facing downward in the lifting and lowering direction of the cap unit, and that has a second engaged surface facing upward at a position lower than the first engaged surface in the lifting and lowering direction of the cap unit;

a shaft perpendicular to the lifting and lowering direction and to which a driving force from a driving source is transmitted; and a lifting member that rotates about the shaft on the basis of a driving force from a driving source, the lifting member that moves the cap unit in the lifting and lowering direction approaching and separating from the liquid ejecting head and has an engaging portion engaged with the cap unit, wherein, in response to the rotation in one direction about the shaft, in the lifting member, the engaging portion is engaged from below with the first engaged surface and the engaging portion moves so as to follow the rotation trajectory about the shaft in the upward direction approaching the liquid ejecting head, wherein, in response to the rotation in the other direction about the shaft, the engaging portion moves so as to follow the rotation trajectory about the shaft in the downward direction separating from the liquid ejecting head and the engaging portion is engaged from above with the second engaged surface, wherein the first engaged surface has a non-overlapped area does not overlap the second engaged surface in a direction perpendicular to both of the lifting and lowering direction and the shaft direction in a range of the rotation trajectory about the shaft, and wherein the engaging portion of the lifting member moves while following the rotation trajectory about the shaft in the upward direction approaching the liquid ejecting head and is engaged with the non-overlapped area with the first engaged surface in the cap unit in a state of approaching closest to the liquid ejecting head.

* * * * *